US005860605A

United States Patent [19]

Van Der Zanden

[11] Patent Number: 5,860,605

[45] Date of Patent: Jan. 19, 1999

[54] METHOD AND DEVICE FOR SYNCHRONOUSLY MAKING MATERIAL COLLIDE

[75] Inventor: Johannes Petrus Andreas Josephus Van Der Zanden, Ring of Kerry, Dunbkilla, Tahilla Co. Kerry, Ireland

[73] Assignees: Johannes Petrus Andreas Josephus Van Der Zanden; Rosemarie Johanna Van Der Zanden, both of Tahilla Co. Kerry, Ireland; IHC Holland N.V., Sliedrecht, Netherlands

[21] Appl. No.: 948,077

[22] Filed: Oct. 9, 1997

[30] Foreign Application Priority Data

Oct. 11, 1996 [NL] Netherlands ..... 1004251
Jun. 9, 1997 [NL] Netherlands ..... 1006260

[51] Int. Cl.[6] ..... B02C 13/09

[52] U.S. Cl. ..... 241/27; 241/29; 241/34; 241/275

[58] Field of Search ..... 241/27, 29, 33, 241/34, 35, 36, 275

[56] References Cited

U.S. PATENT DOCUMENTS

| | | | |
|---|---|---|---|
| 2,844,331 | 7/1958 | Adams | 241/275 |
| 3,044,720 | 7/1962 | Bridgewater | 241/275 |
| 3,162,386 | 12/1964 | Danyluke | 241/275 |
| 3,174,697 | 3/1965 | Bridgewater | 241/275 |
| 3,204,882 | 9/1965 | Vifian et al. | 241/275 |
| 3,346,203 | 10/1967 | Danyluke | 241/275 |
| 4,138,067 | 2/1979 | Planiol | 241/275 |
| 4,373,679 | 2/1983 | Kawano et al. | 241/275 |
| 4,575,014 | 3/1986 | Szalanski et al. | 241/275 |
| 4,697,743 | 10/1987 | Björck et al. | 241/5 |
| 5,248,101 | 9/1993 | Rose et al. | 241/48 |
| 5,690,284 | 11/1997 | Murray | 241/41 |

*Primary Examiner*—John M. Husar
*Attorney, Agent, or Firm*—Young & Thompson

[57] ABSTRACT

The invention relates to a method for directly and multiply making material collide in an essentially deterministic manner, the material being guided by a rotating guide member, from a central feed, along a guide face and to a delivery end, in such a manner, that the material leaves the guide member, from an essentially predetermined take-off location, at an essentially predetermined take-off angle and at a take-off velocity which can be selected with the aid of the angular velocity, with the instantaneous angle (θ) between the radial line on which the delivery end is situated and the radial line on which is situated the location where the spiral stream and the path of the rotating impact member intersect one another being synchronized in such a way that the impact takes place at an essentially predetermined location, at an essentially predetermined impact angle and at an impact velocity which can be selected with the aid of the angular velocity, whereupon the material, when it comes off the impact face, collides with a collision face of a stationary impact member at a collision velocity which is at least as great as the impact velocity.

77 Claims, 29 Drawing Sheets

XII - XII

XI - XI

METHOD AND DEVICE FOR SYNCHRONOUSLY MAKING MATERIAL COLLIDE

FIELD OF THE INVENTION

The invention relates to the field of making material, in particular granular or particulate material, collide, in particular with the object of breaking the grains or particles. However, the method of the invention is also suitable for other purposes for which materials have to be hit by grains or particles at great speed, such as working or treating, for example "cubing" or cleaning, grains and particles.

BACKGROUND OF THE INVENTION

According to a known technique, material can be broken by subjecting it to an impulse loading. An impulse loading of this kind is created by allowing the material to collide with a wall at high speed. It is also possible, in accordance with another option, to allow particles of the material to collide with each other. The impulse loading results in microcracks, which are formed at the location of irregularities in the material. These microcracks continuously spread further under the influence of the impulse loading until, when the impulse loading is sufficiently great or is repeated sufficiently often and quickly, ultimately the material breaks completely and disintegrates into smaller parts. Depending on the specific material properties of the collision partners, in particular the mechanical properties, such as the elasticity, the brittleness and the toughness, and the strength, in particular the tensile strength, on the one hand of the material which collides with an impact face of an impact member at great speed and on the other hand of the material which forms the said impact face, these materials become deformed or yield during the impact. In any case, the impact loading always results in deformation and wear to both collision partners. The impact face can be formed by a hard metal face or wall, but also by grains or a bed of its own material. The latter case is an autogenous process, and the wear during the impact remains limited.

The movement of the material is frequently generated under the influence of centrifugal forces. In this process, the material is flung away from a quickly rotating rotor, in order then to collide at high speed with an armoured ring which is positioned around the rotor and optionally rotates about a vertical shaft in the same or the opposite direction. If the aim is to break the material, it is a precondition that the armoured ring be composed of harder material than the impacting material; or is at least as hard as the impacting material. The impulse forces generated in the process are directly related to the velocity at which the material leaves the rotor and strikes against the armoured ring. In other words, the more quickly the rotor rotates in a specific arrangement, the better the breaking result will be. Furthermore, the angle at which the material strikes the armoured ring has an effect on the breaking probability. The same applies to the number of impacts which the material undergoes or has to deal with and how quickly in succession these impacts take place. This method is known from various patents and is employed in a large number of devices for breaking granular material or making it collide.

Since about 1850, many hundreds of patents have been granted worldwide for this method. A distinction can be drawn here between single impact crushers, in which the material is loaded by a single impact, indirect multiple impact crushers, in which the material is accelerated again after the first impact and loaded by a second impact, which process can be repeated further, and direct multiple impact crushers, in which the material is loaded in immediate succession by two or more impacts. Direct multiple impact is preferred, since this considerably increases the breaking probability.

A single impact crusher, intended for breaking granular material, was announced in the literature as early as 1870 (Ritter Von Rittinger, Lehrbuche der Aufbereitungskunde, FIG. 34), the crusher being equipped with a rotor on which are located relatively long guides, by means of which the material is accelerated and then flung outwards, at great speed, from the delivery end of the guides against a knurled, stationary armoured ring, which is disposed around the rotor, during which impact the material, if the velocity is sufficiently great, breaks. In the known device for breaking material by means of a single impact, the material to be broken is flung outwards, under the effect of the centrifugal forces, on rotation of the rotor. The velocity obtained by the material in the process is generated by guiding the material outwards along a guide, and is composed of a radial velocity component and a velocity component which is directed perpendicular to the radial component, in other words a transverse velocity component.

The theory of the single impact crusher was described extensively as early as 1889 (M. E. Bordier; Broyeur Vapart; Revue de L'Exposition de 1889, septième partie, Tome II, Les machines-outils. Travail des divers Matériaux. Broyeurs, concasseurs, pulvérisateurs, etc., p. 627–631, 1889). When viewed from a stationary position, the take-off angle of the material to be broken from the edge of the rotor blade is determined by the magnitudes of the radial and transverse velocity components which the material possesses at the moment when it comes off the delivery end of the guide. If the radial and transverse velocity components are equal, the take-off angle is 45°. Since in the known single impact crushers the transverse velocity component is generally greater than the radial velocity component, the take-off angle is normally less than this, and lies between 35° and 45°. Over the relatively short distance covered by the material to be broken in the known devices until it strikes the impact face, the force of gravity, the air resistance, any air movements and a self-rotating movement of the grains normally have no significant effect on the direction of movement for (mineral) grains with diameters of greater than 5 mm. For grains with a smaller diameter, or grains composed of lighter material, the effect of the air resistance, in particular, increases considerably. As a general rule, it can be stated that the effect of the air resistance increases for grains of smaller diameter, while the effect of the grain configuration on the air resistance increases for grains of larger diameter. The known atmospheric impact crushers can be used to process material to a diameter of 1 to 3 mm. For smaller diameters, the breaking process has to take place in a chamber in which a partial vacuum can be created.

As long as the diameter is not too small, the material to be broken therefore moves, when seen from a stationary viewpoint, at a virtually constant velocity along a virtually straight line towards the location of the impact on the stationary armoured ring. The impact angle of the granular material against this armoured ring is defined by the take-off angle of the granular material from the delivery end of the guide and by the angle at which the impact face is disposed at the location of the impact.

In the known single impact crusher, the impact faces are generally disposed in such a manner that the impact in the horizontal plane as far as possible takes place perpendicularly. The specific arrangement of the impact faces which is required for this purpose means that the armoured ring as a whole has a type of knurled shape. A device of this kind is known from U.S. Pat. No. 5,248,101. The stationary impact faces of the known devices for breaking material are frequently of straight design in the horizontal plane, but may also be curved, for example following an involute of circle. A device of this kind is known from U.S. Pat. No. 2,844,331. This achieves the effect of the impacts all taking place at an impact angle which is as far as possible identical (perpendicular). U.S. Pat. No. 3,474,974 has disclosed a device for single impact in which the stationary impact faces are directed obliquely downwards in the vertical plane, with the result that the material is guided downwards after impact. This results in the impact angle being more optimum, while the impact of subsequent grains is affected to a lesser extent by fragments from previous impacts, which is known as interference.

The problem with the known single impact crusher described is that the comminution process takes place during one single impact which is directed as perpendicularly as possible. Examinations have shown that a perpendicular impact is not optimum for comminuting most materials by means of impact loading and that a greater breaking probability can be achieved, depending on the specific type of material, with an impact angle of approximately 75°, or at least between 70° and 85°. Furthermore, the breaking probability can be increased considerably further if the material for breaking is subjected to an impact loading not just once, but rather a number of times in quick succession, and at any rate at least twice.

Furthermore, in the impact crusher described, the impact of the granular material is to some extent considerably disturbed by the projecting corners of the impact plates. This interference can be given as the length which is calculated by multiplying the diameter of the fragments of material for breaking by the number of projecting corners of the armoured ring, with respect to the total length or the periphery of the armoured ring. In the known single impact crushers, frequently more than half the grains are interfered with during impact. This interference increases considerably as the corners of the impact plates become rounded by wear; with the result that even the beneficial effect of directing the impact faces obliquely forwards and making them curved is quickly cancelled out.

The single impact, the impact angle which is as far as possible perpendicular, and the disturbing influences resulting from interference and above all from the projecting corners are the cause of the fact that the breaking probability of the known device described for breaking material by a single impact is limited, while the quality of the broken product can exhibit considerable variations. To achieve a reasonable degree of comminution, it is frequently necessary to increase the impact velocity, which requires extra power and causes the wear to increase considerably, while an undesirably high content of extremely fine particles may result.

DE 1,253,562 has disclosed a device for breaking grains by means of a single impact in which use is made of two rotor blades situated one above the other, which are both provided with guides and both rotate in the same direction, at the same angular velocity and about the same axis of rotation. In this device, a first part of the material is accelerated onto the upper rotor blade and is flung outwards against a first armoured ring which is disposed around the upper rotor blade. The second part of the material is accelerated onto the second rotor blade, which is situated below the first rotor blade, and is flung against a second armoured ring, which is disposed around this rotor blade. The capacity is thus doubled, as it were. DE 1,814,751 has disclosed a device in which more than two systems are placed above one another.

Various patents have disclosed methods for accelerating granular material onto a rotor, the attempt being to achieve the required velocity while consuming as little power as possible and above all to limit the wear as far as possible.

U.S. Pat. No. 3,955,767 has disclosed a device by means of which the material is accelerated by guide members which are provided with relatively long rotating radial guide faces. This process has the advantage that these grains are able to make good contact with the guide face and are flung outwards from the delivery end of the guide member at approximately the same velocity and at approximately the same take-off angle. However, the wear to these relatively long guides is extremely high; this is because this wear increases very progressively, to the third power of the radial distance, as the velocity increases.

In addition to radially directed guides, devices are also known in which the guides are not disposed radially, but rather are curved forwards or backwards, when seen in the direction of rotation, and may even be of double-curved design. UK 309,854 has disclosed a device in which the guides are bent backwards and the curvature is integrated with the curvature of stationary impact faces. UK 1,434,420 has disclosed a device in which the guides are designed in the form of a so-called scoop. EP 0,191,696 has disclosed a device in which the guides are bent forwards, in such a manner that the material itself attaches to the guide face under the influence of centrifugal force, so that an autogenous guide face is formed. U.S. Pat. No. 1,875,817 has disclosed a device in which rotating hammers are disposed along the outside of the rotor blade, by means of which hammers the material is flung against stationary impact plates. Symmetrical arrangements are also known, such as from U.S. Pat. No. 1,499,455 and EP 0,562,194, which make it possible to allow the device to function rotating both forwards and backwards. UK 2,092,916 has disclosed a device in which the guide is designed in the form of a tube. It has been found that changing the form of the longitudinal direction of the guide face in general has a relatively limited effect on the wear and the power consumption, because it is, after all, necessary to achieve a certain velocity, at which the material to be broken is flung away and strikes the stationary impact member.

U.S. Pat. No. 4,787,564 has disclosed a guide member in which the guide face is perforated, so that the material is directed better and, at the same time, is guided outwards at various levels situated parallel and next to one another.

WO 96/32195, in the name of the applicant, has disclosed a rotor-blade design in which the guides with the central feed are disposed at various levels, while the discharge ends lie more towards the outside and at the same level. This means that the number of guides on the rotor blade, and thus the capacity, can be doubled without the feed of the material to the central feed of the various guide members being impeded.

U.S. Pat. No. 5,184,784 has disclosed a method for accelerating granular material, in which guide shoes, in the form of projections, are disposed on the edge of a rotor blade, relatively far away from the axis of rotation. Thus the granular material, which is metered onto the centre of the rotor and, from there, spreads outwards over the rotor blade without hindrance, is taken up at a relatively great velocity, accelerated and flung outwards. This type of rotor, which exhibits less wear than a rotor which is equipped with longer, radially directed guides, which extend from the central part to the edge of the rotor blade, is in practice in widespread use in single impact crushers. The rotor blade of the known method, having the projections, does, however, exhibit the drawback that the acceleration takes place in a very uncontrolled manner. Grains can be taken up at the corners on the inside or the outside of the projection or anywhere along the face, and from there can be loaded by means of an oblique or perpendicular impact and flung away; however, and this frequently occurs, they can also be accelerated by being guided along (a section of) the face of the projection, while combinations, in particular of an oblique impact followed by the partial guidance, are also possible. In these known methods, the grains are consequently flung outwards at extremely changeable and divergent velocities in various directions, while the wear to the guides is still in relative terms extremely high, in particular owing to impact friction and above all guide friction. Owing to the uncontrolled acceleration, the impacts of the various grains against the stationary, knurled armoured ring take place at very different velocities and at various angles. To achieve a reasonable level of comminution, the rotational speed of the rotor has to be adapted to the grains which have the lowest breaking probability, which strike against the armoured ring at the most unfavourable angle and at the lowest velocity. The rotational speed therefore has to be relatively high. The broken product thus exhibits a considerable spread in grain size distribution, frequently with a high content of undesirable, very fine constituents, while the power consumption and also the wear are still relatively high. U.S. Pat. No. 3,174,698 has disclosed a single impact crusher in which round bars are mounted instead of projections. The metering face is formed by a relatively steep cone, the intention being to allow the material to strike the round bars at a high velocity, so that the grains can break even during this impact, after which the fragments are flung outwards against the stationary armoured ring. The symmetrical arrangement of the bars makes it possible to allow the rotor blade to rotate in both directions.

It is important that the material should be metered as evenly as possible onto the metering face on the centre of the rotor. It is necessary to avoid metering the material at excessive velocity or from an excessive height. EP 0,740,961 has disclosed a device in which a metering chamber is disposed above the inlet of the rotor, from which metering chamber the material is metered onto the central part of the rotor blade in a uniform manner.

Methods are also known in which the granular material is accelerated not in one step, as in the above-described discovered methods for single impact, but rather in two steps, by means of guidance.

U.S. Pat. No. 3,032,169 has disclosed a device for accelerating granular material, by means of which the grain particles are guided from the central part of the rotor blade with a relatively short preliminary guidance to longer guides disposed directly radially on the outside; the material is accelerated along these longer guides and then flung against a stationary, knurled armoured ring disposed around the rotor blade. The object of the invention is to guide the grains, with the aid of the short preliminary guides, in a more regular distribution to the longer guides, specifically in such a manner that the grains do not strike these longer guides, but rather are accelerated along them, as far as possible by means of guidance, in order then to be flung outwards from the delivery end.

U.S. Pat. No. 3,204,882 has disclosed a device for accelerating granular material, by means of which the granular material is guided, by means of a preliminary guide disposed tangentially directly along the central part of the rotor blade, to the guide face of a guide shoe, which guide face is directed more or less at 90° outwards and is disposed at the end of the first tangential preliminary guide. This design aims to prevent the granular material from striking the guide surface of the shoe structure with an impact, instead of which it is to be accelerated along the guide surface in a regular manner and as far as possible in a sliding movement, in order then to be flung outwards, past the delivery end of the guides, against a knurled armoured ring. It is stated that this method considerably reduces the wear and that the granules are accelerated more regularly. However, the wear to the guide face of the guide shoe is still high. Impact plates are additionally arranged behind the shoe structure, by means of which impact plates material or grain fragments which rebound after impact against this stationary armoured ring are collected and loaded again. These impact plates can also be designed as impact hammers and at the same time serve as a protective structure for the rotor.

Instead of a metal guide face, the material on the rotor blade can also be accelerated along a bed of the same material, i.e. an autogenous guide face. For this purpose, the rotor blade has to be equipped with a structure in which this same material accumulates under the effect of centrifugal force and forms an autogenous guide bed, in which case the structure in question is a chamber vane structure.

U.S. Pat. No. 1,547,385 has disclosed a single impact crusher in which the material becomes attached to the rotor blade along sections of a circular wall, the material being accelerated and then flung outwards, primarily in a tangential direction, through openings in the cylinder wall, primarily with the tip velocity at that location. The amount of material which is guided outwards through the slot-like openings in the cylinder wall, that is to say the flow rate, is determined primarily by the radial velocity component which the material has at the moment at which it passes through the slot-like opening. On the baseplate of the cylindrical chamber, where the contact with the grains is limited, the material only develops a low radial velocity, with the result that the flow rate also remains limited; moreover, it is only affected to a limited extent by the angular velocity. A further problem with the known structure is that the material becomes attached to the cylindrical wall section between the slot-like openings, so that bridges can easily be formed, so that the flow of the granular material outwards is considerably impeded. The manner in which the grains are guided outwards through the openings in the cylinder wall is extremely chaotic, because essentially there is an absence of any form of guidance. Another problem is presented by the considerable wear which occurs along the walls of the slot-like opening. U.S. Pat. No. 1,405,151 has disclosed a similar design, in which the openings (delivery end) in the cylinder walls are provided with guide projections, so that an autogenous guide face can be formed. This design is improved further in U.S. Pat. No. 4,834,298, so that a tangentially directed, autogenous guide face can be formed in the cylinder.

WO 96/20789 has disclosed a device in which the material on the centre of the rotor blade is taken up in a sleeve, from where it is flung outwards along the top edge, under the influence of centrifugal force. It is claimed that this considerably limits the wear. U.S. Pat. No. 3,834,631 has disclosed a design in which the cylinder is arranged in tumbling fashion. JP 61-216744 has disclosed a symmetrical rotor-blade structure which has the form of a cone which widens downwards. The material is introduced from above onto a co-rotating distributor disc which is suspended in the top of the cone and, from there, is flung outwards, where the material becomes "attached" to the inside of the cone in vane structures which are arranged there. In these structures there is formed an autogenous guide bed which is, as it were, inverted and along which the material is accelerated and flung outwards along the bottom of the edge of the cone.

U.S. Pat. No. 3,174,697 has disclosed a device for accelerating granular material, in which the rotor is equipped with a guide, each in the form of two chamber vanes which are positioned in line with one another. Under the influence of centrifugal force, the granular material accumulates in these chamber vanes, resulting in the formation of a type of bent, tangentially directed, autogenous guide face, along which the granular material is accelerated and flung outwards.

U.S. Pat. No. 3,162,386 has disclosed a similar device for accelerating granular material with guide arms which are directed radially outwards and along which guides more than one vane structure is fastened, each of which is disposed tangentially in such a manner that the granular material accumulates in these vanes under the influence of centrifugal force, with the result that the vanes as a whole form an autogenous bed of grains, along which the granular material is accelerated and flung outwards by stepwise guidance. This combination aims to prevent the material from rubbing too much against the rotor blades, due to the fact that the fillet-like top ends of the fillings in the chamber vanes as a whole form an autogenous guide face, along which the material is accelerated and guided outwards. The number of chamber vanes is determined by the diameter of the rotor. At the same time, the wear to the guides, and in particular to the rotor, is limited. This is because the vanes are designed in such a manner that the granular material is prevented from rubbing along the bottom plates and top plates of the rotor housing, as a result of which wear to these plates is prevented. In a supplementary U.S. Pat. No. 3,346,203, a protective structure is also provided for the device of this invention, which structure is arranged in the form of pins along the edge of the rotor, between the upper and lower blades, thus preventing granular material which rebounds after it has struck the stationary armoured ring from damaging the rotor-blade structure. The known crusher brings about a certain degree of direct, multiple autogenous impact, albeit uncontrolled. Since the "impact face" essentially functions as the subsequent guide face, this action is ineffective.

EP 0,101,277 has disclosed a method for accelerating granular material and making it collide, using guides which are disposed virtually tangentially and, furthermore, are designed such that an autogenous guide face made of the same material is formed against these guides, under the influence of centrifugal force. The known structures, by means of which an autogenous guide face is formed, aim to limit wear. However, a relatively great amount of wear occurs at the delivery end of a guide of this kind. Moreover, the tangential arrangement of the guide is the cause of the fact that the radial velocity component is used only to a very limited extent for accelerating the material. The grains come off the delivery end with essentially only the tip velocity and scarcely any radial velocity. As a result, much of the added energy, approximately half, is lost. Furthermore, a large quantity of energy is lost because the grains in the rotor are guided towards the edge of the rotor in an essentially unnatural, forwards movement. Consequently, the known rotor structure has only a limited efficiency. A major problem with the known crushers is that because the grains do not develop any radial velocity along the guides, they do not have any outwards velocity, when seen from the viewpoint which moves together with the delivery end, when they come off the delivery end of the guide, and therefore they move directly backwards, seen in the direction of rotation, and cause intense wear along the outer edge of the delivery end (tip). Thus, moreover, considerable velocity is lost. Dozens of tip designs are known for the delivery end of rotors of this kind, which designs aim to limit the wear, and are known inter alia from U.S. Pat. No. 5,131,601 and EP 0,187,252, EP 0,265,580 and EP 0,452,590, UK 2,214,107 and WO 95/10358, WO 95/10359 and WO 95/11086. However, none of the known tip designs functions satisfactorily, and they are unable to prevent the occurrence of intense wear at the delivery end. U.S. Pat. No. 4,390,136 has disclosed a device in which the guide, which is of symmetrical design, is formed by vertical bars, which are disposed along the edge of the rotor blade in such a manner that a type of semi-autogenous guide face is produced.

The material is flung from the rotor against an armoured ring disposed around the rotor, during which impact the material breaks. It is possible to combine the guide and impact structures in various ways: a steel guide face and a steel impact face, known as steel-on-steel, an autogenous guide face and a steel impact face, known as stone-on-steel, an autogenous guide face with an autogenous impact face, known as stone-on-stone, and a steel guide face with an autogenous impact face, known as steel-on-stone.

The armoured ring is generally formed by separate elements, i.e. impact plates, which are disposed around the rotor blade with their impact face directed perpendicular to the straight path which the grains describe when they are flung outwards from the rotor blade. The wear to the impact plates is relatively high, since the grains continuously rub along them at high speed. U.S. Pat. No. 4,090,673 has disclosed a typical structure (steel-on-steel) in which the separate impact plates are provided with a special fastening structure, so that they can be exchanged quickly. JP 2-237653 has disclosed a device in which the impact faces are designed such that less hindrance is undergone as a result of the wear of the projecting corners. EP 0,135,287 has disclosed a design in which the impact plates comprise elongate, radial blocks which are disposed next to one another around the rotor blade. These blocks, as they become worn, can always be moved forwards, so that they have a longer service life. In this case, the impact face of the armoured ring is knurled centrally and is no longer directed perpendicular to the path which the grains describe. Overall, it has to be stated that in the known crushers the wear is relatively high in relation to the intensity of comminution.

JP 06000402 and JP 06063432 have disclosed devices in which the impact plates are vertically adjustable, so that the wear can be spread more evenly along the impact face.

JP 06091185 has disclosed a device which is symmetrical and in which it is possible to charge the length of the guide members in the radial direction and to adjust the height of the impact faces. This document contains an extensive (theoretical) discussion of the movement of granular material along a radially disposed guide face.

Instead of an armoured ring, against which the material is flung from the delivery end of the autogenous guide, a trough structure may be disposed around the edge of the rotor, in which trough an autogenous bed of the same material builds up, against which bed the granular material which is flung off the rotor blade then strikes (stone-on-stone). U.S. Pat. No. 4,575,014 has disclosed a device with an autogenous rotor blade, from which the material is flung against an armoured ring (stone-on-steel) or a bed of the same material (stone-on-stone). JP 59-66360 has disclosed a device in which the material is flung from steel guides onto an the same bed (steel-on-stone). Comminution takes place in the bed of the same material by the grains colliding with one another and undergoing friction. As a result, the wear is limited further; however, the impact intensity, i.e. the impulse loading of the grains in the autogenous ring, is limited in the known method. Due to the fact that primary the transverse velocity component (tip velocity) is active and the radial velocity component, although limited, is variably active, the grains are guided into the autogenous bed at extremely shallow but very diverse angles (from approximately 5° to 20°). Consequently, the impact against the autogenous bed of the same material takes place at a very oblique, and moreover variable impact angle, which as a result has limited effect. As a result, the grains are guided in a movement "running round" along the autogenous bed. When the grains collide with one another, the impacting grains are loaded against grains which continue to move along the said bed of the same material; i.e., as it were, from behind, which also has little effect. The level of comminution of the known method is therefore low, and the crusher is primarily employed for the after-treatment of granular material by means of rubbing the grains together, and in particular for "cubing" irregularly shaped grains. A further drawback is that if the material for breaking contains fine material, or a large number of small particles are formed during the autogenous treatment, the autogenous bed can easily become blocked, forming a so-called dead bed of fine particles. Material which strikes against and rubs along, a dead bed of this kind is relatively ineffective. It is therefore in actual fact not possible to call this a comminution process, but rather a more or less intensive after-treatment process for material which has already been broken.

JP 04300655 has disclosed a single impact crusher in which the autogenous ring is designed so that it can be emptied at the bottom, thus allowing the bed of the same material to be, as it were, exchanged regularly. As a result, a dead bed is less likely to form. U.S. Pat. No. 4,844,364 has disclosed a single impact crusher in which the autogenous bed is formed in a structure in which it can move right round, thus aiming to make the autogenous action more intensive.

JP 07275727 has disclosed a single impact crusher in which an armoured ring is disposed around part of the rotor and a bed of the same material is disposed around part of the rotor, so that the intensity of comminution differs considerably and a grain size distribution with a large dispersion can be achieved.

EP 0,074,771 has disclosed a method for breaking material using autogenous guides and a stationary bed of the same material, in which part of the granular material is not accelerated but rather is guided around the outside of the rotor. Two streams of grains are thus formed, a horizontal first stream of grains, which is flung outwards onto the rotor from the guides, and a vertical second stream of grains which, as it were, forms a curtain of granular material around the guides. The material from the first accelerated horizontal stream of grains now collides with the material of the second, unaccelerated vertical stream of grains, whereupon the two collided streams of grains are taken up in an autogenous bed of the same material, so that this can be known as an inter-autogenous comminution process. This method, which aims to save energy and to reduce the wear, has a number of drawbacks. The loading takes place by the perpendicular collision between a grain moving quickly in the horizontal direction and a grain moving relatively slowly in the vertical direction. The effectiveness of a collision of this kind is essentially low; in the most favourable scenario, when grains of the same mass hit each other full on, at most half of the kinetic energy is transmitted, while only a limited fraction of the grains actually contact each other fully. Furthermore, the material which is accelerated with the guide is concentrated in separate first horizontal streams of grains, which are guided, from the guides, around the inside of a vertical curtain, or second stream of granular material. Consequently, the grains from the second stream of grains are not all loaded uniformly. In fact some of the grains from the second stream of grains are not even touched at all before being collected at the bottom in the bed of the same material. The specific, very oblique angle at which the grains from the first stream of grains leave the rotor blade is furthermore the reason for the intensity of the impact of the collided material from the first and second streams of grains against the autogenous bed of the same material being limited. The effectiveness of the known method is therefore limited. Here too, a dead autogenous bed is easily formed, as a result of which the autogenous action along the bed of the same material is limited. Moreover, the method is extremely susceptible to changes in the quantitative distribution of the material across the first and second streams of grains.

U.S. Pat. No. 3,044,720 has disclosed a device for indirect multiple impact, in which the material is flung, with the aid of a first rotor blade, against a first stationary armoured ring where, after impact, it is taken up and guided to a second rotor blade situated beneath the first, which rotates at the same angular velocity, in the same direction and about the same axis of rotation as the first rotor blade, on which second rotor blade the second part of the material is accelerated for the second time, frequently at greater velocities than during the impact against the first impact face, and flung against a second stationary armoured ring, which is disposed around this second rotor blade. U.S. Pat. No. 3,160,354 has disclosed methods in which this process is repeated a number of times, or at least more than twice. U.S. Pat. No. 1,911,193 has disclosed a device in which the impact plates on the rotor blade situated at a lower level are disposed ever further from the axis of rotation, so that the impact velocity increases.

DE 38 21 360 (JP 0596194) has disclosed a method for indirect multiple impact, in which the material, after it has been accelerated for the first time on a first rotor blade and flung against an armoured ring, is taken up on a second rotor blade, situated below the first, from where it is flung against an autogenous bed of the same material. JP 08192065 has disclosed a similar device, in which the material is flung from both the first and the second rotor blades against a bed of the same material. This structure aims, inter alia, to utilize as much as possible of the kinetic energy which the grain still possesses after the first impact. However, this kinetic energy is generally limited, since the material often loses virtually all its kinetic energy during the stationary impact and, as it were, kills this energy. In order to prevent the formation of a dead bed in the autogenous ring, air can be injected into the trough structure from below, so that relatively fine particles can be blown out of the material bed.

Indirect multiple impact of this kind can achieve a high level of comminution. However, the wear and the power consumption are high, while it is frequently difficult, after the first impact, to guide the material uniformly to the next rotor blade, on which the material is accelerated again and undergoes a second impact.

WO 94/29027, which is in the name of the applicant, has disclosed a device for direct multiple impact, the impacts taking place in an annular and slot-shaped space between two casings which are positioned one above the other and are in the form of truncated cones which widen downwards and which are both rotatable in the same direction and at the same angular velocity as the rotor, around the same axis of rotation. Instead of cones, in the known method for direct multiple impact, the impact faces can also be composed of straight faces which are disposed in the centre before the delivery end of the guides and, in the horizontal plane, are directed perpendicular to the radius of the rotor. This angle which is directed perpendicularly in the horizontal plane may be altered by +10° and −10°, thus allowing the material which is to be broken to be guided downwards between the impact faces as far as possible perpendicularly in a zig-zag path of direct multiple impact, and making it possible to prevent the material to be broken from striking the side walls of the breaking chamber. In the rotating breaking chamber, primarily the radial velocity component is utilized; the residual energy, which is mostly transverse, is only utilized after the material is guided out of the rotating breaking chamber and strikes stationarily disposed impact faces.

Instead of being stationary, the impact face may also be designed to rotate, about the same axis of rotation as the rotor blade. In this case, rotation can take place in the same direction and at the same angular velocity as these guides, but also oppositely thereto.

UK 376,760 has disclosed a method for breaking granular material, by means of which a first and a second part of the granular material are flung outwards, with the aid of two guides which are situated directly above one another, are directed towards one another and rotate around the same axis of rotation but in opposite directions. As a result, the two streams of grains are oppositely directed, with the result that the grains hit each other at a relatively great velocity and are then taken up in a trough structure which is disposed around the two rotor blades and in which the granular material builds up a bed of the same material. In order to allow the grains to hit each other correctly, it is necessary to concentrate the oppositely directed streams of grains as far as possible in one plane between the rotor blades. With guides, this can be achieved only to a limited extent, because the grains, when they come off the delivery end, under the influence of centrifugal force, immediately move outwards in a horizontal path. Therefore, only a limited fraction of the grains actually collide fully with one another. The specific arrangement of the guides, which is necessary in order as far as possible to move the streams of grains into one plane when they come off the delivery end of the guides is the reason for the wear to the guides being relatively great. JP 2-227147 has disclosed a similar structure in which the material is launched from a symmetrical autogenous structure.

JP 2014753 has disclosed a device in which the material on a rotor, which is equipped with autogenous guides, is flung outwards against an autogenous bed of the same material, which is formed in a trough structure which rotates in the same direction as the rotor, but is driven separately.

DE 31 16 159 has disclosed a device in which an autogenous ring is disposed around a sleeve structure in the centre of the rotor blade, which autogenous ring rotates in a direction opposite to that of the sleeve structure.

JP 2-122841 has disclosed a device in which a rotor is disposed in the centre, which rotor is provided with first chamber vanes, in which material accumulates, forming a guide face, around which is disposed a rotor with similar, second chamber vanes which rotate in the opposite direction and from which the material is flung into the autogenous bed disposed around it. The material is flung from the first chamber vane at great velocity against the material in the second chamber vane and, from there, into the stationary autogenous ring. A problem with the known crusher is the transfer from the first to the second chamber vane, which is impeded to a considerable extent by the edges of the chamber vanes.

JP 2-122842 has disclosed a device in which a ring structure is disposed around the outside of the rotor with chamber vanes, which rotor is disposed in the centre, which ring structure rotates in the opposite direction and an autogenous bed accumulates therein.

JP 2-122843 has disclosed a crusher, of which two rotors are disposed in the crusher chamber, which are provided with two rotors, which are positioned one above the other, rotate in opposite directions about the same shaft and are each provided with chamber vanes, the material being guided outwards into the autogenous ring in two oblique paths which are situated one above the other and in opposite directions, which process leads to an intense after-treatment. A disadvantage is that the jets do not immediately contact one another, but rather do so only after they have struck the autogenous bed.

A significant problem with the known rotors operating in opposite directions is the complicated separate drive.

SU 797761 has disclosed a device in which the material, after it has been accelerated on the rotor blade, is flung outwards against a stationary, knurled edge, from where it is taken up again by projections which are fastened along the edge of the rotor. However, this process, which is known as direct multiple impact, is disrupted by the material not rebounding "cleanly" when it strikes the points of the knurled edge and not being taken up by the projections.

DE 39 26 203 has disclosed a rotor structure in which rebound plates are disposed behind the chamber vanes for taking up material which rebounds from the armoured ring, i.e. direct multiple impact. JP 06079189 has disclosed a similar, but symmetrical design for indirect multiple impact, the rebound plates being fastened in a pivoting manner along the outer edge. U.S. Pat. No. 2,898,053 has disclosed a direct multiple impact crusher in which the material, after it has struck a stationary armoured ring from the rotor blade, is taken up by impact plates which are suspended along the bottom of the rotor blade.

DE 39 05 365 has disclosed a direct multiple impact crusher, by means of which the material is guided from the rotor blade between impact faces which are directed radially outwards, are positioned next to one another and are disposed around the rotor blade. The material executes a zig-zag movement between these impact plates. A problem with the known impact crusher is the disruption from the points of the impact plates.

EP 0 702 598, which is in the name of the applicant, has disclosed a direct multiple impact crusher, by means of which the material, after it is flung from the rotor blade, is taken up in a circular, gap-like space which is disposed around the rotor blade and in which the material is guided downwards in a zig-zag path. This crusher functions only if the distance between the edge of the rotor blade and the surrounding stationary impact face is made to be relatively great.

PCT/NL96/00154 and PCT/NL96/00153, which are in the name of the applicant, have disclosed a method for direct multiple impact, in which the impact face is formed by a planar armoured ring which is disposed around the rotor and can be rotated in the same direction and at the same angular velocity as the rotor, around the same axis of rotation; furthermore, its impact face, which is directed inwards, has a conical shape which widens downwards. The material, which after the first impact still has a considerable residual velocity, is guided further to a stationary second impact plate or bed of the same material, where it undergoes the second impact. When seen from a co-rotating position, i.e. when seen from a viewpoint which moves together with the rotor, primarily the radial velocity component is active at the moment that the grain comes off the delivery end of the guide. The transverse velocity component of the material to be broken is in fact at that moment equal to that of the delivery end. After the material to be broken comes off the delivery end, it bends off gradually, when seen from a viewpoint which moves together with the rotor, in a direction towards the rear, when seen from the direction of rotation, thus describing a spiral path. In the known method for direct multiple impact, the impact face is directed perpendicular to the radius of the rotor shaft and therefore has to be disposed at a relatively short radial distance from the delivery end of the guide, because, if this distance becomes too great, the angle at which the material to be broken strikes the horizontal face becomes too oblique, with the result that the impact intensity decreased considerably and the wear increases considerably. The short distance required is the cause of the impact velocity against the co-rotating impact face being defined primarily by the radial velocity component. In order to generate a reasonable radial velocity component, the guide on the rotor blade has to be made relatively long, or else the angular velocity has to be raised considerably, which in both cases leads to a high level of wear to the guide and extra power consumption. Since the transverse component does not contribute to the impact intensity, or does so only to a limited extent, a not insignificant part of the energy supplied to the material to be broken is not used profitably during this first impact. However, the unused energy to a large part remains after the first impact, and in the known method for multiple impact is utilized during one or more immediately following impacts against stationary impact faces.

SU 1,248,655 has disclosed a device in which an impact means is situated outside the rotor, in line with the guide, the centre of the radial impact face of which impact means is directed perpendicular to the radius which joins this centre to the centre of the rotor, which impact face can be rotated at the same velocity as the rotor around the axis of rotation. The impact face is in this case disposed at a relatively short radial distance beyond the delivery end of the guide, since, if the radial impact face were to be disposed at a greater distance beyond the guide, the material to be broken would pass along the back of the impact face, when seen in the direction of rotation. The relatively short distance between the delivery end and the impact face has the consequence that the transverse velocity component scarcely contributes to the impact intensity, as a result of which, since the residual energy in this known method is not utilized further in the first impact, a large proportion, approximately half, of the energy supplied to the material to be broken is completely lost.

FR 2,005,680 has disclosed a direct multiple impact crusher, in which the rotor is equipped with guides which in relative terms are very short and are disposed close to the axis of rotation. In this case, the material is not metered centrally onto the rotor blade, but rather directly above the guides, from where it is flung outwards, whereupon the material is taken up by a large number of short radial impact faces which are mounted along the edge of the rotor blade. A large number of short, radially directed, stationary impact faces are disposed directly around these guides, resulting in a sort of grinding track. The conveyance of the grains between these impact faces is given extra impetus with the aid of an air flow. A problem with the known device is that there is a considerable disturbing effect during the entry of the material at the location of the top edges of the short guides, with the result that the impact acceleration is extremely chaotic, and also that there is a considerable disturbing effect at the location of the points of the co-rotating impact faces.

JP 54-104570 (U.S. Pat. No. 4,373,679) has disclosed a direct multiple impact crusher, in which the material is metered into a thin-walled cylinder which is located on the central part of the rotor blade, from where the material is flung outwards through slot-like openings in the cylinder wall, under the effect of centrifugal force. Impact members are fastened along the edge of the rotor at some distance outside the cylinder. These impact members are preferably formed by pivoting hammers. The cylinder structure with the slot-like opening is selected so as to minimize the length of the impact faces, so that the grains are not accelerated radially, but rather, with an impact, are guided outwards from the cylinder in an essentially tangential path only under the effect of the transverse velocity component (tip velocity). The aim of the method is to guide the material outwards always in an essentially tangential—i.e. essentially the same—direction, irrespective of the rotational speed of the rotor. It is stated that if the grains are guided outwards in a tangential path of this kind, the movement of the grains, even those with a relatively small diameter, is not affected by turbulence caused by the rotating hammers. Furthermore, the tangential path makes it possible to control the location where the grains strike the co-rotating hammers, by turning the cylinder with respect to the hammers. The known crusher has a number of drawbacks. The material which is metered onto the centre of the rotating rotor blade on the bottom of the cylinder describes, when seen from the slot-like opening in the cylinder wall, an outwardly directed spiral (Archimedes' spiral) path in a direction opposite to the direction of rotation of the rotor. In doing so, the material develops, with respect to the slot-like opening, only a low speed. It is therefore inevitable that part of the material will pass through the slot-like opening without coming into contact with the edge of the slot-like opening, i.e. will, as it were, roll outwards through the gaps. Some of the material comes into contact with the edge and in so doing is accelerated by means of an impact, in which case the material can be hit by the points or by the short impact face, or by the very short impact face. A significant problem with the crusher according to the invention is that since the material is unable to develop any radial velocity component, or can develop only a very limited radial velocity component, the flow rate of the said rotor blade, which is essentially a function of the radial velocity component, is limited. This was pointed out earlier in the discussion of cylindrical guide members of this kind. Furthermore, the feed of the material to the slot-like opening is disturbed to a considerable extent, due to the fact that, under the effect of centrifugal force, material becomes attached to the cylinder segments between the slot-like openings, with the result that bridges are formed in the cylindrical space. Only a limited amount of the grains will really hit the impact face of the hammers full on, with the impacts taking place spread along the impact face. Moreover, since there is no protective (tip) structure provided, the edge will become worn very quickly and irregularly, with the result that the way in which the grains are guided outwards is disturbed further. In order nevertheless to subject all the grains to an impact, a second set of hammers is provided which are mounted along the edge of the rotor blade, in a plane directly below the first hammers.

EP 0,562,163 has disclosed a symmetrical multiple impact crusher in which the rotor blade is equipped along the edge with hammers, the material being metered from above these hammers and being guided with an impact between stationary impact plates which are directed radially outwards. After striking these plates, the material falls downwards, where it is taken up by a second set of hammers, which rotate along the inside of a steel armoured ring, the opening between the hammers and the armoured ring forming a gap, so that a maximum grain dimension of the broken product is limited.

U.S. Pat. No. 4,145,009 has disclosed a rotor blade which is provided along the edge with hammers, the material being metered around the rotor blade, above the rotating hammers. An armoured ring is disposed around the outside of the hammers, the distance between the hammers and the armoured ring being adjustable, so that the maximum grain dimension of the broken product can be controlled.

In principle, it is possible with direct multiple impact crushers to synchronize the movement of the impact members in such a manner that the grains are always hit full on by the respective impact faces.

U.S. Pat. No. 1,331,969 has disclosed a multiple synchronized impact crusher in which the moving impact plates are mounted on two rotors which are situated next to one another and rotate about horizontal shafts, the rotating movement of the rotors being mutually adapted so that the material is successively hit firstly full on by the first impact plate and immediately afterwards full on by the second impact plate.

EP 0,583,515 has disclosed a device for direct multiple (double) impact, in which the material is comminuted by a first impact plate which rotates around a first axis of rotation and from which the material is guided in a direction towards a second impact face, which rotates about a second axis of rotation and the rotating movement of which is synchronized with that of the first impact face in such a manner that the material is hit full on twice immediately in succession. A problem with the known method is that the direction in which the material is guided from the first impact face inevitably exhibits a certain dispersal, with the result that this material is hit by the second rotor blade at "considerably" differing distances and thus at "considerably" differing tip velocities of the axis of rotation. It is claimed that impact against a stationary wall provides the lowest possible loading.

Impact loading is also used for the production of extremely fine material with diameters of less than 100 $\mu$m and even 100 $\mu$m. Since the movement of fine material is affected to a considerable extent by the air resistance, the rotor therefore has to be disposed in a chamber in which there is a vacuum. To break fine material (powder) by impact loading to give an extremely fine product, the material has to be introduced at a very great velocity, which places high demands on the structure whose rotor blade has to rotate at a very high speed, while a high level of wear is found on the means by which the material is accelerated.

U.S. Pat. No. 4,138,067 has disclosed a single impact crusher in which the material is flung outwards with the aid of a rotor, which is provided with closed guide ducts, into a chamber in which there is a vacuum and in which a stationary armoured ring is disposed around the outside of the rotor. Other centrifugal vacuum impactors have been disclosed in U.S. Pat. No. 4,645,131 and U.S. Pat. No. 4,697,743 and U.S. Pat. No. 4,738,403.

EP 0 750 944 discloses an vacuum low temperature impact system.

SUMMARY OF THE INVENTION

The known methods for accelerating granular materials and then making them collide, with the aim of breaking or comminuting, working and cleaning this material, have been found to have drawbacks. For example, the efficiency of the many known methods for comminution by means of single impact, indirect multiple impact and direct multiple impact, is rather low, primarily owing to the chaotic nature of the methods: much of the energy supplied to the material is converted into heat, which is at the expense of the energy available for breaking. An additional drawback is the rather considerable wear to which the comminution device with which this method is carried out is exposed. The process with which the material is accelerated proceeds in a rather uncontrolled manner. The grains leave the rotor blade at different take-off velocities and at varying take-off angles, with the result that the various grains from the stream of grains can strike the stationary armoured ring, which is disposed around the rotor blade, at varying velocities and at differing angles, while the knurled, stationary armoured ring in part interferes considerably with the comminution process, which interference increases considerably as the projecting points of the armoured ring become worn. The stream described by the accelerated grains before they strike the said armoured ring is disrupted further by rebounding fragments (interference). Impact against an autogeneous bed of the same material limits the wear but requires a relative high amount of energy and has a relative limited crushing efficiency. All the above has the result that the comminution process cannot always be controlled equally well, so that not all parts are broken uniformly. The comminution product obtained as a result frequently has a relatively great grain size distribution and spread in grain configuration, and may contain a relatively great proportion of undesirable fine parts.

The object of the invention is therefore to provide a method, as described above, which does not exhibit these drawbacks, or at least does so to a lesser extent. This object is achieved by means of an essentially deterministic method for making material collide with the aid of a rotating impact member, comprising the steps:

feeding the said stream of material ($S_c$) to the central feed of a guide member which rotates about the axis of rotation (O) of the said rotating system;

guiding the said fed stream ($S_c$) of material from the said central feed, along the guide face, to the delivery end of the said guide member, which delivery end is situated at a greater radial distance from the said axis of rotation (O) than the said central feed, in such a manner that the said guided stream of material comes off the said guide member with at least a radial velocity component ($v_r$) and is guided in an essentially deterministic straight stream (R), when seen from a stationary viewpoint, and in an essentially deterministic spiral stream (S), when seen from a viewpoint which moves together with the said guide member;

using the said rotating impact member to hit the said material which is moving in the said essentially deterministic spiral stream (S) and has not yet collided, which rotating impact member is provided with an impact face and rotates in the same direction, at the same angular velocity (Ω) and about the same axis of rotation (O) as the said guide member, at a hit location (T) which is behind, when seen in the direction of rotation, the radial line on which is situated the location (W) where the said as yet uncollided stream of material leaves the said guide member, and at a greater radial distance from the said axis of rotation (O) than the location at which the said as yet uncollided stream of material leaves the said guide member, the position of which hit location (T) is determined by selecting the angle (θ) between the radial line on which is situated the location (W) where the said as yet uncollided stream of material leaves the said guide member and the radial line on which is situated the location where the stream (S) of the said as yet uncollided material and the path (C) of the said impact face intersect one another in such a manner that the arrival of the said as yet uncollided stream (S) of material at the location where the said stream (S) and the said path (C) intersect one another is synchronized with the arrival at the same location of the said impact face.

In the method according to the invention, the grains to be broken, as is usual, are metered onto a metering face, which is disposed on the centre of a rotor, and, under the effect of centrifugal forces, are accelerated with the aid of a rotating guide member and flung away outwards, i.e. "launched" in the direction of an impact member which, at a greater radial distance, rotates in the same direction, at the same angular velocity (Ω) and about the same axis of rotation as the said guide member. The unit comprising rotating guide member and rotating impact member is here referred to as the rotating system. The said guide member is equipped with a central feed, a guide face and a delivery end. According to the method of the invention, each grain from the stream of material is launched in a predetermined fixed, controlled and unimpeded manner, i.e. in an essentially deterministic manner: i.e. from a predetermined take-off location (W), at a predetermined take-off angle (α) and at a take-off velocity ($v_{abs}$) which can be selected with the aid of the angular velocity (Ω). As a result, the stream which the grains then describe is also fixed.

The movement executed by a grain in the process can, in effect simultaneously, be seen from both a stationary viewpoint and a viewpoint which moves together with the guide member or the rotating impact member. Although the movement which takes place in the same period of time is identical in both of these cases, the path described by the movement of the grain is extremely different when seen from the respective viewpoints. To understand the method of the invention, it is of essential import that the movement executed by the material between the guide member and the rotating impact member is simultaneously seen from both a stationary viewpoint and from a viewpoint which moves along therewith.

When seen from a stationary viewpoint, the grains, after they have been metered onto the rotor blade, move in a virtually straight, radially directed stream outwards, towards the outer edge of the metering face, where the stream of material is taken up by the guide member and accelerated. When the stream of material comes off the delivery end of the guide member, this stream moves along a virtually straight path and the velocity of the movement is virtually constant. This velocity is equal to the take-off velocity ($v_{abs}$) with which the grains leave the guide member. The direction of the straight stream is determined by the take-off angle (α), the grains in the plane of the rotation moving outwards, when seen from the axis of rotation, and forwards, when seen in the direction of rotation.

When seen from a viewpoint which moves together with the rotating impact member, the grains on the metering face describe an outwardly directed, short spiral stream, approximating to an Archimedes' spiral, and from the delivery end they describe a long spiral stream, which is directed more radially outwards than the short spiral, the relative velocity of the movement increasing, when seen from the rotating impact member, as the grain moves further away from the axis of rotation. At the moment at which the grain comes off the guide member, the relative velocity is lower than the take-off velocity ($v_{abs}$), but it quickly exceeds the latter, whereupon the relative velocity along the spiral stream increases, and further on in the stream relative velocities can be reached which are a multiple of the take-off velocity ($v_{abs}$). The direction of the movement of the spiral stream, as for the straight stream, is determined by the take-off angle (α), the grains in the plane of the rotation moving outwards, when seen from the axis of rotation, and backwards, i.e. in the opposite direction to the straight stream, when seen in the direction of rotation. After the take-off velocity ($v_{abs}$) has been exceeded, the grains cover a greater relative distance along the spiral stream than along the straight stream, the difference in length increasing as the grains move further away from the axis of rotation.

The function of the guide member is thus to "launch" the grains in succession, in such a manner that they are flung away in a defined stream, the "short" natural spiral stream which the grains describe on the metering face being converted, with the aid of the guide member, into a "longer" spiral stream which the grains describe between the guide member and the rotating impact member, when seen from a viewpoint which moves together with the rotating impact member.

According to the method of the invention, the accelerated granular material is not allowed to collide directly with a stationary or co-rotating armoured ring, armoured plate or bed of the same material which is disposed around the rotor, but rather the grains are first hit in their spiral stream, after leaving the guide member, by the impact face of a rotating impact member, which impact face is disposed virtually transversely in the spiral stream which the grains describe after leaving the guide member. The rotating impact member is situated at a greater radial distance from the axis of rotation than the delivery end of the guide member, from where the grains are launched. Nevertheless, the impact member rotates in the same direction and at the same angular velocity (Ω) and about the same axis of rotation as the guide member, which means that the absolute velocity in the peripheral direction of the said rotating impact member is greater than this corresponding velocity of the grains, when seen from a stationary viewpoint. The difference in the absolute velocity in the peripheral direction, i.e. the difference in absolute transverse velocities, between the grains and the rotating impact member roughly provides the impulse loading, under the effect of which the breaking process takes place. In addition, the grains still have a radially outwardly directed velocity component with respect to the rotating impact member, which radial velocity component is of essential importance to the accuracy with which the impacts of the grains against the collision face of the stationary impact member take place.

It can be demonstrated that, in a rotating system, the path which a grain describes, from the moment at which the said grain comes off a guide face until the moment at which the said grain strikes an impact face of a rotating impact member, is not affected by the angular velocity (Ω), or the take-off velocity ($v_{abs}$), when the following conditions are satisfied:

the take-off angle (α) of the said grain on leaving the said guide member is independent of the said angular velocity (Ω);

the take-off location (W) at which the said grain leaves the said guide member is likewise independent of the said angular velocity (Ω);

the said take-off velocity ($v_{abs}$) of the said grain after leaving the said guide member, with regard to a viewpoint which moves together with the said rotating impact member, is proportional to the angular velocity (Ω) of the said rotating impact member.

If these conditions are satisfied, then the route covered by the said grain between the said guide member and the said rotating impact member is constant. Since the said distance is constant, and since the said distance is the product of the constant velocity ($v_{abs}$) and the time (t) elapsed, and the said velocity ($v_{abs}$) is proportional to the said angular velocity (Ω), the said elapsed time (t) is inversely proportional to the said angular velocity (Ω). Since the peripheral velocity ($V_{tip}$) of the said rotating impact member is also proportional to the said angular velocity (Ω), the route covered along the periphery, which the said rotating impact member describes, is not affected by the angular velocity (Ω) in the said elapsed time (t). This demonstrates that the route covered by both the said grain and the said rotating impact member is always constant in relation to the said angular velocity (Ω).

This makes it possible to synchronize the movement executed by the rotating impact member with the movement executed by the grain, so that, irrespective of the angular velocity (Ω), the impact of the grain against the impact face of the rotating impact member takes place at a predetermined synchronization location (T) and at a predetermined impact angle (β), the impact velocity ($V_{impact}$) being proportional to the angular velocity (Ω) and can thus be selected with the aid of the said angular velocity (Ω) without in so doing affecting the impact location (T) or the impact angle (β).

For the sake of completeness, it should be noted that the friction between the grain and the guide face, which is given by the coefficient of friction (ω), is affected slightly, although minimally, by the angular velocity (Ω), and as such slightly affects the take-off angle (α) and the take-off velocity ($v_{abs}$). However, this effect is so minimal that it can be disregarded here. However the friction as such has to be taken into account.

In order to satisfy the abovementioned conditions, the grains therefore have to leave the guide member, irrespective of the angular velocity (Ω), at the same location and at the same take-off angle (α), when seen from a stationary viewpoint, the take-off velocity ($v_{abs}$) may only be affected by the angular velocity (Ω) and the movement of the grains along the stream may not be substantially affected by the air resistance and air movement; i.e. both the way in which the grains leave the guide member and the stream which the grains then describe must be essentially deterministic.

In theory, the grains can be guided (launched) in a deterministic manner in a deterministic stream of thus kind for any take-off velocity ($v_{abs}$) and at any take-off angle (α) between 0° and 90°: with an extremely short rotating impact face with a take-off angle (α) of approximately 0° in a straight tangential stream, and with a spiral (Archimedes' spiral) guide member with a take-off angle (α) of approximately 90° in a straight radial stream, when seen from a stationary viewpoint. However, in reality the possibilities are limited, and certain conditions have to be met with regard to the take-off velocity ($v_{abs}$) and the take-off angle (α), while the effect of air movements has to be limited as far as possible.

In order to bridge the relatively short distance between the guide member and the rotating impact member without the force of gravity and the air resistance significantly affecting the movement of the grains, a take-off velocity ($v_{abs}$) of 10 to 15 meters per second is normally sufficient for grains with diameters of greater than 3 to 5 mm. At lower velocities, the movement of the grain is increasingly affected by both the air resistance and the force of gravity, with the result that the spiral paths described by the grains start to shift in an uncontrolled manner. For smaller diameters, the influence of the air resistance increases considerably, essentially irrespective of the velocity, and in order for the process to proceed in an essentially deterministic manner it is necessary to create a vacuum in the chamber between the guide member and the rotating impact member.

The effect of the air movements which are generated by the rotating guide member and the rotating impact member can be limited by setting in motion, at the same time as the grains, an air stream, which has virtually the same velocity as the grains, with the aid of the guide member along the spiral stream, so that, as it were, a cylindrical disc (flying dish) of air is formed between the guide member and the rotating impact member, this air rotating in virtually the same direction, at virtually the same angular velocity (Ω) and about the same axis of rotation as the guide member and the rotating impact member.

In order to allow the separate grains from the stream of grains to come off the guide member from virtually the same location and at virtually the same take-off angle (α), irrespective of the angular velocity (Ω), with only the take-off velocity ($v_{abs}$) being affected by the angular velocity (Ω), it is necessary for the grains to be taken up in a regular manner by the central feed of the guide member, making good contact with the guide face in the process, so that the grains are guided to the delivery end over a certain distance along the guide face, so that the radial and transverse velocity components of the individual grains from the stream of material, at the moment at which they reach the delivery end and come off the guide member, are virtually constant. To achieve this, the length of the guide face has to be selected such that the radial velocity component ($v_r$) at the location of the delivery end is at least 35% till 55% of the transverse velocity component ($v_t$), i.e. so that the take-off angle (α) is greater than or equal to 20°, and preferably 30°. A shorter guide face leads not only to a shorter take-off angle (α), but is also the cause of the grains starting to come off the guide member at varying take-off velocities ($v_{abs}$) and at different take-off angles (α), and in the process even the location where the grains come off can shift. The shorter the guide is chosen to be, such that the take-off angle (α) becomes less than 30°, the more chaotic the process becomes.

Thus, in order to realize the abovementioned conditions in practice, the said material has to be accelerated along the said guide face in such a manner that, when the said material is taken from the said delivery end in a straight stream, the said take-off velocity ($v_{abs}$) is at least 10 meters per second, and preferably at least 15 meters per second, and the take-off angle (α) is at least 20°, and preferably at least 30°, when seen from a stationary viewpoint. The maximum take-off angle (α) is normally limited in practice to 45°, so that the feasible range in which the grains can be guided in an essentially deterministic stream from the guide member to the rotating impact member irrespective of the angular velocity (Ω) lies between the take-off angles (α) of 30° and 45°. This places certain requirements on the guide member.

After the granules have been metered onto the rotating metering face close to the axis of rotation, they move outwards in a virtually radial direction, when seen from a stationary viewpoint, and outwards in a spiral stream, when seen from a viewpoint which moves together with the face, which spiral movement normally approximates to an Archimedes' spiral.

The movement of the stream of material moving outwards, from the metering face, along the said spiral is interrupted by the guide member, which is normally arranged in the spiral at a distance from the axis of rotation. That part of the guide face of the guide member which intersects the stream of material is referred to as the central feed. This central feed forces the material stream to move in a more radial direction, with the result that the movement is accelerated. The length ($l_c$) from the start point to the end point of the central feed is thus determined by the shape of the spiral stream of material, and as such is a function of the angular velocity (Ω) at which the guide member is rotating, the radial velocity ($v_a$) of the material at the moment at which it touches the central feed and the number of guides ($n_g$) which radial length ($l_c$) essentially satisfies the equation:

$$l_c = \frac{\chi V_a}{\Omega}$$

The length ($l_c$) of the central feed therefore increases at lower angular velocities (Ω) and greater initial radial velocities ($v_a$): the latter being a function primarily of the way in which the material is metered (height of drop) and the shape of the metering face. It is important that the length of the central feed, which, after all, is not completely effective for accelerating the material in the radial direction is kept as short as possible. This is achieved by allowing the system to rotate at a sufficiently great angular velocity (Ω) and keeping the initial radial velocity ($v_a$) as low as possible, i.e. as far as possible limiting the height of drop from which the stream of material is metered onto the metering face. Furthermore, the shape of the central feed can be selected in such a manner that the stream of material is taken up as well as possible by the guide member; this matter will be dealt with later in the text.

In order to promote a good feed of the metered material to the central feed, it is furthermore preferred to provide the grains with a preliminary guidance, in the direction of a central inlet of the guide member, from the said rotating face with the aid of a preliminary guide member, which extends from a central inlet in a direction opposite to the direction of rotation of the rotating face towards a discharge end. It is preferred here for the preliminary guidance of the said preliminary guide member as far as possible to approximate to the natural spiral movement, i.e. Archimedes' spiral, which the said material describes at that location, or at least for the said central inlet and the said discharge end of the said preliminary guide member to lie on the natural movement spiral described by the material; i.e. for the radial distance from the discharge end of the preliminary guide member to the axis of rotation to be approximately 10 to 15% greater than the corresponding radial distance to the central inlet of the preliminary guide member.

From the central feed, the material is taken up by the guide face and moves outwards along the latter, under the effect of centrifugal force, during which movement the material is accelerated. As has been stated, it is important that in the process the material makes good contact with the guide face. The guide face has to be at least sufficiently long for the grains to leave the guide member from a delivery end always at the same take-off location (W) and always at the same take-off angle (α), irrespective of the angular velocity (Ω). A lower take-off velocity ($v_{abs}$) results in a higher impact velocity ($V_{impact}$), but the take-off velocity ($v_{abs}$) has to be at least 10 m/sec. The function of the guide member is thus to guide the grains at as low a velocity as possible in an essentially deterministic spiral stream. The aim is to achieve direction, and not so much to achieve velocity.

It is furthermore important that no more material is added to the guide members than the amount which the latter are able to deal with in an essentially deterministic manner; i.e. that the grains come off the guide member essentially in succession (virtually one by one) and that the impacts are not disrupted by interference. This so-called essentially deterministic capacity is determined by the grain diameter and, of course, by the angular velocity (Ω) and the length of the guide face. The deterministic capacity decreases considerably for smaller grain diameters. This is balanced by the fact that it is possible, in the case of smaller grain diameters, to design the rotor blade with more guides, so that the essentially deterministic capacity of the rotor blade as a whole is not affected excessively.

Starting from a radially arranged guide face, the minimum length of the guide face which is required in order to make the grains come off the guide member in an essentially deterministic manner is, for a resistance-free state given by the relationship between the radial distance from the axis of rotation to the central feed and the corresponding radial distance to the delivery end, i.e. ($r_c/r_1$), which ratio essentially satisfies the equation:

$$\frac{r_c}{r_1} = \sqrt{1 - \tan^2\alpha}$$

To achieve a take-off angle (α) of 30° the ratio $r_c/r_1$= ~25%, and for 20° the ratio $r_c/r_1$=~10%. In the event of a different coefficient of friction and in the event that the guide face is not arranged radially and is not straight, but rather is of curved design, the relationship between the said radial distances has to be adapted. In the event that the guide face is not arranged radially, or is curved, the relationship can also be calculated; however, this calculation is complicated, but essentially satisfies the equation:

$$\alpha = \arctan\left(\frac{\cos\alpha_0\sqrt{r_1^2 - r_c^2}}{r_1 - \sin\alpha_0\sqrt{r_1^2 - r_c^2}}\right)$$

If the delivery end is positioned towards the rear, when seen in the direction of rotation, a greater radial velocity component ($v_r$) is generated by comparison with a radial arrangement of the guide face, while the transverse velocity component ($v_r$) decreases slightly, resulting in a greater take-off angle (α). This makes it possible, while retaining the prescribed take-off angle (α), to make the radial distance from the delivery end to the axis of rotation shorter. Conversely, if the delivery end is positioned towards the front, the opposite is the case. It is therefore possible to achieve the prescribed take-off angle (α) with a relatively short radial distance from the axis of rotation to the delivery end, making it possible to reduce the take-off velocity ($v_{abs}$).

In the case of a radially arranged guide member, the central feed is directed virtually perpendicular to the short spiral stream which the material describes on the metering face. The movement of this stream, at the location of the central inlet, therefore has to form an angle of approximately 90°, which can lead to blockage, with the result that the flow rate from the guide member is limited. It is therefore preferred to curve the central feed and to position it with the entry in line with the short spiral stream, as a result of which the material is taken up and guided to the guide face in a better and more natural manner. Since there is only a limited take-off velocity ($v_{abs}$), of approximately 10 meters per second, the guide face can be designed with a straight face which is directed obliquely backwards, when seen in the direction of rotation. From the guide face, the stream of material is guided towards the delivery end, from where the material is guided in an essentially deterministic, long spiral stream. The said delivery end may be bent backwards, when seen in the direction of rotation, so that the grains are guided, as it were, in a natural manner from a location on the said delivery end in the intended, essentially deterministic spiral stream, in the direction of the rotating impact member. An essentially S-shaped "grain pump" of this kind makes it possible to convert the movement of the stream of material in as natural a manner as possible, and thus with minimum energy and wear, from a short spiral into an essentially deterministic long spiral.

The grains advancing in an essentially deterministic spiral stream are now hit for the first time, specifically by the impact face of the rotating impact member, which impact is likewise essentially deterministic, specifically such that, irrespective of the angular velocity (Ω), the hitting takes place at a predetermined hit location (T), at a predetermined impact angle (β) and at an impact velocity ($V_{impact}$) which can be specified and can be controlled with the aid of the angular velocity (Ω). For this purpose, the angle (θ) between the radial line on which is situated the location at which the said as yet uncollided stream of material leaves the guide member and the radial line on which is situated the location at which the stream of the as yet uncollided material and the path of the said rotating impact member intersect one another has to be selected in such a manner that the arrival of the said as yet uncollided stream of material at the location at which the said stream and the said path intersect one another is synchronized with the arrival at the same location of the rotating impact member.

A plurality of guide members with associated impact members can be disposed around the axis of rotation. Since the synchronously running steps of accelerating and striking the material from essentially individual processes for each of the arrangements, these processes can be differentiated by changing the position of the guide member and/or the rotating impact member for each arrangement, in which case the principle of differentiation is referred to. A differentiated arrangement of this kind makes it possible for the separate breaking processes to take place simultaneously but at different collision velocities or impulse loading. As a result, a differentiated arrangement of the impact members leads to the production of materials of differing fineness, with the result that the grain size distribution of the broken product can be controlled to a considerable extent. This can be achieved by varying only the radial distances to the various locations where the grains leave the guide member amongst themselves or, and this is the preferred option, by arranging the rotating impact member at a different location, or at a different distance from the axis of rotation, in the spiral stream described by the grains.

Furthermore it is possible to vary the amount of material which is fed to the various guide members. The guide members as it were divide the rotor blade into feed segments. Normally, the guides are arranged at regular intervals and at the same radial distances from the axis of rotation. In this case, the feed segments are of equal sizes and the stream of material is distributed uniformly over the guide members. However, it is also possible to make the size of the feed segments different. This is known as the principle of segmentation. An irregular segmentation of this kind may, for example, be achieved by arranging the start points of the central feed ends of the guide members at different radial distances from the axis of rotation. The guide members which are disposed with the central feed closer to the axis of rotation now take up more material than the guide members whose central feed is further away from the axis of rotation. Such segmentation of the material makes it possible to regulate further the amounts of material which are broken into fine and coarse particles. Naturally, segmentation is also possible with the aid of the preliminary guide members.

To obtain the desired result, i.e. the desired collision between grains and the rotating impact member, the angle (θ) between the radial line on which is situated the location where the material leaves the guide member and the radial line on which is situated the location where the material is hit by the impact face, with the aid of the rotating impact member, must essentially satisfy the equation:

$$\theta = \arctan\left(\frac{p\cos\alpha}{p\sin\alpha + r_1}\right) - p\frac{\cos\alpha}{fr_1}$$

in which:

$$f = \frac{v_{abs}\cos\alpha}{v_{tip}} \qquad p = r_1\left\{\sqrt{\frac{r^2}{r_1^2} - \cos^2\alpha} - \sin\alpha\right\}$$

It is necessary here to take into account the grain diameter. The further the grain diameter increases, the longer the grain makes contact with the guide face at the location of the delivery end, resulting in a greater transverse and, in particular, radial velocity component, and consequently a greater take-off angle (α) and a greater take-off velocity ($v_{abs}$). The influence is in any case limited, but is the cause of a natural shift, which is per se deterministic, of the spiral stream for larger and smaller grains. The radial distance to that location at which the material leaves the guide member ($r_1$) is therefore calculated as the sum of the corresponding radial distance to the delivery end of the guide member, increased by half the diameter of the grains from the material.

Since the angle (θ) has an unambiguous relationship with the radial distance (r) from the axis of rotation to the hit location (T), it is in fact possible to dispose the impact face at precisely the correct location, i.e. in a synchronized manner.

In order to achieve an effective collision between particle and the impact face of the rotating impact member, it is preferred for the angle (θ) to be greater than 10°; preferably greater than 20° to 30°. The maximum angle (θ) is essentially limited only in practical terms, but may even be greater than 360°.

In the calculation, a resistance-free state is assumed. In reality, the movement of the grains is in actual fact subject to, inter alia, friction against components of the rotor and to the air resistance. The same applies to the force of gravity. In this calculation, a role is played by the grain diameter, the grain configuration and the self-rotation of the grains. These parameters have a certain influence on the stream, although without changing the nature of the movement significantly.

However, this influence is generally limited for the limited distance between the guide member and the rotating impact member, which is covered at high speed by the grains, and thus in a very short period of time (normally 30–60 ms), although the influence cannot be ignored altogether. Furthermore, we have to deal with the influence of air movements which are caused by the rotation of the system. These may be limited by forming a type of rotating (flying) dish of air in the space between the guide member and the rotating impact member, so that the air rotates together with the guide members and the impact members.

Different grains from one stream of material can therefore describe different paths next to one another, owing to a natural, but essentially deterministic shift, with the result that the grains do not all hit precisely the same location on the rotating impact member. Although the effect is normally limited, it is necessary in practice, when positioning, dimensioning and selecting the rotating impact member, to take into account the fact that the impacts can to some extent spread over a certain region on the impact face because of natural effects. As we shall see later, this is in itself beneficial, since the wear is thus also spread along the impact face.

As well as the hit location, it is also possible to specify the angle (β) at which the grains hit the impact face of the rotating impact member in a fairly accurate manner. At the location where the said as yet uncollided material hits the said impact face, the said impact face, together with the line which is directed perpendicular to the radial line on which is situated the location at which the said material leaves the said guide member, forms an impact angle (β'), when seen in the plane of the rotation and when seen from a viewpoint which moves together with the said rotating impact member, which angle essentially satisfies the equation:

$$\beta' = \arctan\left\{\frac{\frac{r^2\cos\alpha}{fr_1} - \left\{\frac{r\cos\phi}{p\sin\alpha + r_1}\right\}^2 r_1\cos\alpha}{r_1\sin\alpha + p}\right\} - \theta$$

in which:

$$\theta = \arctan\left(\frac{p\cos\alpha}{p\sin\alpha + r_1}\right) - p\frac{\cos\alpha}{fr_1}$$

$$p = r_1\left\{\sqrt{\frac{r^2}{r_1^2} - \cos^2\alpha} - \sin\alpha\right\}$$

$$\phi = \arctan\left\{\frac{p\cos\alpha}{p\sin\alpha + r_1}\right\} \quad f = \frac{v_{abs}\cos\alpha}{v_{tip}} \quad v_{tip} = \Omega r_1$$

With the aid of the angle (β'), it is in fact possible to curve and arrange the impact face in such a manner that different grains from the stream of material all strike the impact face of the rotating impact member at an angle which is as far as possible identical, which impact angle (β) preferably lies between 75° and 85°.

In order as far as possible to limit the wear to the said impact face of the said rotating impact member, it is necessary to prevent the said material from moving outwards along the said impact face after impact; i.e. to prevent the said impact face starting to function as a "guide acceleration member" in addition to as an "impact acceleration member". This leads, at the relatively great radial distance from the axis of rotation on which the said rotating impact member is disposed and the associated high peripheral speed at that location, to an extremely high level of wear along the outer edge of the said rotating impact member; which guide acceleration and guide wear do not contribute significantly to an improved progression of the comminution process. By directing the said impact face slightly (a few degrees) inwards, when seen in the plane of the rotation, at an angle (β"), with respect to the position directed perpendicular to the said spiral stream of the said material, and directing the said impact face slightly (a few degrees) downwards, in the plane directed perpendicular to the plane of the rotation, at an angle (β'''), the said material can be guided downwards, as far as possible perpendicularly along the impact face, after impact, provided it does not rebound, where it comes off along the edge of the said impact face of the rotating impact member: in which case there is no significant centrifugal acceleration, so that the wear on the guide remains limited to a minimum and interference is prevented, since the impact face is immediately free for the impact of the said following material. The calculated angle (β') in fact makes an arrangement of this kind possible.

The precise velocity at which the grains hit the impact face of the rotating impact member, i.e. the actual impact velocity ($V_{impact}$), is a function of, on the one hand, the radial distance from the axis of rotation to the central feed end of the guide member, the corresponding radial distance to the location from which the grains leave the guide member and the location at which the grains hit the impact face and, on the other hand, the angular velocity (Ω) of the guide member and of the rotating impact member, and essentially satisfies the equation:

$$V_{inslag} = \sqrt{\dot{r}^2 + r^2\dot{\theta}^2}$$

in which:

$$\dot{\theta} = \left\{\frac{\cos\phi}{p\sin\alpha + r_1}\right\}^2 v_{abs}r_1\cos\alpha - \frac{v_{abs}\cos\alpha}{fr_1}$$

$$\dot{r} = v_{abs}\frac{p + r_1\sin\alpha}{r}$$

$$\phi = \arctan\left\{\frac{p\cos\alpha}{p\sin\alpha + r_1}\right\}$$

$$f = \frac{v_{abs}\cos\alpha}{v_{tip}}$$

$$p = r_1\left\{\sqrt{\frac{r^2}{r_1^2} - \cos^2\alpha} - \sin\alpha\right\}$$

$$r = \sqrt{r_1^2 + 2r_1p\sin\alpha + p^2}$$

$$v_{tip} = \Omega r_1$$

It is therefore possible, for a defined angular velocity (Ω), successively to select the radial distance from the axis of rotation to the central feed end of the guide member, the radial distance from the axis of rotation to the location where the as yet uncollided grains leave the guide member, and the radial distance from the axis of rotation to the location where the as yet uncollided grains are hit for the first time by the rotating impact manner, such that the as yet uncollided grains are hit for the first time by the rotating impact member at a prescribed impact velocity ($V_{impact}$).

It is also possible, for a guide member with a defined radial distance from the axis of rotation to the central feed end of the guide member, a defined radial distance from the axis of rotation to the location where the as yet uncollided grains leave the guide member, and a defined radial distance from the axis of rotation to the location where the as yet uncollided grains are hit for the first time by the rotating impact member, to select the angular velocity (Ω) such that the grains are hit for the first time by the rotating impact member at a prescribed impact velocity ($V_{impact}$).

As has been stated, the high level of determinism of the method of the invention for making material collide has the consequence that the impacts against the said impact face of the said rotating impact member can take place in a relatively concentrated manner. This may be the cause of problems. If the impacts against the impact face of the breaking member take place in an excessively concentrated manner, this may lead to a non-uniform wear pattern along this face, with the result that the breaking process can be disturbed significantly. However, as explained above, there is normally a natural, although limited, spread and shift of the deterministic spiral paths which the separate grains of the said material run through; for example due to the fact that grains with a large grain diameter make contact for a longer period with the guide member than grains with smaller diameters, and thus leave the delivery end at a slightly different take-off angle (α) and take-off velocity ($v_{abs}$). Furthermore, the air resistance, the air movements and even the force of gravity will to some extent affect the movement of the separate grains. In addition to the grain diameter, the shape of the grain, the grain configuration and the self-rotation of the grain also have an effect here. As will be dealt with later in the text, the spiral movement will also shift to a certain extent as a result of wear along the said guide face and along the said impact face. Thus there is normally a natural, outwardly widening spiral bundle of paths, which is otherwise still essentially deterministic.

However, it may also prove necessary to take measures to ensure that the impacts spread out to a greater extent across the impact face. An artificial shift of the location, i.e. the limited area where the said material from the said spiral stream hits the said impact face, may be of essential import; in particular when the natural spread is limited and when the grains become very pulverized during the first impact and the fragments are not removed from the location of the said impact quickly enough (this occurs in particular in the event of the impact of very tough material), with the result that the intensity of the following impacts is limited (damped), in which case interference is involved. A regular shift of this kind can be achieved by allowing the position of the delivery end of the guide member to move slightly, when seen from a viewpoint which moves together with the rotating impact member. A relatively small movement of the delivery end, as stated above, quickly leads to a greater displacement further on in the spiral stream. The delivery end can be moved in a relatively simple manner by arranging the guide member pivotably along the edge of the rotating face, in such a manner that the delivery end, in the plane of the rotation, executes a slight reciprocating movement along the circumference which the delivery end describes, when seen from a viewpoint which moves together with the rotating impact member; the invention provides for this possibility.

On the other hand, it may happen that the spiral streams along which the grains are guided to the rotating impact member become somewhat excessively spread, with the result that some grains from the stream of material hit the impact face on the edge or fly right past it. The method of the invention therefore provides the option of a subsequent guide member which can be disposed, between the guide member and the rotating impact member, along a section of the intended spiral stream; preferably along the outside, when seen from the axis of rotation. It is in any case possible actively to involve the subsequent guide member in providing subsequent guidance for the grains, by allowing the subsequent guide face of the subsequent guide member to intersect slightly the spiral stream of the grains.

Owing to wear on the guide face, and in particular on the delivery end, of the guide member, the spiral stream between the guide member and the rotating impact member shifts gradually backwards, when seen in the direction of rotation, with the result that the location of the impact on the impact face of the rotating impact member also shifts. It is necessary to prevent the delivery end being able to become worn to such an extent that the impact face is no longer hit by all the grains from the stream of material. It is possible to adapt the wear along the guide member and on the rotating impact member, i.e. to integrate this wear, in such a manner that in the event of wear to the guide member the rotating impact member always lies in the spiral stream of the said material. This is known as the principle of integration, although this principle cannot be summarized by a formula; however, it can be simulated using a computer. Together with practical observations, this makes it possible to mutually adapt the design and the geometry of the guide member and the rotating impact member to the shift backwards, when seen in the direction of rotation, of the said spiral stream through which the said material runs between the said guide member and the said rotating impact member, which seen from a viewpoint which moves together with the said rotating impact member, which shift arises as a result of wear to the said guide face and in particular to the said delivery end, and specifically to adapt them such that, in the event of wear to the said guide member, the said impact face always lies in the said spiral stream of the said material.

As has been stated, the impact of a grain from the stream of material against the impact face of the rotating impact member can be impeded by other grains or fragments which are formed from these grains during the impact. This occurs in particular if grains are pulverized during the impact, in which case the very fine particles, in particular if they are moist, may adhere to the rotating impact face. As, indicated earlier, this can be partially prevented by disposing the rotating impact face at an oblique angle, inwards and downwards, with respect to the impacting stream of material. The method of the invention furthermore provides the possibility of guiding a jet of air, in the vertical direction from the top downwards, at great speed against the rotating impact face, with the result that the impact face is continuously blown clean. The jet of air can be generated with the aid of the rotating movement of the rotating impact member, by disposing a partition or pipe, directed obliquely downwards, along the top of the edge of the rotating impact member.

In contrast to the known method, in which the material is flung from the guide member directly against a stationary impact member, essentially no velocity remaining after the stationary impact, the said material leaves (rebounds from) the rotating impact member after the impact with a rebound or residual velocity ($V_{residual}$) which is at least as great as the peripheral velocity (tip velocity ($V_{tip}$)) of the rotating impact member, which velocity, depending on the coefficient of restitution, is frequently greater (5–15%) than the impact velocity ($V_{impact}$). This residual velocity ($V_{residual}$) can be further utilized by allowing the material then to strike the collision face of a stationary impact member, which collision face is disposed in the straight stream which the material describes after it has struck the rotating impact member and come off the latter, when seen from a stationary viewpoint.

The stationary impact member can be formed by at least one collision face. The stationary impact member can be made with a collision face of hard metal, which collision face is directed virtually transversely to the straight stream which the said material which has collided once describes when it comes off the said rotating impact member, when seen from a stationary viewpoint. The stationary impact member can also be formed by a collision face, which is formed by a bed of the same material, which collision face is directed at the straight stream which the said material which has collided once describes when it comes off the said rotating impact member, when seen from a stationary viewpoint.

The collision face of the stationary impact member can be designed in such a manner that the separate grains impact at an angle which is as uniform as possible. For this purpose, the said collision face has to be curved and arranged in such a manner that the impacts, when seen from the plane of the rotation, take place as far as possible perpendicularly; and when seen from a plane perpendicular to the plane of the rotation, at an angle which is optimum for the loading of the material, normally lying between 75° and 85°, and preferably between 80° and 85°. This is possible both for a collision face made of hard metal and for a collision face which is formed by a bed of the same material.

The fact that the said impacts take place regularly, immediately in succession and at an angle which is as optimum as possible leads to a very great loading intensity on the grains and a correspondingly high breaking probability, while the wear is limited as far as possible.

A second impact against a collision face made of the same material allows a very intensitive autogenous (after) treatment of the said material which has collided once. Compared to known systems, in which the grains are introduced into the autogenous bed in the plane of the rotation, i.e. virtually horizontally, the method according to the invention has the advantage that the material can be guided from the said impact face which is also moving, at relatively great speed, into the said autogenous bed, obliquely from above, thus considerably enhancing the intensity of the autogenous treatment. Furthermore, it is possible to arrange the collision face in such a manner that an autogenous bed of the same material is built up, arranged virtually transversely in the straight stream of granules, thus enhancing the autogenous intensity still further. However the impact face of the autogeneous bed can also be positioned in such a way that the grains are introduced virtually or horizontally or obliquely form below; which can be the preferred way, depending on the crushing behaviour of the material.

The method of the invention thus makes it possible to bring granular material from a predetermined location on the guide member, at a predetermined take-off angle ($\alpha$>30°) and at a relatively low take-off velocity ($v_{abs}$) (>10 meters per second) into a deterministic spiral stream and then to allow the said material to strike at great speed against an impact face, disposed transversely further on in the spiral stream, of a rotating impact member, which rotates in the same direction, at the same angular velocity ($\Omega$) and about the same axis of rotation as the guide member. The impact face of the said rotating impact member can be positioned in such a manner that the impact takes place at a predetermined hit location (T), at a predetermined impact angle ($\beta$), at a predetermined impact velocity ($V_{impact}$), which impact velocity ($V_{impact}$) can be selected accurately, within very wide limits, with the aid of the rotational speed ($\Omega$), without the location of impact and the angle at which the impact takes place being affected. This high residual velocity ($V_{residual}$) which the grains still possess after they come off the rotating impact member, i.e. approximately half of the comminution energy, can be utilized further for a second impact of the material against a stationary collision face or a bed of the same material.

In the method according to the invention, the material is thus accelerated in two steps, short guidance followed by impact while moving along, while the said material is simultaneously loaded in two, immediately successive steps, co-rotating impact immediately followed by stationary impact, the second impact taking place at an collision velocity ($V_{residual}$) which is at least as great as the velocity at which the first impact ($V_{impact}$) takes place. Both the two acceleration steps and the two loading steps, which overlap one another, proceed in an essentially deterministic manner, with the result that as little energy as possible is lost, the wear remains limited and the loading intensity is very great and regular. The method of the invention thus leads to a very great, and essentially deterministic, collision intensity with a relatively low power consumption and a relatively low level of wear.

The method of the invention makes possible a device for breaking granular material, comprising:

at least one rotor which can rotate around a central, vertical axis of rotation (O) and is provided with a shaft;

at least one guide member, which is supported by the said rotor and is provided with a central feed, a guide face and a delivery end, for respectively feeding, guiding, accelerating and delivering the said stream of material which, in a region close to the said axis of rotation (O), is metered onto the said rotor, which guide member extends in the direction of the external edge of the said rotor;

at least one rotatable impact member, which is associated with the said guide member and can rotate around the said axis of rotation (O), which rotatable impact member is equipped with an impact face which lies entirely behind, when seen in the direction of rotation, the radial line on which is situated the location (W) at which the said as yet uncollided stream of material leaves the said guide member and at a greater radial distance from the said axis of rotation (O) than the location (W) at which the said as yet uncollided stream of material leaves the said guide member, the position of which impact face is determined by selecting the angle ($\theta$) between the radial line on which is situated the location (W) at which the said as yet uncollided stream of material leaves the said guide member and the radial line on which is situated the location at which the said essentially deterministic stream (S) of the said as yet uncollided stream of material and the path (C) of the said impact face intersect one another, in such a manner that the arrival of the said as yet uncollided material at the location where the said stream (S) and the said path (C) intersect one another is synchronized with the arrival at the same location of the said impact face, which impact face is directed virtually transversely, when seen in the plane of the rotation, to the spiral stream (S) which the said as yet uncollided material describes, when seen from a viewpoint which moves together with the said rotatable impact member.

The forgoing and other objectives, features and advantages of the present invention will be more readily understood upon consideration of the following detailed description of the invention taken in conjunction with the accompanying schematic drawings.

DETAILED DESCRIPTION OF THE INVENTION

Figure 1:
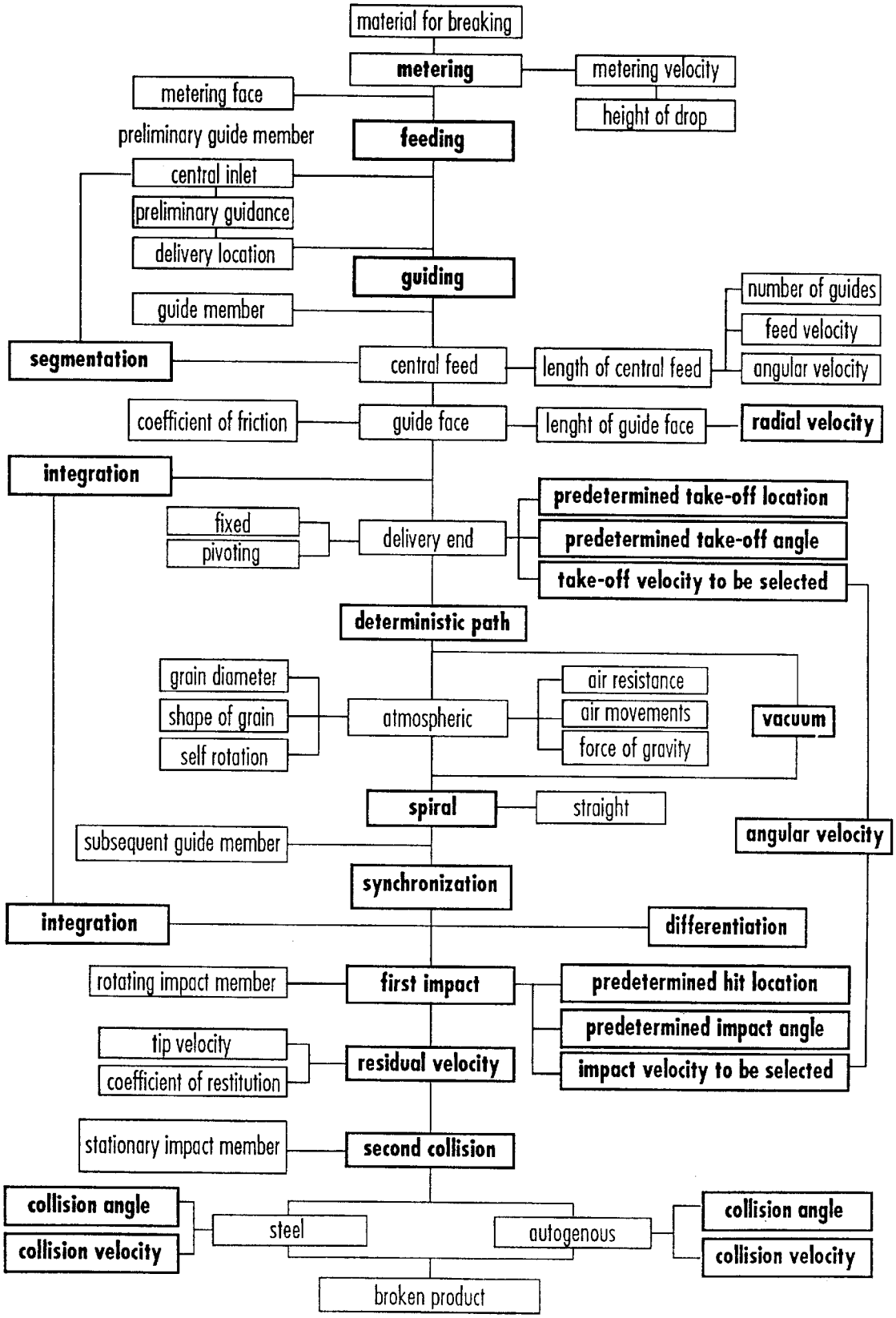
FIG. 1 diagrammatically shows, in steps, the progress of the method of the invention.

FIG. 1 shows in steps the progress of the method of the invention: the material is metered in a rotating system onto a rotor and, from there, is fed, optionally with the aid of a preliminary guide members to the central feed of a guide member rotating about a vertical axis of rotation (O), whereupon the material is brought up to speed along the guide face of the said guide member and, above all, is guided in the desired direction, so that the stream of material from the delivery end of the said guide member comes off from a predetermined take-off location (W) at a predetermined take-off angle ($\alpha$) and at a take-off velocity ($v_{abs}$) which is defined by the angular velocity ($\Omega$) and is thus predetermined, and is brought into an essentially deterministic spiral stream, when seen from a viewpoint which moves along, in an atmospheric environment at normal temperature or in an partially vacuum environment at normal or lower temperatures, which spiral movement is synchronized with the movement of a rotating impact member, which is situated at a greater radial distance from the axis of rotation (O) than the said delivery end, in such a manner that the said stream of material strikes the impact face of the said rotating impact member at a predetermined hit location (T), at a predetermined impact angle and at an impact velocity ($V_{impact}$) which can be selected with the aid of the angular velocity ($\Omega$) and is thus predetermined, whereupon, after the said stream of material has collided for the first time and comes off the said impact face, the stream of material is guided at the residual velocity, which is at least as great as the impact velocity ($V_{impact}$), in a straight stream (R), when seen from a stationary viewpoint, and the stream of material, immediately after the first impact and at an essentially predetermined collision velocity ($V_{collision}$), at an essentially predetermined collision angle, strikes the collision face of a stationary impact member which is disposed in the said straight stream (R), which collision face may consist of a metal face or is formed by a bed of the same material. A number of specific additional possibilities are indicated, as are a number of factors which affect the separate steps in the process.

Figure 2:
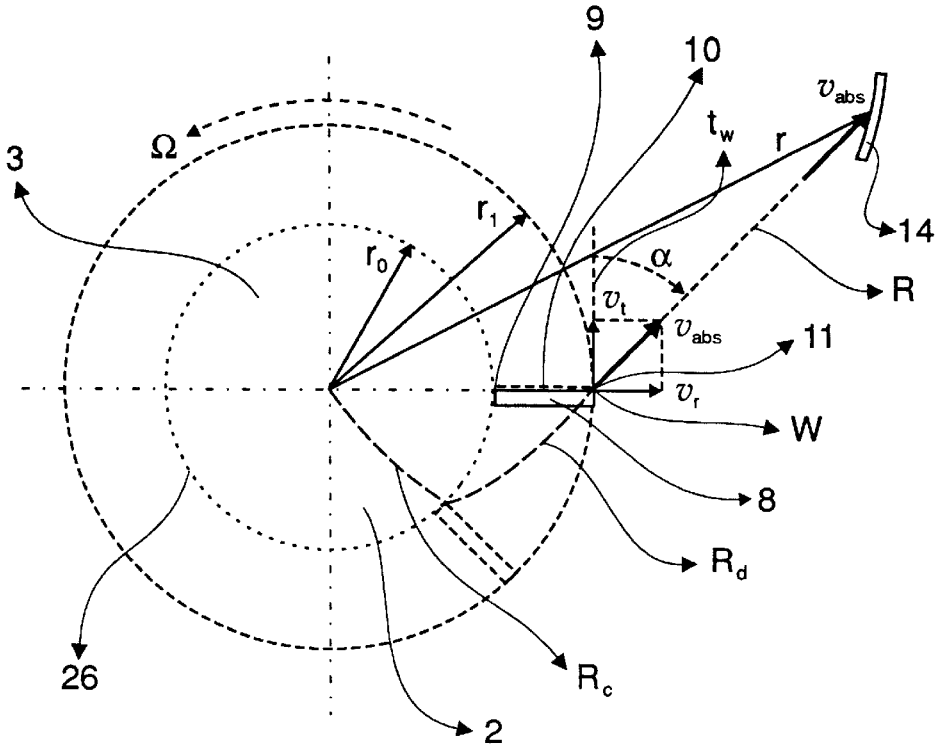
FIG. 2 diagrammatically shows a top view with a diagrammatic curve of the movement of the material according to the method of the invention, when seen from a stationary viewpoint.

FIG. 2 diagrammatically illustrates, for the resistance-free state, the movement which the grain executes in the rotating system, when seen from a stationary viewpoint. On the rotor (2), the grain, since it makes only limited contact with the metering face (3), which in this case is rotating, moves in a virtually radial stream ($R_r$) in the direction of the edge (26) of the metering face (3), where the grain is taken up by the central feed (9) of the guide member (8), and is guided in a spiral (logarithmic) movement ($R_0$) along the guide face (10), the grain being accelerated and moved in the desired direction, whereupon the grain is moved in a straight stream (R) from the delivery end (11) of the guide member (8), at a take-off velocity ($v_{abs}$). At the moment at which the grain comes off the guide member (8), a transverse velocity component ($v_r$) and a radial velocity component ($v_r$) are active, the radial velocity component ($v_r$) being decisive for the direction of the movement; i.e. it is decisive for the take-off angle ($\alpha$). The grain moves further, when seen from a stationary viewpoint, at a constant velocity ($v_{abs}$) along the said straight stream (R), in the direction of the rotating impact member (14).

Figure 3:
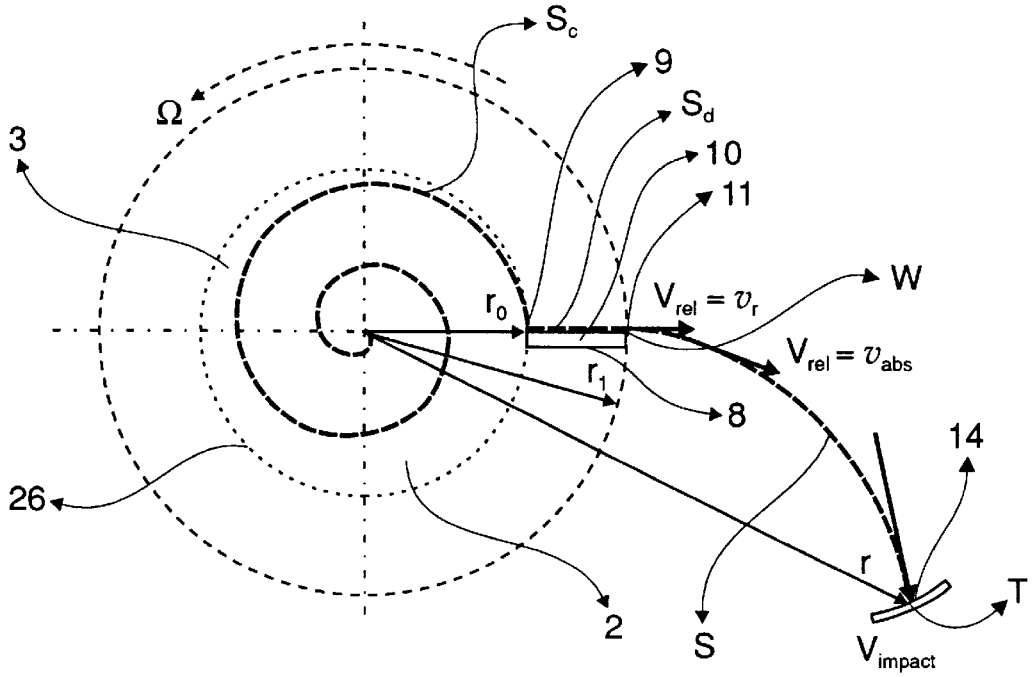
FIG. 3 diagrammatically shows a top view with a diagrammatic curve of the movement of the material according to the method of the invention, when seen from a moving viewpoint.

FIG. 3 diagrammatically illustrates, for the resistance-free state, the relative movement of the grain, when seen from a viewpoint which moves along. As can be seen, the grain on the metering face (3) moves in a spiral stream ($S_r$), which approximates to the Archimedes' spiral, towards the edge (26) of the metering face (3), where it is taken up by the central feed (9) of the guide member (8) and is accelerated and directed along the guide face (10), in this case in the radial direction ($S_c$), whereupon the grain is moved from the delivery end (11) in a spiral stream (S), the direction of which spiral stream (S), at the moment the material moves of the delivery end (11), is a continuation of the stream ($S_c$) which the grain describes along the guide member (8), along which spiral stream (S) the grain is guided towards the rotating impact member (14) in a direction which is essentially opposite to that of the straight stream (R), the direction of the spiral stream (S) being determined essentially by the radial velocity component ($v_r$).

Figure 4:
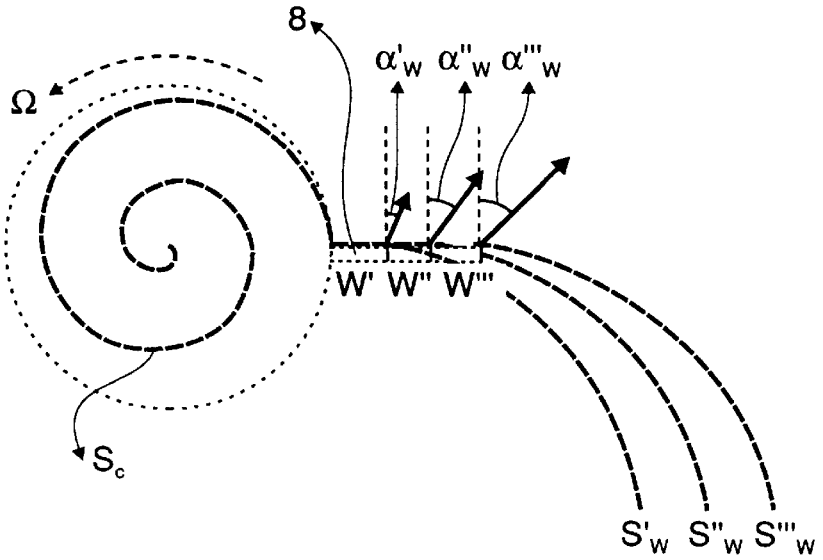
FIG. 4 diagrammatically shows the transition from the short spiral to the long spiral for increasing length of the guide member.

As shown in FIG. 4, the grain, when seen from a viewpoint which moves along, describes on the metering face (3) as it were a "short" spiral ($S_r$), which, with the aid of the guide member (8), is converted into a "long" spiral (S), the "length" of this spiral, as is shown, being determined by the radial velocity component ($v_r$): as the length of the guide member (8) increases (a→b), the take-off angle ($\alpha_a \rightarrow \alpha_c$) increases and the grain is moved in a "longer" spiral (S) (A→B).

In order to understand the method of the invention correctly, it of essential import that the movement (R)(S) which the grain describes in the rotating system, thus from the metering face (3), along the guide member (8) to the rotating impact member (14), is simultaneously seen from both a stationary viewpoint and from a viewpoint which moves along.

Figure 5:
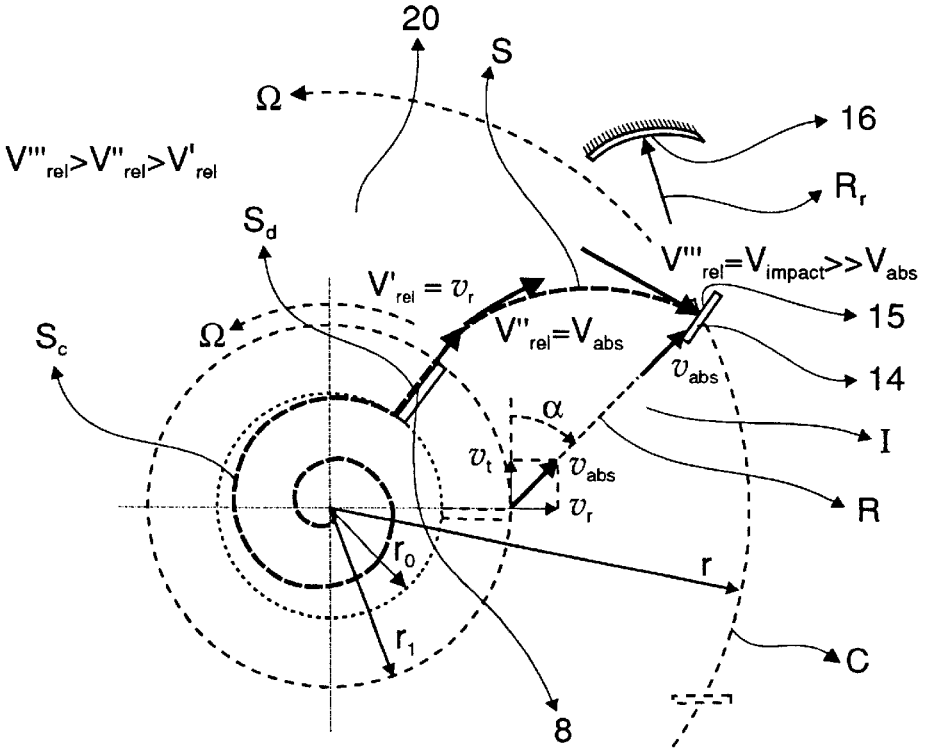
FIG. 5 diagrammatically shows a top view with a diagrammatic curve of the movement of the material according to the method of the invention, when seen from a stationary and a moving viewpoint.

FIG. 5 shows these movements, when seen from both the stationary (R) and the moving (S) position. While the grain moves at a constant velocity ($v_{abs}$) along the straight stream (R), the relative velocity ($V_{rel}$) of the movement along the spiral stream (5) increases as the grain moves further away from the axis of rotation (O). At the moment at which the grain comes off the guide member (8), it has a relative velocity ($V_{rel}'$) which is lower than the absolute velocity ($v_{abs}$). Along the spiral stream (S), the absolute velocity ($v_{abs}$) is quickly exceeded by the relative velocity ($V_{rel}''$), after which, further on in the spiral stream (S), velocities ($V_{rel}'''$) can be reached which are a multiple of the absolute velocity ($v_{abs}$).

In the method of the invention, use is made of this high relative velocity ($V_{rel}'''$) by allowing the grain to strike, at this relatively great impact velocity ($V_{impact}$), the impact face (15) of an impact member (14) which rotates together with the system. In this way, the method of the invention makes it possible to allow a grain, which comes off the guide member (8) at a relatively low velocity ($v_{abs}$)($V_{rel}'$), to impact at a very high relative velocity ($V_{impact}$). This means that the wear to the guide member is reduced considerably and the impact, if the impact face (15) is disposed correctly, takes place at an optimum, virtually perpendicular impact angle ($\beta$)(80°–85°), with the result that a great comminution intensity is obtained, while the wear even to the impact face (15) is limited, since impact wear is much lower than guide wear.

A particular advantage according to the method of the invention is that the grain, after the first impact, comes off the impact face (15) at a residual velocity ($V_{residual}$), which is at least as great as the impact velocity ($V_{impact}$), at which residual velocity ($V_{residual}$) the grain is moved into a straight stream (R), when seen from a stationary viewpoint, whereupon the grain, immediately after the first impact, can strike for a second time, at a high collision velocity ($V_{collision}$), a stationary impact member (16), which impact can likewise take place at an optimum, virtually perpendicular angle ($\beta$)(80°–85°).

It has been demonstrated that an impact at an angle of 80° to 85° for most types of material results in a much higher breaking probability than a perpendicular impact. The breaking probability can be increased considerably still further by allowing the grain to impact twice immediately in succession.

The method of the invention thus makes it possible, with a relatively lower power consumption and a relatively low level of wear, to allow the grains to impact at an optimum angle, at least twice immediately in succession, with the result that a high breaking probability is achieved.

Furthermore, the method of the invention makes it possible to synchronize the movement of the grain with the movement of the rotating impact member.

Figure 6:
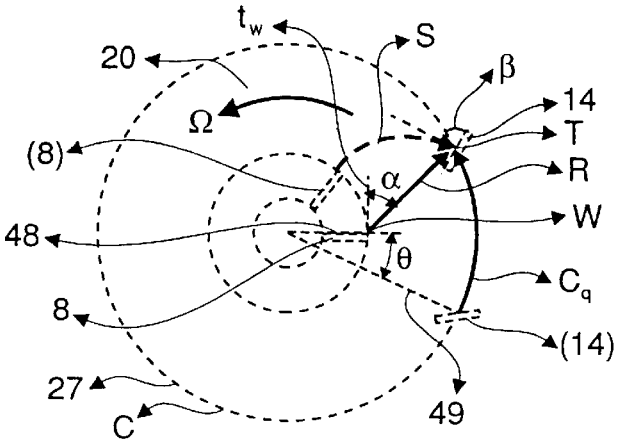
FIG. 6 diagrammatically shows the synchronization of the stream of material and the path which the rotating impact member describes.

FIG. 6 shows the spiral stream (S) which the grains describe between the guide member (8) and the rotating impact member (14). As indicated previously, it can be demonstrated that if the take-off location (W) and the take-off angle ($\alpha$) are not affected by the angular velocity ($\Omega$), and the take-off velocity ($v_{abs}$) is proportional to the angular velocity ($\Omega$), the route covered as the grain describes the spiral stream (S) and the route covered ($C_\theta$) as the rotating impact member (14) describes the periphery (27) which is described by the rotating impact member (14), are independent of the angular velocity ($\Omega$). The instantaneous angle ($\theta$), which is formed by the radial line (48) on which is situated the location (W) where the grains leave the guide member (8) and the radial line (49) on which is situated the location (T) at which the grains hit the rotating impact member (14), is thus not affected by the angular velocity ($\Omega$).

This makes it possible to synchronize the movement which the rotating impact member executes with the movement which the grain executes, so that, irrespective of the angular velocity ($\Omega$), the impact of the grain against the impact face of the rotating impact member takes place at a predetermined synchronization location (T) and at a predetermined impact angle ($\beta$), the impact velocity ($V_{impact}$) being proportional to the angular velocity ($\Omega$) and can thus be selected with the aid of the said angular velocity ($\Omega$) without in so doing affecting the impact location (T) or the impact angle ($\beta$).

However, a synchronization of this kind is only possible if the individual grains from the stream of material are guided, from the rotating impact member (14) in an essentially deterministic spiral stream (S), i.e. from a defined take-off location (W) and at a defined take-off angle ($\alpha$), which is not affected by the angular velocity ($\Omega$). This places particular demands on the guide member (8).

Figure 7:
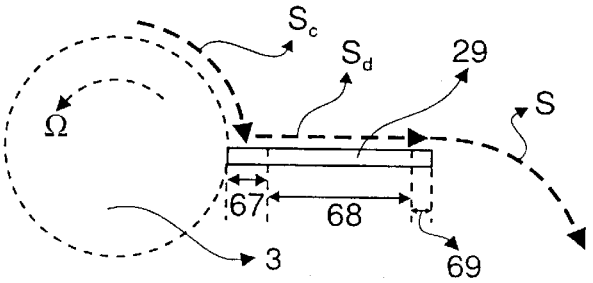
FIG. 7 diagrammatically shows a straight guide member with central feed, guide face and delivery end.
Figure 8:
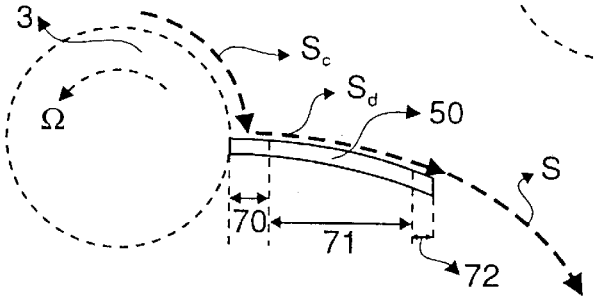
FIG. 8 diagrammatically shows a bent guide member with central feed, guide face and delivery end.

FIG. 7 diagrammatically depicts a radially designed guide member (29), and FIG. 8 depicts a bent guide member (50), each guide member (29)(50) being equipped with a central feed (67)(70), by means of which the material is taken up from the metering face (3), which merges into a guide face (68)(71), along which the material is brought up to speed and is guided primarily in the desired direction, which guide face merges into a delivery end (69)(72), by means of which the material is guided in a spiral stream (S) in an essentially deterministic manner.

Figure 9:
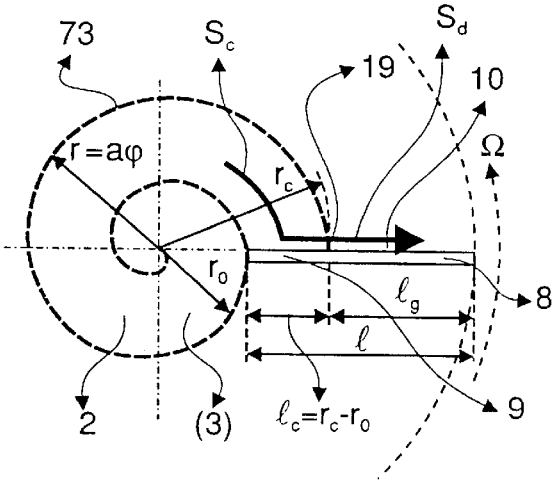
FIG. 9 diagrammatically shows the spiral movement which the material describes on the rotor and the transition of this spiral movement to a radial movement.

FIG. 9 diagrammatically shows the movement of a stream of material ($S_r$) on a rotating face of a rotor (2), when seen from a viewpoint which moves together with the said rotor (2). The said stream ($S_r$) is guided outwards in a spiral movement, which approximates to an Archimedes' spiral, and is taken up by the central feed (9) of a guide member (8), which in this case is arranged radially, and is therefore directed virtually transversely to the spiral stream ($S_r$). With the aid of the said central feed (9), the spiral stream of material ($S_r$) is converted into a radial movement ($S_c$) and is guided towards the guide face (10).

Figure 10:
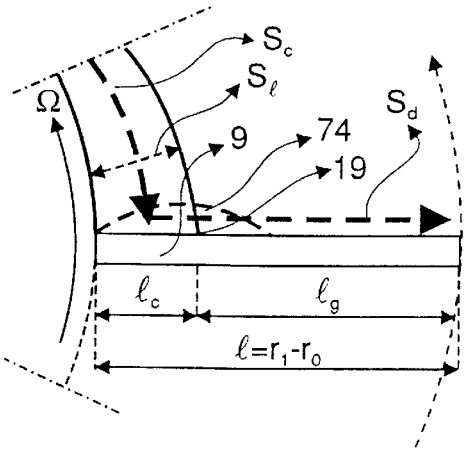
FIG. 10 diagrammatically shows the way in which the material from the rotor is taken up by the central feed.

FIG. 10 provides a diagrammatic depiction of the central feed. The length of the central feed (9) is given here by ($l_c$) which length is essentially determined by the width ($S_b$) of the spiral stream ($S_r$) at that location. The conversion of the spiral stream ($S_r$) into a straight radial movement ($S_c$) takes place along this central feed (9), it being necessary to take into account the fact that the length which is required in order to allow the stream of material to make good contact with the guide face (10) may be slightly longer than the given length ($l_c$) of the central feed (9). The actual guide begins from this region (74).

Figure 11:
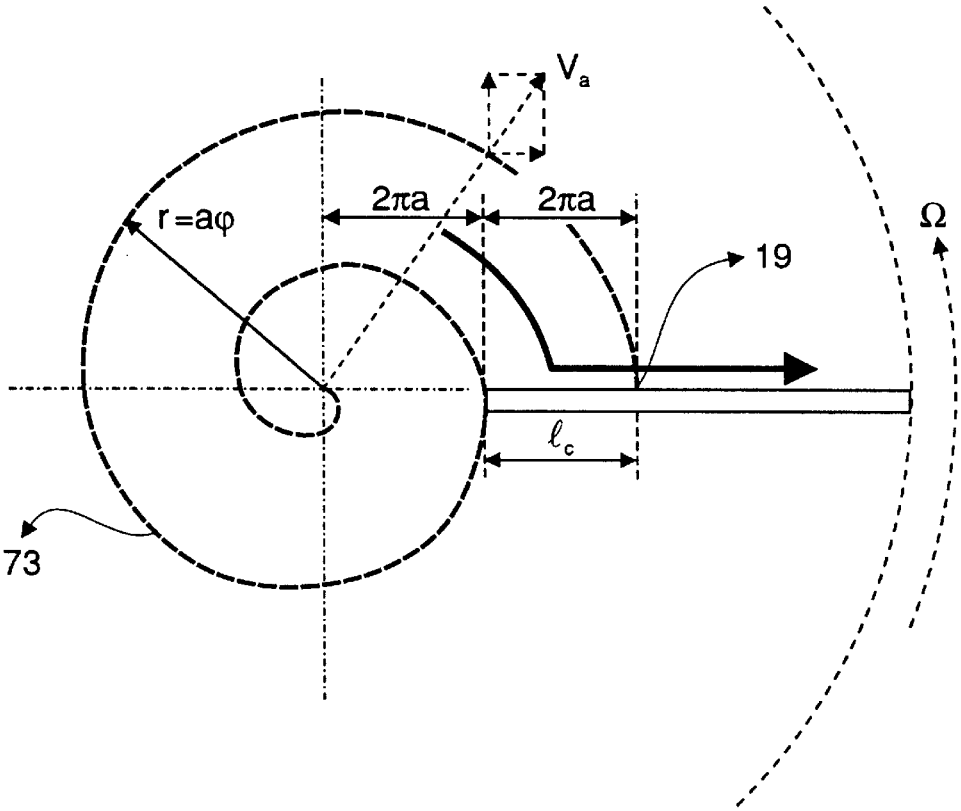
FIG. 11 diagrammatically shows a movement along an Archimedes' spiral.

FIG. 11 shows the Archimedes' spiral (73). On the basis of a movement in an Archimedes' spiral (73), the radial width of the spiral is $2\pi a$, a being calculated as: $a=V_a/\Omega$, i.e. the initial radial velocity ($V_a$) which the stream of material has at that location, divided by the angular velocity ($\Omega$).

Figure 12:
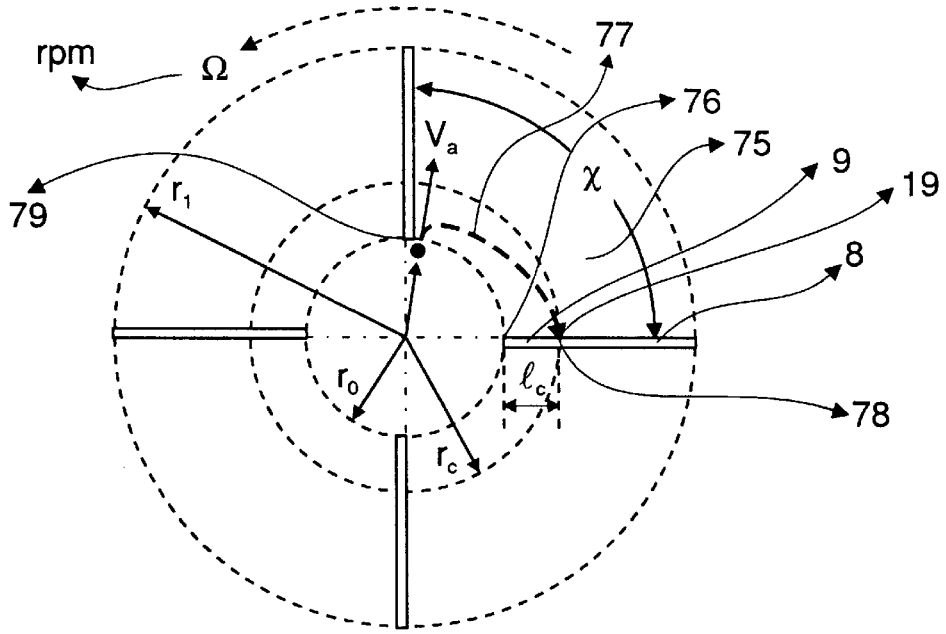
FIG. 12 diagrammatically shows a method of calculating the length of the central feed.

FIG. 12 indicates how it is possible to calculate the minimum length ($l_c$) which the central feed (9) has to have in order to take up the stream of material, specifically as the maximum distance which is given by the angle ($\chi$) which a grain, in the region in front of the said central feed (9), when seen in the direction of rotation, can cover in the radial direction starting from the periphery ($r_0$) which the start point (76) of the central feed (9) describes, before the grain is taken up by the said central feed (9). In the process, the grain moves naturally in a spiral stream (77), when seen from a viewpoint which moves along. The radial distance, or width of the spiral stream ($S_c$) which the said grain now covers is a function of the rotational speed (rpm), of the initial radial velocity ($V_a$) which the grain has at the moment at which it passes into the region (75) before the said central feed (9), and the angle ($\chi$) between the radial line on which is situated the location (78) where the grain hits the guide member (8) and the radial line on which is situated the location of the start point (79) of the following central feed arranged in the direction of rotation; which length ($l_c$) of which central feed (9) essentially satisfies the equation:

$$l_c = \frac{\chi V_a}{\Omega}$$

Figure 13:
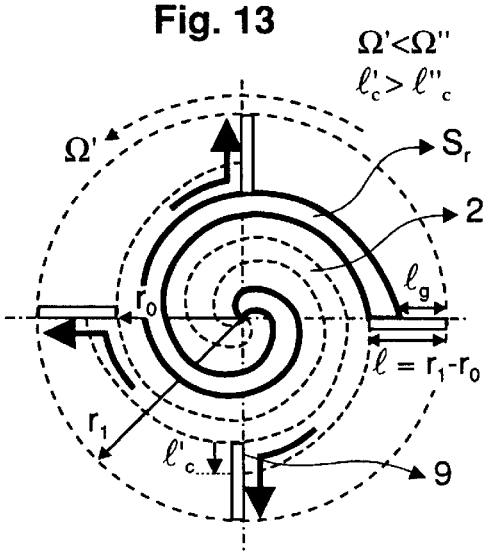
FIG. 13 diagrammatically shows the spiral stream which the material describes on the rotor at a relatively low angular velocity.
Figure 14:
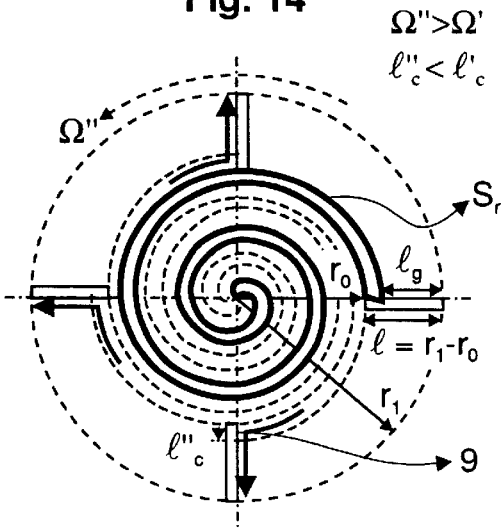
FIG. 14 diagrammatically shows the spiral stream which the material describes on the rotor at a relatively high angular velocity.

FIGS. 13 and 14 diagrammatically show how the angular velocity ($\Omega$) affects the spiral stream ($S_r$) on the rotor (2), and thus the length ($l_c$) of the central feed (9). FIG. 13 shows, for a low rotational speed (rpm), that the material moves in a relatively wide spiral stream ($S_r$) over the rotor (2), with the consequence that the length ($l'_c$) of the central feed (9) is relatively great. Allowing the rotor (2) to rotate at a greater speed (rpm) means, as is shown diagrammatically in FIG. 14, that the spiral stream ($S_r$) becomes less wide, leading to a shorter length ($l''_c$) of the central feed (9).

It is furthermore apparent that the initial radial velocity ($V_a$) which the stream of grains has at the moment at which it comes into contact with the central feed (9) has a considerable effect on the width ($S_r$) of the spiral stream ($S_r$). For example, for an angle $\chi$=90 (approximately four guide members) and an initial radial velocity ($V_a$) of 2 m/sec, the minimum length of the central feed ($l_c$), for a rotational speed of 100 rpm, is in absolute units $l_c$=600 and, for a rotational speed of 1000 rpm, $l_c$=60. If the initial radial velocity ($V_a$) is 5 m/sec, the respective values are $l_c$=1500 (at 100 rpm) and $l_c$=150 (at 1000 rpm). The length ($l_c$) of the central feed decreases with the number of guides, i.e. the angle ($\chi$).

It is preferred to keep the length ($l_c$) of the central feed (9) as short as possible, so that the stream of material ($S_r$) can make contact as quickly as possible with the guide face (10) and can be guided from the delivery end (11) in the desired spiral movement (S) at as low a velocity ($V_a$) as possible, i.e. at as short a radial distance ($r_1$) as possible. As indicated, it is possible to make do with a shorter length ($l_c$) as the angular velocity (rpm) is increased and the rotor (2) is designed with more guide members (8). However, the maximum number of guides is limited by the necessary free feed of the stream of material ($S_r$) to the central feed (9). Flow rate and grain dimension play an important role in this connection. If the distance ($\chi$) between the guide members (8) is made too short, this impedes the feed of the stream of material (S) to the said central feed (8), with the consequence that the material accumulates on the metering face (3). With regard to the grain dimension, it can be stated as a general rule that the calculated length ($l_c$) of the central feed (9) has to be at least twice as great as the maximum grain dimension of the grains from the stream of material ($S_r$). The initial radial velocity ($V_a$) can be limited by limiting as far as possible the height of drop of the material during metering onto the rotor (2), and by limiting the diameter of the rotorblade; however, also depending on the maximum grain dimension, a certain minimum diameter of the rotorblade is required.

Figure 15:
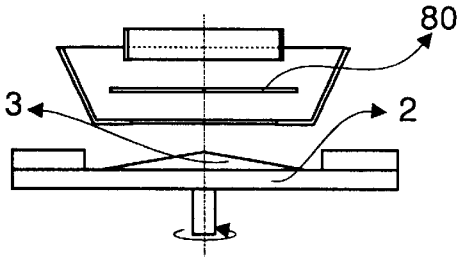
FIG. 15 diagrammatically shows a metering means, with which the height of drop of the material onto the rotor can be limited.

FIG. 15 shows how it is possible to limit the radial velocity ($V_a$) by suspending a partition (80) in the feed tube (81) above the metering face (3) of the rotor (2). However, here too it is necessary to take into account the fact that, in order to achieve a defined capacity, a defined flow rate is necessary during the metering.

To bridge the relatively short distance between the guide member (8) and the rotating impact member (14) without the grain being significantly affected by air resistance, any air movements and the force of gravity, a take-off velocity ($v_{abs}$) of approximately 10 m/sec is normally sufficient.

Furthermore, in order to move the said material into a spiral stream (S) in an essentially deterministic manner, it is of essential importance that the take-off angle ($\alpha$) of the individual grains from the stream of grains is virtually constant and that all the grains come off the guide member (8) at virtually the same take-off location (W).

For the method of the invention, the function of the guide member (8), in addition to providing a certain acceleration, is therefore primarily to direct the movement of the grains along the guide face (10) in such a manner that the stream of material comes off the guide member (8) at virtually the same take-off location (W), at a virtually constant take-off angle ($\alpha$) and at virtually constant take-off velocity ($v_{abs}$). To this end, the grains from the stream of material, after they have been taken up by the central feed (9), must quickly and correctly make contact with the guide face (10).

Figure 16:
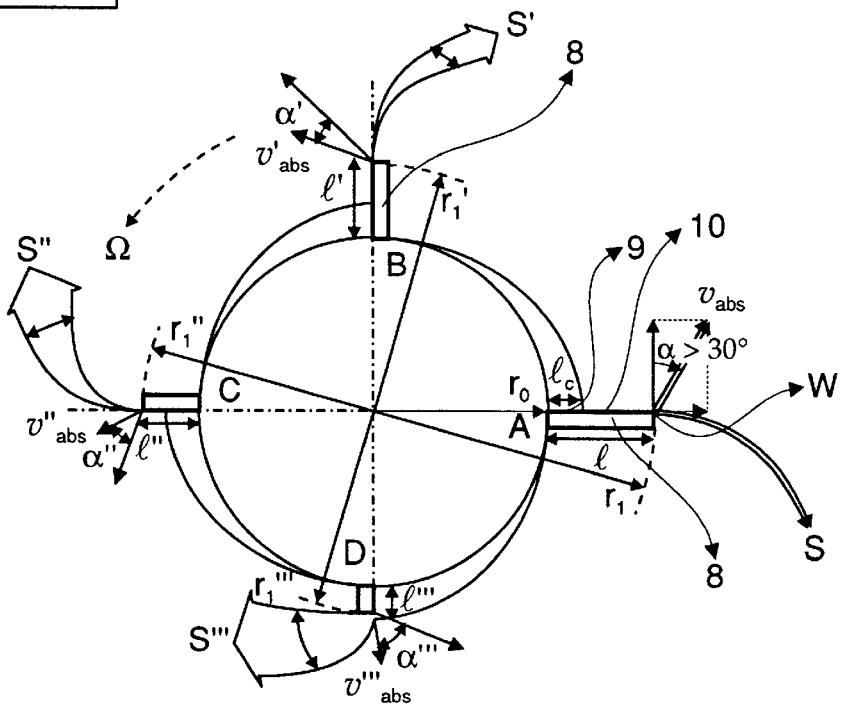
FIG. 16 diagrammatically shows the effect of the length of the guide member on the way in which the stream of material comes off the guide member.

As is diagrammatically indicated in FIG. 16, the radial length (1) of the guide member (8) is essentially the determining factor here. An excessively short guide member (8) with a length ($l_c'''$) which is shorter than the required length ($l_c$) of the central feed (9) (situation D), the radial length ($l'''$) of the guide member (8) thus being shorter than the width of the spiral stream ($S_r$), is the factor which causes only some of the grains from the stream of material ($S_r$) to come into contact with the central feed (9). A substantial proportion of the grains moves past the front of the said central feed (9) (as it were rolls off the rotor (2)) and is not taken up by the said central feed (9). The grains which, owing to the lack of a guide face, are not guided therefore leave the "guide member" in a chaotic manner, with the take-off angle ($\alpha$) varying ($\alpha'''$) from virtually tangential to virtually radial, while the take-off velocity ($v'''_{abs}$) varies from virtually nothing to the tip velocity ($V_{tip}$) at that location. It is impossible to synchronize a stream (S'''') of this kind effectively with the movement of a rotating impact member (14). As the length ($l''\rightarrow l'$) of the guide member (8) increases (situations C and B), thus involving a guide member (8) with a central feed (9) and a guide face (10), the grain can make better contact with the guide face (10), and the spread of the take-off velocity ($v''_{abs}v'_{abs}$) and the spread of the take-off angle ($\alpha''\rightarrow\alpha'$) decrease, resulting in a process which proceeds in a more deterministic manner. If the length (l) of the guide member (8) is made large enough to produce a guide face (10) with sufficient contact length (situation A), the separate grains from the stream ($S_r$) make contact with the said guide face (10) in such a manner that the grains all leave the guide member (8) from virtually the same take-off location (W), at virtually the same take-off angle ($\alpha$) and at a virtually constant take-off velocity ($v_{abs}$) which is determined by the angular velocity ($\Omega$), and are guided in an essentially deterministic spiral stream (S).

Directing the stream of material along the guide face (10) is done essentially by means of the radial velocity component ($v_r$); for a correct direction, it is therefore necessary for the stream of material to develop a specific minimum radial velocity component ($v_r$) along the guide face (10). To launch the grains from the guide member (8) in an essentially deterministic manner, it is necessary for a radial velocity component ($v_r$) which is approximately 35–55% of the transverse velocity component ($v_r$) to be developed along the guide face (10), thus resulting in a take-off angle ($\alpha$) of approximately 20° to 30°. It can therefore be stated that the stream of material ($S_r\rightarrow S_c$) can be brought into a spiral stream (S) in an essentially deterministic manner, with the aid of a guide member (8), if the take-off angle ($\alpha$) is greater than 20°, and preferably greater than 30°.

For this purpose, the guide member (8) must be equipped with a central feed (9) which has a length ($l_c$) to take up the stream of material ($S_c$) and a guide face (10) which has sufficient guidance length ($l_g$) to direct the stream ($S_c$). These factors together determine the length (l) of the guide member (8).

Figure 17:
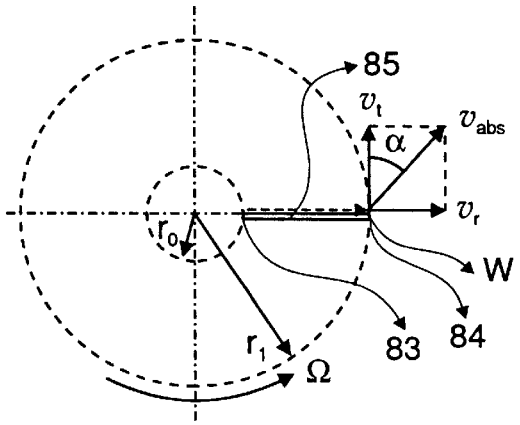
FIG. 17 diagrammatically shows the theoretical relationship between the radial length to the central feed and the delivery end of the guide member as a function of the take-off angle for a radially disposed guide face.

FIG. 17 shows how this guidance length ($l_g$) can be calculated as a function of the take-off angle ($\alpha$). The guidance length ($l_g$) is given here as the difference between the radial length ($r_0$) from the axis of rotation (O) to the start point (83) of the guide face (10) (end point of said central feed) and the corresponding radial length ($r_1$) to the end point (84) of the said guide member (8) (end point of said delivery end), i.e.: $l_g=r_1-r_c$. The length ($l_g$) of the guide member (8) can thus be calculated on the basis of the relationship ($r_c/r_1$). For radially arranged guides and for the resistance-free state, this relationship essentially satisfies the equation:

$$\frac{r_c}{r_1} = \sqrt{1 - \tan^2\alpha}$$

Figure 18:
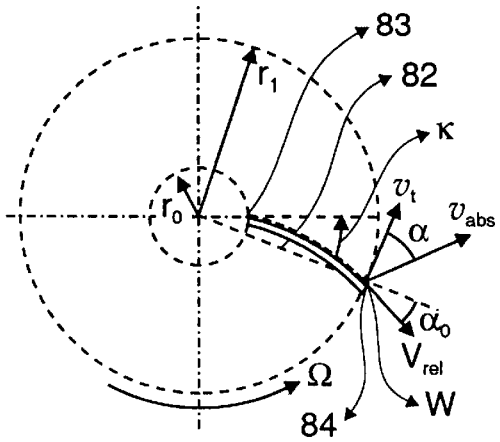
FIG. 18 diagrammatically shows the theoretical relationship between the radial length to the central feed and the delivery end of the guide member as a function of the take-off angle for a bent guide face.

FIG. 18 shows a guide member (8) which is not arranged radially, with the result that the relationship ($r_c/r_1$) changes and, as a function of the take-off angle ($\alpha$), can essentially be given by the equation:

$$\alpha = \arctan\left(\frac{\cos\alpha_0\sqrt{r_1^2 - r_c^2}}{r_1 - \sin\alpha_0\sqrt{r_1^2 - r_c^2}}\right)$$

Figure 19:
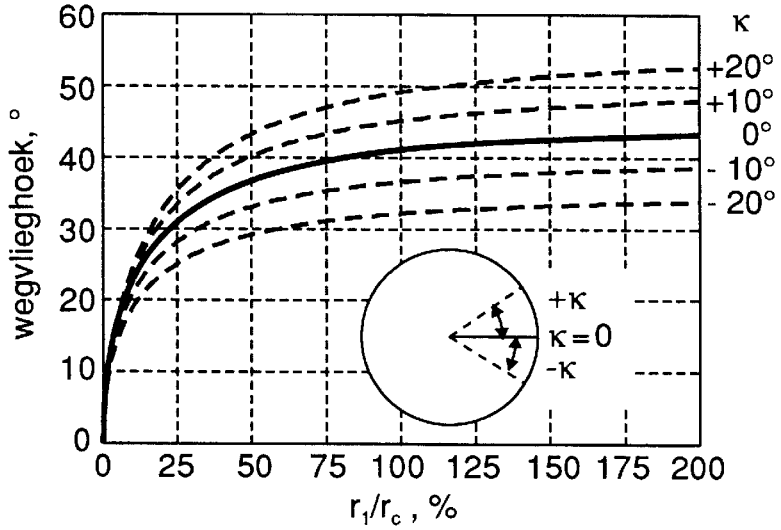
FIG. 19 diagrammatically shows the graph of the relationship between the radial length to the central feed and the delivery end of the guide member as a function of the take-off angle for a radially disposed and bent guide face.

FIG. 19 shows the connection between the take-off angle ($\alpha$) and the relationship ($r_0/r_1$) for guide members which are arranged radially (85) and non-radially (86). The degree to which the non-radial guide members (86) differ from the radial guide member (85) is shown by the angle ($\kappa$) between the radial line on which is situated the end of the radial guide member (85) and the radial line on which is situated the end of the non-radial guide member (86), a non-radial guide member (86) which is situated towards the front, in the direction of rotation, by comparison with the radially arranged guide member (85) forming an angle ($+\kappa$), and a non-radial guide member (86) which is situated towards the rear forming an angle ($-\kappa$). Furthermore, it is necessary to take into account the friction of the stream of material ($R_c$) along the guide face (10).

Figure 20:
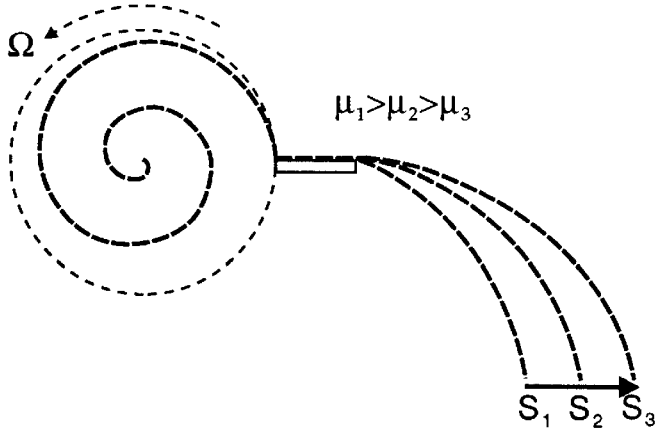
FIG. 20 diagrammatically shows the effect of the friction on the spiral movement described by the material after it comes off the guide member.

FIG. 20 diagrammatically illustrates how the friction affects the take-off angle ($\alpha$); the take-off angle ($\alpha$) becomes smaller as the influence of the friction, which can be given by the coefficient of friction ($\omega$) increases. The coefficient of friction ($\omega$) depends on the contact between the grains and the guide member (8). The friction is further influenced by the shape of the guide member (8). However, it is extremely complicated to try to include the coefficient of friction ($\omega$) in an equation; indeed, for a bent guide member this is essentially impossible. The friction increases when the guide member (8) is directed forwards in the direction of rotation and decreases when directed backwards. However, the situation can be simulated reasonably accurately with the aid of a computer. In any case, it is true that the guidance length ($l_g$) of the guide face (10) which is required to launch the stream of material ($R_c$) in an essentially deterministic manner increases together with the coefficient of friction ($\omega$).

On the basis of the above description, it can be stated as a general rule for the method of the invention that, in order to achieve an essentially deterministic take-off process of the grains from the guide member (8), i.e. such that the grains leave the guide member (8) at a take-off angle ($\alpha$) of at least 30°, the length (l) of the guide face (10), i.e. the radial distance ($r_1$) from the axis of rotation (O) to the end point of the guide member (8), has to be at least 33⅓% greater than the corresponding radial distance ($r_0$) to the start point of the guide member (8).

Figure 21:
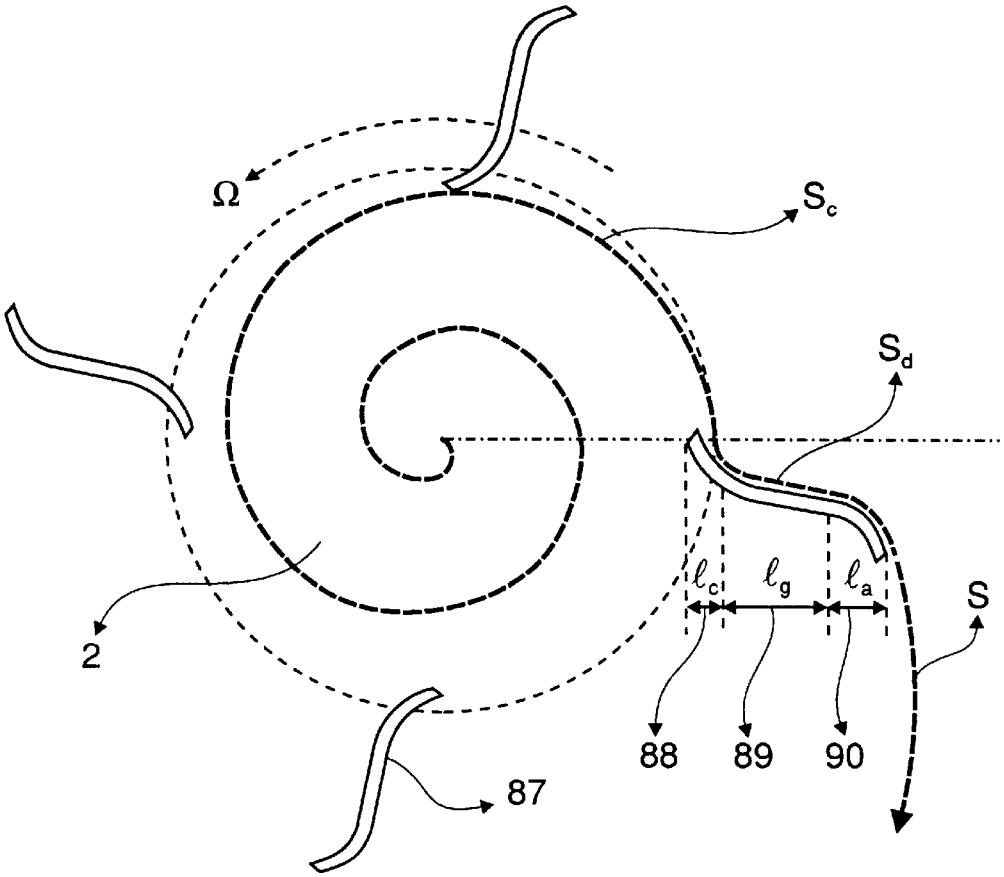
FIG. 21 diagrammatically shows a rotor with S-shaped guide members.

FIG. 21 shows a guide member (87) which has a sort of S-shape. In this case, the central feed (88), which is designed such that it is bent forwards in the direction of rotation, lies as far as possible as a continuation of the natural spiral stream ($S_r$) which the material on the rotor (2) describes, which central feed (88) merges into a guide face (89) which is of straight design and is directed backwards in the direction of rotation, which guide face (89) merges into a delivery end (90), which is bent backwards in the direction of rotation and is at least sufficiently curved for the curvature to be situated as a continuation of the spiral stream (S) which the said material describes when it comes off the said delivery end (90).

The specific bent shape of the central feed (88) makes it possible to take up, in an improved manner, the stream of material ($S_r$) in a flowing movement from the rotor (2) and to guide it to the guide face (89). Since the guide face (89) is directed backwards, the acceleration is limited, while the material is guided from the bent delivery end (90) into the intended spiral stream (S) in, as it were, a natural manner, in the direction of the rotating impact member (14). This design makes it possible to allow the stream of material ($S_c$) to come off the guide member (87) at a relatively low velocity ($v_{abs}$) in an essentially deterministic manner. Thus both the power consumption and the wear are limited, while the stream of material ($S_c \rightarrow S$) comes off the S-shaped guide member (87) at a lower take-off velocity ($v_{abs}$), and can thus develop a greater relative velocity ($V_{rel}$) along the spiral stream (S), and thus hits the rotating impact member (14) at a greater velocity ($V_{impact}$).

Figure 22:
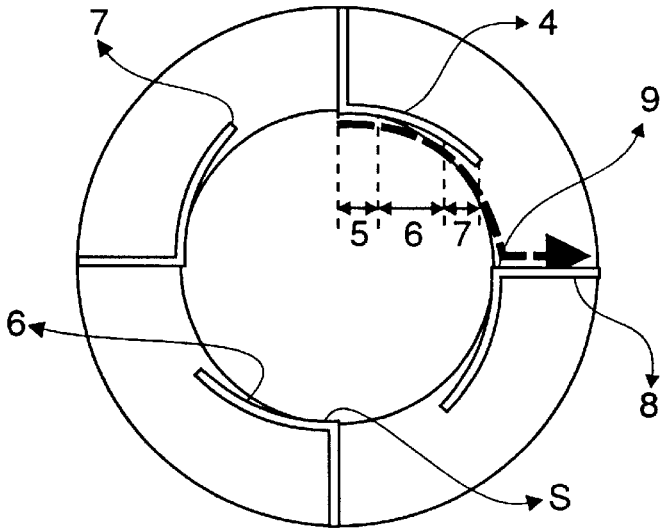
FIG. 22 diagrammatically shows a rotor which is equipped with preliminary guide members.

FIG. 22 shows a preliminary guide member (4), the central inlet (5) of which lies immediately behind the central feed (9), when seen in the direction of rotation, which preliminary guide member (4) extends, from the said central feed (5), with the preliminary guide face (6) in a direction essentially opposite to the direction of rotation, to a delivery location (7) which is directed towards the central feed (9) of a following guide member (8). A preliminary guide member (4) of this kind makes it possible to feed the spiral stream ($S_r$) to the central feed (9) of the guide member (8) in a more effective manner without impeding the movement of the grain on the rotor (2), and to prevent grains from being able to jump or simply roll off the metering face, thus not being taken up by the central feed (9), or to prevent them from coming into contact with the guide member (8) at a greater radial distance from the axis of rotation (O), with the result that the guidance process is significantly disturbed.

Figure 23:
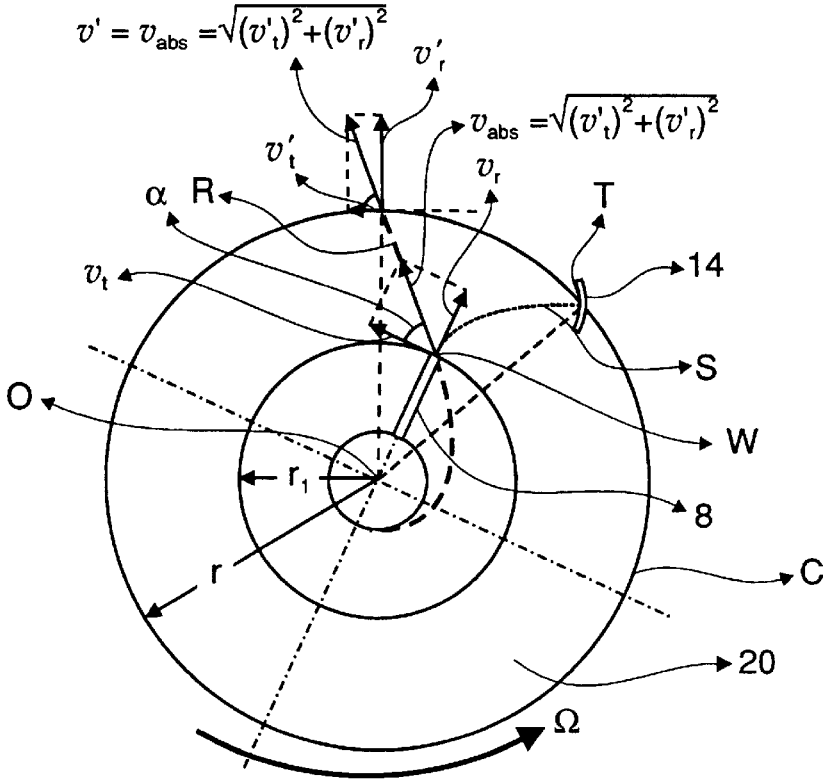
FIG. 23 diagrammatically shows the velocities of the movement which the stream of material develops when it comes off the guide member, when seen from a stationary viewpoint.
Figure 24:
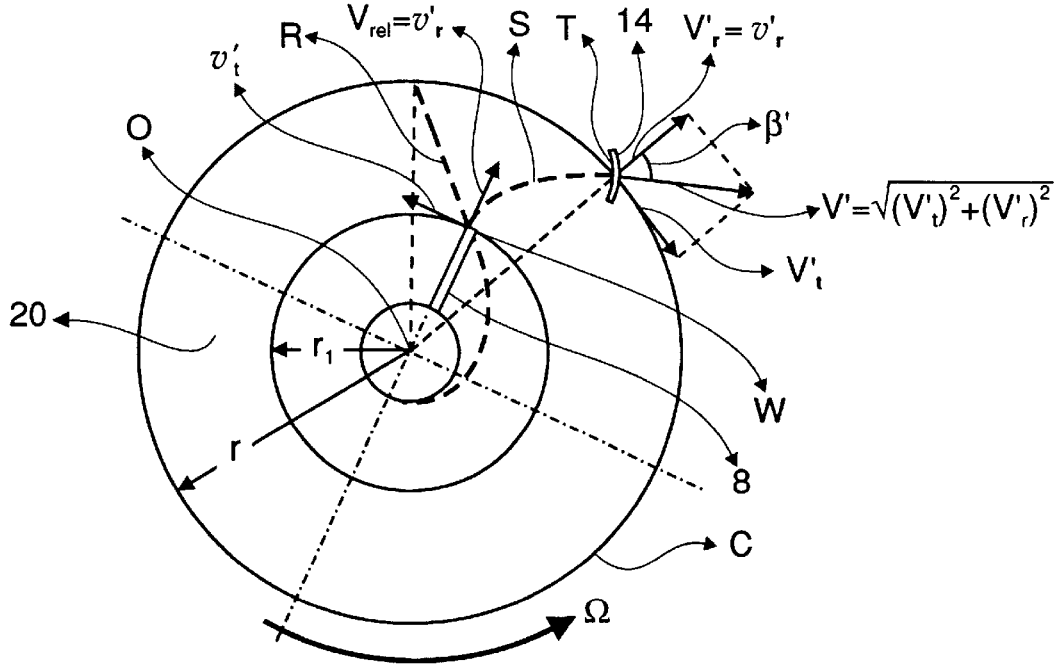
FIG. 24 diagrammatically shows the velocities of the movement which the stream of material develops when it comes off the guide member, when seen from a viewpoint moving along.

FIGS. 23 and 24 diagrammatically show, for the resistance-free state, the movements of the material between the location (W) where this material leaves the radial guide member (8) and the location (T) where the material strikes the rotating impact member (14), when seen respectively from a stationary viewpoint (FIG. 23) and a viewpoint which moves together with the system (FIG. 24).

In reality, the movement of the material is actually subject to, inter alia, friction with components of the rotor and to air resistance. The same also applies to the force of gravity. These factors affect the stream, although without significantly changing the nature of the movement. The grain size and the grain configuration play an important role here. In the following observations, these effects are, for the time being, discounted.

When seen from a stationary viewpoint (FIG. 23), when the material comes off the guide member (8) at a radial distance ($r_0$) from the axis of rotation (O), at a take-off velocity ($v_{abs}$), a radial velocity component ($v_r$) and a velocity component which is perpendicular to the radial component, i.e. a transverse velocity component ($v_t$), are active. The transverse velocity ($v_t$) of the material at the moment at which it leaves the guide member (8) corresponds to the tip velocity, i.e. the velocity at the location of the discharge end (11), of the guide member (8): tip velocity=$\Omega r_1$. If the radial ($v_r$) and transverse ($v_t$) velocity components are equal, the material leaves the guide member (8) at an angle ($\alpha$) of 45°. In reality, the magnitudes of the velocity components may differ, with the result that the direction of movement changes: the transverse velocity component ($v_t$) is normally greater than the radial velocity component ($v_r$), but the reverse may also be true. The take-off angle ($\alpha$) can thus be greater than and less than 45°, but is normally less than 45°. As indicated above, it is necessary in order to bring the said material into an essentially deterministic stream, for the take-off angle ($\alpha$) to be greater than 20°, and preferably greater than 30°.

Since the straight movement path (R) is not directed from the axis of rotation (O), but rather from a location (W)

situated at a radial distance from the axis of rotation (O), there is a shift outwards, when seen from the axis of rotation (O), at a radial distance which is greater than the radial distance to the location (W) where the material leaves the guide member (8), between the radial ($v_r$) and transverse ($v_t$) velocity components, when seen from a stationary viewpoint, the magnitude of the radial component ($v_r$) increasing and that of the transverse component ($v_t$) decreasing.

When seen from a viewpoint which moves together with the guide member (8) (FIG. 24), the situation is different. After coming off the guide member (8), the grain moves at a relative velocity ($V_{rel}$) along the spiral stream (S), the direction of which is opposite to that of the straight stream (R), the relative velocity ($V_{rel}$) increasing as the grain moves further away from the axis of rotation (O). At the moment at which the grain comes off the guide member (8), there is no relative transverse velocity ($V'_{t\ rel}$) active. At that moment, the relative movement is determined only by the radial velocity component ($v_r$). When the material comes off the guide member (8), a relative transverse velocity component ($v_t$) begins to develop. In the process, as the material moves further away from the axis of rotation (O), the radial velocity component ($v_r$) increases considerably, and the transverse velocity component ($v_t$) increases very considerably. The material therefore describes a spiral stream.

In this case, for both the movement in the straight stream and in the relative movement in the spiral stream (S), i.e. wherein from both the stationary and the moving viewpoint, the radial velocity component is, at any distance from the axis of rotation (O), identical ($V_r$=$v_r$), and increases as the grains move further away from the axis of rotation (O). Since, as the radial distance between the location (W) where the material leaves the guide member (8) and the location (T) where the material hits the rotating impact member (14) increases, the transverse velocity component ($v_t$) increases more than the radial velocity component ($V_r$), the direction of movement of the relative velocity ($V_{rel}$), further on in the spiral stream (S), increasingly comes to lie as a continuation of the direction of movement, which is in fact in the opposite direction, of the rotating impact member (14), with the result that the impact intensity increase when the grain hits the rotating impact member (14). However, the spiral movement (S) described by the material prevents the relative movement (S) of the grain and the movement (B) of the rotating impact member (14) from being able to lie completely in a single line. Moreover, the distance ($r-r_1$) between the location (W) where the material leaves the guide member (8) and the location (T) where it strikes the rotating impact member (14) is also limited for practical reasons.

Figure 25:
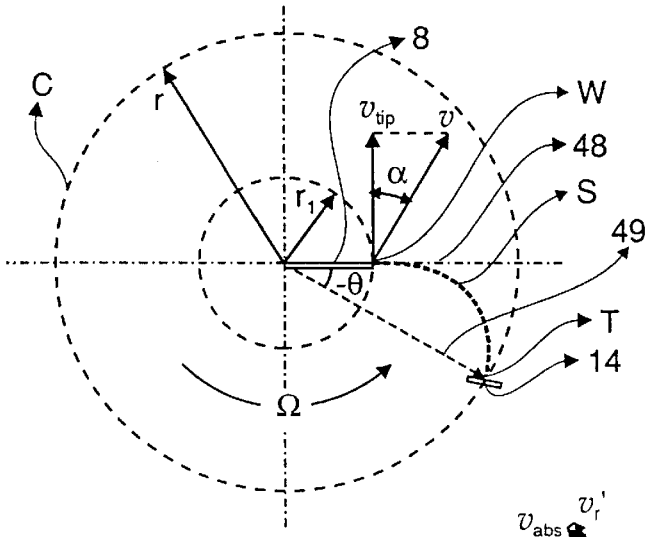
FIG. 25 diagrammatically shows the method of calculating the instantaneous angle ($\theta$).

The spiral movement (S) which the material describes according to the method of the invention can, as shown in FIG. 25, be given, when seen from a co-rotating position, as the connection between the instantaneous angle (θ), the associated radius (r) and a factor f, and essentially satisfies the equation:

$$\theta = \arctan\left(\frac{p\cos\alpha}{p\sin\alpha + r_1}\right) - p\frac{\cos\alpha}{fr_1}$$

which instantaneous angle (θ) is defined as the angle between the radial line (48) on which is situated the location (W) where the stream of material (S) leaves the guide member (8) and the radial line (49) on which is situated the location (T) where the stream of material (S) hits the rotating impact member (14). The equation shows that the spiral stream (S) which the said material describes after leaving the guide member (8), when seen from a viewpoint which moves together with the rotating impact member (14), is determined entirely by the location (W), i.e. the radial distance ($r_1$), from where the material leaves the guide member (8), by the take-off angle (α) of the material from the guide member (8) and by the relationship between the transverse component ($v_t$) of the absolute velocity ($v_{abs}$) on leaving the guide member (8) and the tip velocity ($V_{tip}$) of the delivery end (11) of the guide member (8), i.e. the factor f. It is extremely important that the stream (S) should not be affected by the angular velocity (Ω); as pointed out earlier, this essentially forms the basis of the method of the invention.

The fact that the instantaneous angle (θ), which has an unambiguous connection with the radial distance (r) of the axis of rotation (O) to the hit point (T), can be calculated makes it possible to position the rotating impact member (14) accurately with respect to the guide member (8).

The velocity ($V_{impact}$) at which the material, with the aid of the rotating impact member (14), hits the impact face (13) increases considerably, as has been stated, as the difference increases between the radial distances ($r-r_0$) from the location (W) where the material leaves the guide member (8) and a hit location (T) situated further on in the stream (S). Furthermore, the impact velocity ($V_{impact}$) is determined by the angular velocity (Ω).

Figure 26:
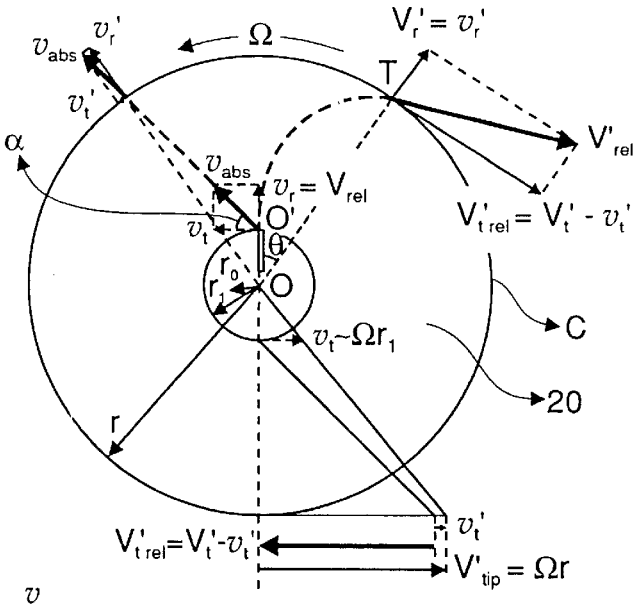
FIG. 26 diagrammatically shows the velocities which the stream of material develops after it comes off the guide member, along the spiral path.

FIG. 26 shows how the relatively velocity ($V_{rel}$) of a grain develops along the spiral stream (S). At the moment at which the grain is guided into the spiral stream (S), only the radial velocity component is active, i.e.: $V_{rel}$=$v_r$; at that moment, the grain has no transverse velocity component ($V_l$=0). As stated above, the radial velocity component ($V_r$) increases for both the absolute velocity ($v_{abs}$) and the relative velocity ($V_{rel}$), when seen from the axis of rotation (O), as the grain moves further away from the said axis of rotation (O), thus: $v_r$=$V_r$. Immediately after the grain comes off the guide member (8), it develops, along the spiral stream (S), a transverse velocity component ($V_t$) which increases considerably as the grain moves further away from the axis of rotation (O). This transverse velocity component ($V_t$) is calculated as the distance, at a specific radial distance from the axis of rotation (O), between the relative tip velocity ($V'_{tip}$) of the grain, which is calculated as $V'_{tip}$=Ωr, and the transverse velocity component ($v_t$) of the grain along the straight stream (R) at the said radial distance, i.e.: $V'_{t\ rel}$=$V'_{tip}$−$v'_t$=$\Omega_r$−$v'_r$. The relative velocity ($V'_{rel}$), i.e. the impact velocity ($V_{impact}$), is now, when seen from the axis of rotation (O), formed by the resultant of the radial ($V_r$) and the relative transverse ($V_t$) velocity components. It is clearly illustrated how considerably the relative velocity ($V_{rel}$) increases along the spiral stream (S) as the grain moves further away from the axis of rotation (O).

Figure 27:
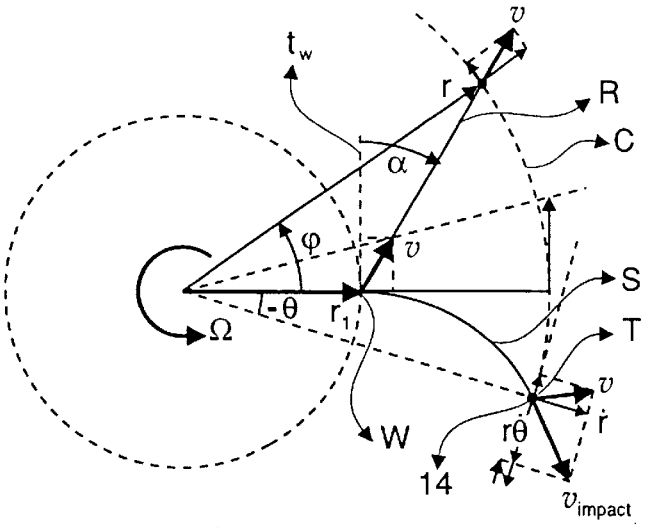
FIG. 27 diagrammatically shows the method of calculating the velocity ($V_{impact}$) at which the material hits the rotating impact member.

FIG. 27 indicates how the velocity at which the material hits the rotating impact member (14), i.e. the impact velocity ($V_{impact}$), can be reached. This impact velocity ($V_{impact}$) essentially satisfies the equation:

$$V_{impact} = \sqrt{\dot{r}^2 + r^2\dot{\theta}^2}$$

This specific connection makes it possible, at a given location (T) where the material hits the rotating impact member (14), accurately to give the angular velocity (Ω) which is required in order to achieve a specific impact velocity ($V_{impact}$). Conversely, if the angular velocity (Ω) is given, the hit location (T) where the material hits the rotating impact member (14) at a defined impact velocity ($V_{impact}$) can be defined accurately.

Figure 28:
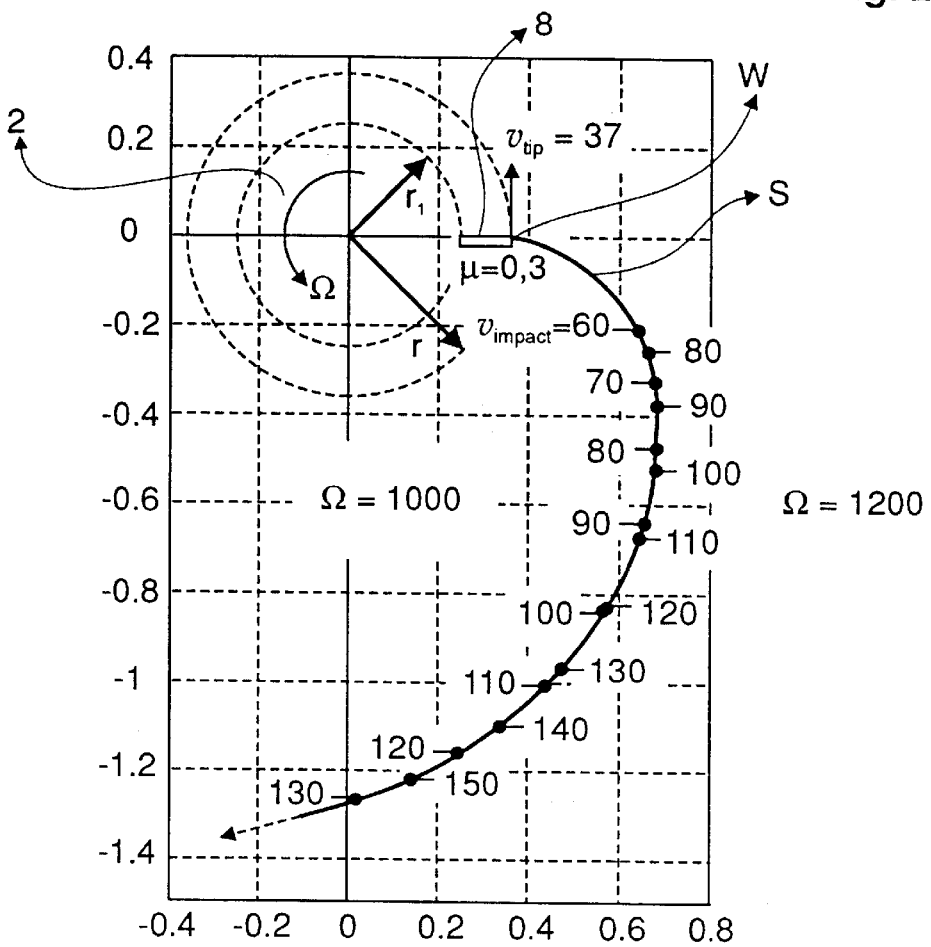
FIG. 28 diagrammatically shows the relative velocities which the stream of material develops along the spiral stream.

For two angular velocities Ω=1000 and Ω=1200 rpm), FIG. 28 shows the relative velocities ($V_{rel}=V_{impact}$) which the material develops along a specific spiral stream (S); i.e. the velocity ($V_{impact}$) at which the material at the location (T) in the spiral movement (S) would strike a rotating impact member (14) disposed at that location. The basis used here is a tip velocity ($V_{tip}$), i.e. peripheral velocity ($V_{tip}$), at the location (W) from where the material comes off the guide member (8), of 36 m/sec. The method of the invention thus makes it possible, at a relatively low take-off velocity ($v_{abs}$), to achieve a very high collision velocity ($V_{impact}$), and thus a high impulse loading of the material, which impact velocity ($V_{impact}$) can be selected with the aid of the angular velocity (Ω) and the radial distance (r) from the axis of rotation where the rotating impact member (14) is arranged in the spiral (S).

It is preferred for the material to hit the impact face (15) of the rotating impact member (14) perpendicularly, when seen in the plane of the rotation and when seen from a viewpoint which moves together with the rotating impact member (14). The actual impact angle (β) can then be adjusted by tilting the impact face (15) in the vertical direction.

Figure 29:
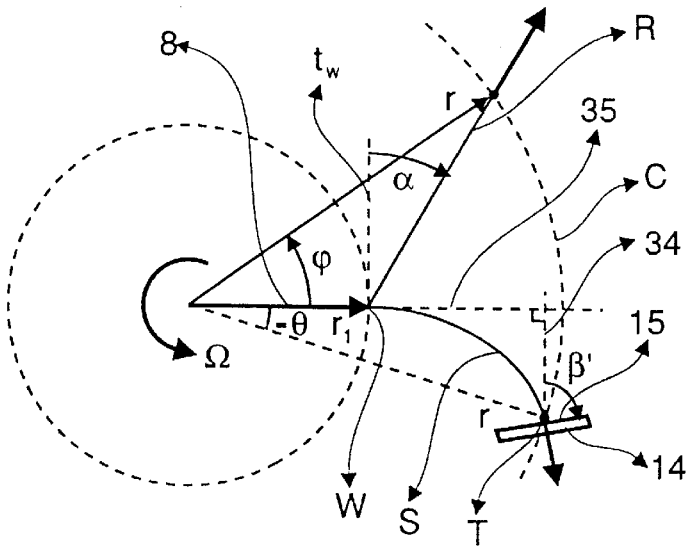
FIG. 29 diagrammatically shows the method of calculating the angle ($\beta'$) at which the stream of material strikes the rotating impact member.

FIG. 29 shows how the impact face (15) has to be arranged in order to achieve a perpendicular impact angle in the plane of the rotation, at the location where the grain strikes the said impact face (15); at an angle (β') in the horizontal plane, between the radial line (48) on which is situated the location (W) from where the material leaves the guide member (8) and the line (49) which, from the location (T) where the material hits the impact face (15), is direct perpendicular to this radial line (48), which angle (β') essentially satisfies the equation:

$$\beta' = \arctan\left\{\frac{\frac{r^2\cos\alpha}{fr_1} - \left\{\frac{r\cos\phi}{p\sin\alpha + r_1}\right\}^2 r_1\cos\alpha}{r_1\sin\alpha + p}\right\} - \theta$$

With the aid of the angle (β'), it is possible to arrange the impact face (15) in such a manner that the impact of the stream of material (S) takes place at an optimum impact angle (β), which lies, as indicated above between 75° and 85° for most materials. At the same time, the impact angle (β) is largely the determining factor for the rebound behaviour of the grains; i.e. the rebound velocity ($V_{residual}$), the rebound angle ($\beta_r$) and the behaviour of the granular material which remains stuck to the impact face (15) during the impact. This is the case in particular if the grains have a low coefficient of restitution, and above all if the grains become pulverized during the impact. This adhesion behaviour is promoted if the grains are moist. Disposing the impact face (15) at a slightly oblique angle with respect to the impacting stream (S) has the advantage, in addition to increasing the breaking probability, of guiding the grains in a different direction after the impact, so that the impact of following grains is not disturbed. Furthermore, it is necessary to prevent the grains from starting to move outwards, after impact, radially along the impact face (15) under the influence of the centrifugal force. Since the peripheral velocity ($V'_{tip}$) is relatively high at that location, this can lead to extremely intensive wear along the outer section of the impact face (15). This wear disturbs the impact process and does not lead to significantly greater rebound velocities, i.e. residual velocity ($V_{residual}$), of the rebounding stream of material ($S_{residual}$). It is therefore preferred to direct the impact face (15) slightly obliquely inwards and slightly obliquely downwards with respect to the impacting stream (S).

Figure 30:
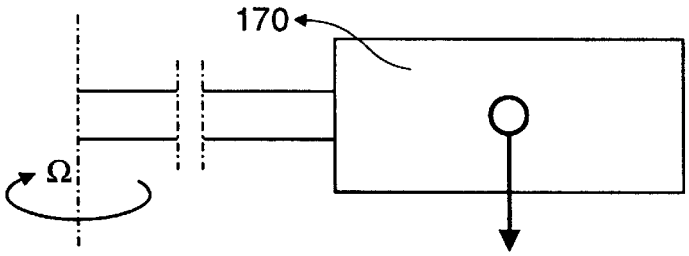
FIG. 30 diagrammatically shows the behaviour of the stream of material after it has struck the rotating impact member.
Figure 31:
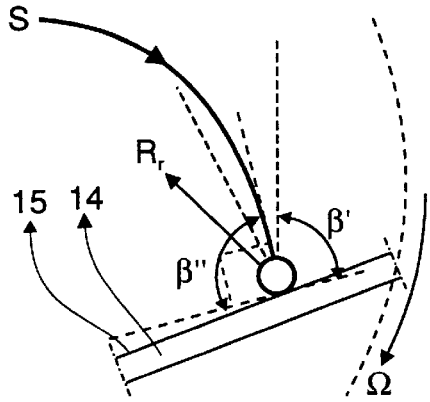
FIG. 31 diagrammatically shows the angle ($\beta''$) at which the impact face of the rotating impact member can be arranged in the vertical plane.
Figure 32:
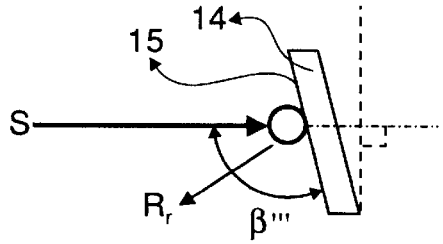
FIG. 32 diagrammatically shows the angle ($\beta'''$) at which the impact face of the rotating impact member can be arranged in the horizontal plane.

FIG. 30 shows a preferred arrangement of an impact face (170). In this case, the impact face (170) is directed slightly inwards in the horizontal plane (FIG. 31), so that the angle (β") is a few degrees (1° to 5°) greater than the calculated angle β'; in such a manner that, when seen in the plane of the rotation, the said angle (β"), which the said impact face forms with the spiral stream (S) at the location of impact is greater than 90°, when seen from a viewpoint which moves together with the said rotating impact member. In the vertical plane (FIG. 32), the impact face (170) is directed slightly downwards, with the angle (β'") being a few degrees (1° to 5°); in such a manner that, when seen from the plane directed perpendicular to the plane of the rotation, the said angle (β'"), which the said impact face forms with the spiral stream (S) at the location of impact is greater than 90°, when seen from a viewpoint which moves together with the said rotating impact member. Overall, the angles β" and β'" must be selected in such a manner that the actual impact angle (β) lies between 75° and 85°. An arrangement of this kind is possible with the aid of the calculated angle β').

Figure 33:
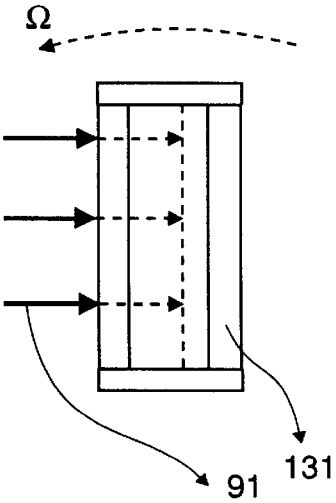
FIG. 33 diagrammatically shows a top view of an air-guidance member.
Figure 34:
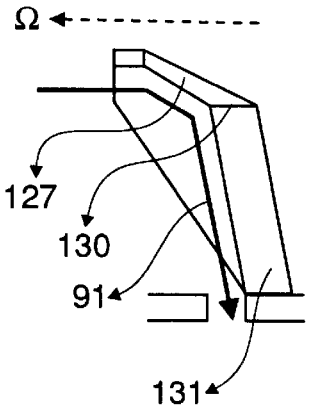
FIG. 34 diagrammatically shows a side view of an air-guidance member.
Figure 35:
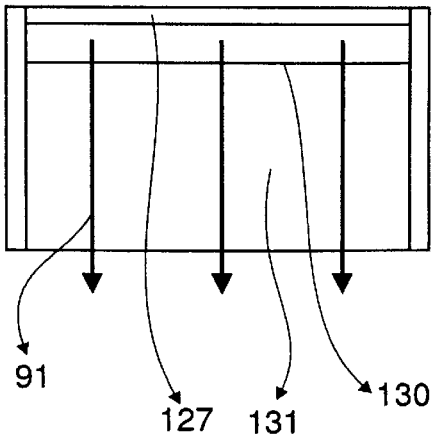
FIG. 35 diagrammatically shows a front view of an air-guidance member.

FIGS. 33, 34 and 35 show how a jet of air (91) can be blown in a simple manner and at great speed along the impact face (131), from the top towards the bottom, thus assisting the movement of adhering material in a direction which is as far as possible vertical, downwards along the impact face (131), while the stream ($S_{residual}$) of the rebounding material is guided more effectively. The jet of air (91) is generated with the aid of an air-guidance member (127) in the form of a partition (128) which is disposed along the top of the edge (130) of the rotating impact member (131).

The spiral streams which the grains describe between the guide member and the impact face may shift slightly as a result of natural effects.

Figure 36:
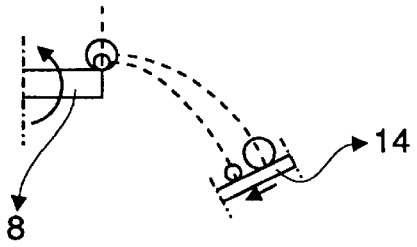
FIG. 36 diagrammatically shows the effect of the grain dimension on the spiral movement which the material describes when it comes off the guide member.

FIG. 36 shows the influence of the grain diameter. Since larger grains (153) make contact with the delivery end (11) for at somewhat longer period, to a somewhat greater distance from the axis of rotation (O), than smaller grains (154), larger grains (153) develop a somewhat greater take-off velocity ($v_{abs}$), and come off the delivery end (11) at a somewhat greater take-off angle (α) than smaller grains (154). The stream (155) of larger grains (153) therefore shifts outwards to some extent by comparison with the stream (156) of smaller grains (154). The length (l) of the guide member (8) can therefore be calculated as the length to the delivery end (11), increased by half the grain diameter.

Figure 37:
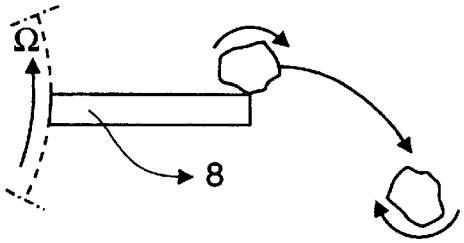
FIG. 37 diagrammatically shows a self-rotating grain.

FIG. 37 shows how the spiral stream (S) can shift slightly owing to the self-rotation (158) of the grain in this stream (S). This is true in particular of elongate grains.

Figure 38:
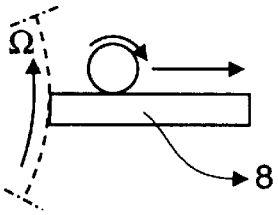
FIG. 38 diagrammatically shows rolling friction of a grain along the guide face.
Figure 39:
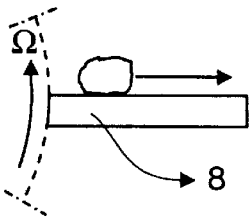
FIG. 39 diagrammatically shows sliding friction of a grain along the guide face.

FIG. 38 and FIG. 39 show a different behaviour of grains along the guide face (15). The grain can roll along this face (FIG. 38), but can also, as is generally the case, slide along it (FIG. 39). The coefficient of friction (ω) for rolling friction is normally less than for sliding friction, and as such affects the take-off velocity ($v_{abs}$) and the take-off angle (α), although only to a limited extent.

Figure 40:
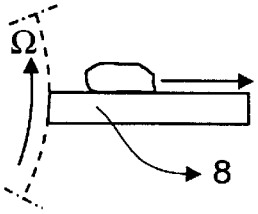
FIG. 40 diagrammatically shows the effect of the shape of the grain on the sliding friction along the guide face.
Figure 41:
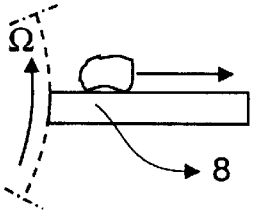
FIG. 41 diagrammatically shows the effect of the shape of the grain on the sliding friction along the guide face.

FIGS. 40 and 41 show that the contact surface (159)(160) between the grain and the guide face (10), depending on the shape of the grain, can differ considerably, which can affect the frictional behaviour and thus the take-off behaviour to some extent.

The factors mentioned above explain why the particles from the stream of grains (S) exhibit a certain spread (157) along the rotating impact face (15) as has been mentioned; this spread (157) increases further on in the stream (S).

Figure 42:
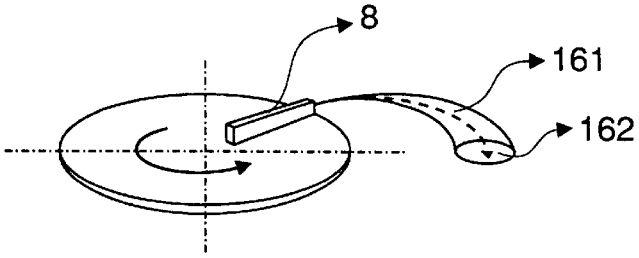
FIG. 42 diagrammatically shows the spiral bundle of paths which the stream of material describes after it comes off the guide member.

FIG. 42 shows that, owing to the abovementioned natural effects, the streams (S) which the separate grains from the material (S) describe as a whole form a bundle of streams (161). This behaviour is inherently essentially deterministic and controllable. As a result, the impacts become spread slightly over the impact face (15), with the result that a more regular wear pattern is produced. An extensive concentration of the impacts can lead to an irregular wear pattern, which can impair the impact of the grains. These natural effects must be taken into account when designing the impact face (15) by, as far as possible, adapting the design to the impact pattern (162) of the stream of material (161). As a general rule, it can be stated that the natural spread of the streams (161) which the grains describe, i.e. the extent to which the spiral streams (S) shift, increases as the stream of material contains grains with more divergent diameters, grain shapes which differ to a greater extent and as the material compositions of the grains differ increasingly, with differing coefficients of friction ($\omega$).

The impact pattern (162) has a major effect on the wear behaviour and is thus of great importance if the impact face (15) is to be designed optimally. In theory, the impact pattern (162) can be approximated effectively with the aid of computer simulation, but this simulation has to be checked and corrected using practical observations. An insight into the impact pattern (162) makes it possible to design a wear-resistant impact segment which has a relatively long service life.

Figure 43:
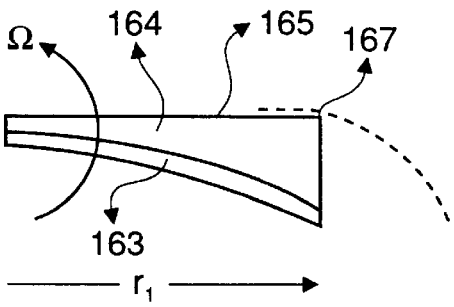
FIG. 43 diagrammatically shows a guide member with a guide face.
Figure 44:
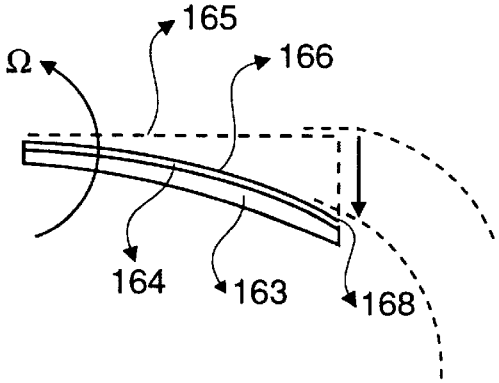
FIG. 44 diagrammatically shows a guide member with a guide face which has become worn.

FIG. 43 and FIG. 44 show a guide member (163) with a guide segment (164). The wear along the guide face (165) of the guide segment (164) increases with the radial distance ($r_l$) to the axis of rotation (O), i.e. outwards. As wear occurs, therefore, the guide face (165) is gradually curved backwards to a greater extent, when seen in the direction of rotation.

With increasing wear, the location (167→168) from where the material leaves the guide member (163) shifts backwards, when seen in the direction of rotation. As a result, the stream (S) which the particle describes between the guide member (163)(8) and the rotating impact member (14) also shifts backwards, when seen in the direction of rotation.

Figure 45:
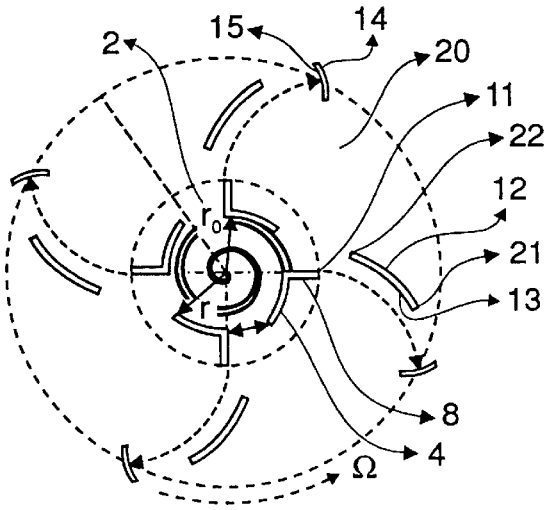
FIG. 45 diagrammatically shows a top view of a rotor which is equipped with single subsequent guide members.
Figure 46:
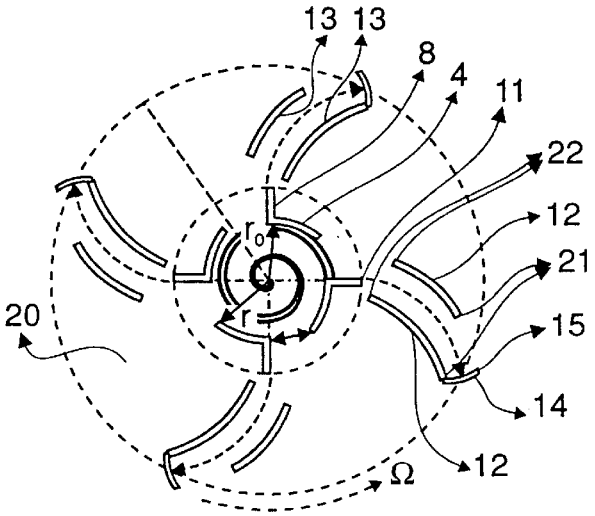
FIG. 46 diagrammatically shows a top view of a rotor which is equipped with double subsequent guide members.

FIGS. 45 and 46 show that, in the event that the stream of material (S) exhibits an excessive spread owing to natural or other effects, this can be corrected using the subsequent guide member (12), which is disposed with the subsequent guide face (13) along at least a section of one side of the spiral steam of material (S). A subsequent guide member (12) of this kind makes it possible also to gain better control of the air movement, in addition to the stream of grains.

It is necessary to prevent the stream (S) which the grains describe from being affected excessively by air movements. The air in the cylindrical chamber (20) between the guide member (8) and the rotating impact member (14) has to flow at virtually the same velocity and along the same spiral stream (S) as the said material, so that, as it were, a dish of air is formed in the circular chamber (20), which dish rotates in the same direction, at the same angular velocity ($\Omega$) and about the same axis of rotation (O) as the said guide member (8) and rotating impact member (14).

The central feed, the guide member and the delivery end are each subject to different forces. The central feed is subject to impact forces concentrating at the corners at the begin point and is further subject to both rolling and sliding wear. The guide face is subject to friction forces, caused mainly by sliding wear; the sliding wear increasing exponentially towards the end point of the guide member. The delivery end is subject to a sudden (total) drop in loading at the moment the particle leaves the guide member, resulting into intense friction and wear. It is therefor preferred to (geometrically) construct the different parts of the guide member in such a way that these can best withstand the particular forces. An important aspect is the choice of construction materials. Especially for the guide face the ceramics show interesting possibilities. However also a composite structure has interesting features.

Figure 47:
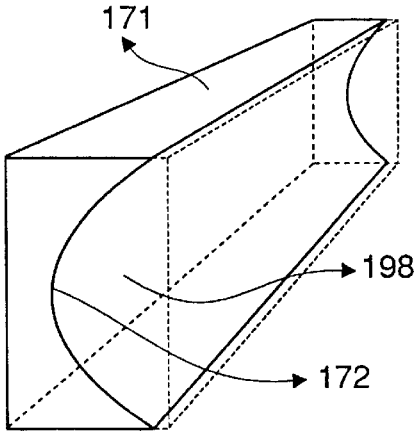
FIG. 47 diagrammatically shows a longitudinal wear pattern along the guide member.

FIGS. 47 shows a characteristic wear pattern of a guide member composed of one type of highly resistant metal or composite. The wear pattern develops towards the end point and has a strong tendency to concentrate in the middle, which tendency strongly increases when this pattern further develops. Such a wear pattern has the disadvantage that the stream of material is, during operation, increasingly concentrating towards the middle of the guide face, reducing the deterministic capacity. Furthermore this wear behaviour can narrow the bundle of streams of particles, concentrating the impacts of the particles at the impact face, which can result in a more uneven wear pattern of the impact face.

Figure 48:
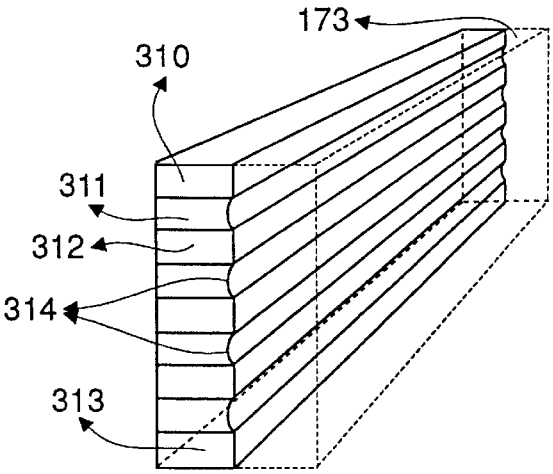
FIG. 48 diagrammatically shows a guide member with a longitudinal layered structure.

FIG. 48, shows a composite structure where, in longitudinal direction, the guide member has a layered construction which layers are alternated composed of materials with different wear resistance; in such a way that the top layer has a high wear resistance, the next layer a lower wear resistance, the third layer a higher wear resistance again, and so on, with the bottom layer having a high wear resistance. The thickness of the individual layers depends on the particle size distribution of the material. Such a composed structure shows a waved wear pattern developing evenly distributed longitudinal guide channels along the layers with low wear resistance. Such guide channels make is possible to distribute the stream of particles more evenly along the central feed, the guide face and the delivery end.

Figure 49:
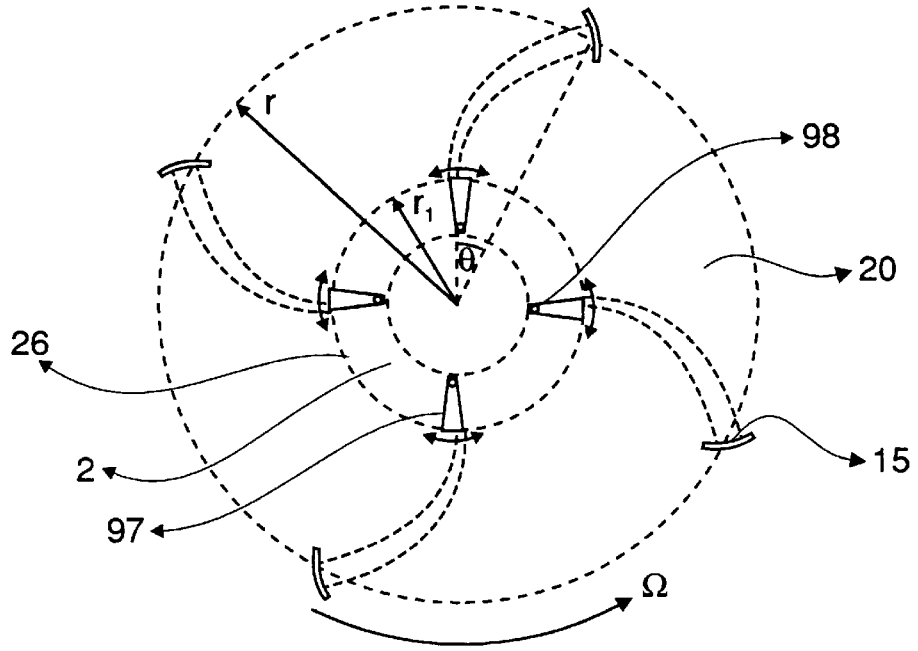
FIG. 49 diagrammatically shows a top view of a rotor which is equipped with pivoting guide members.
Figure 50:
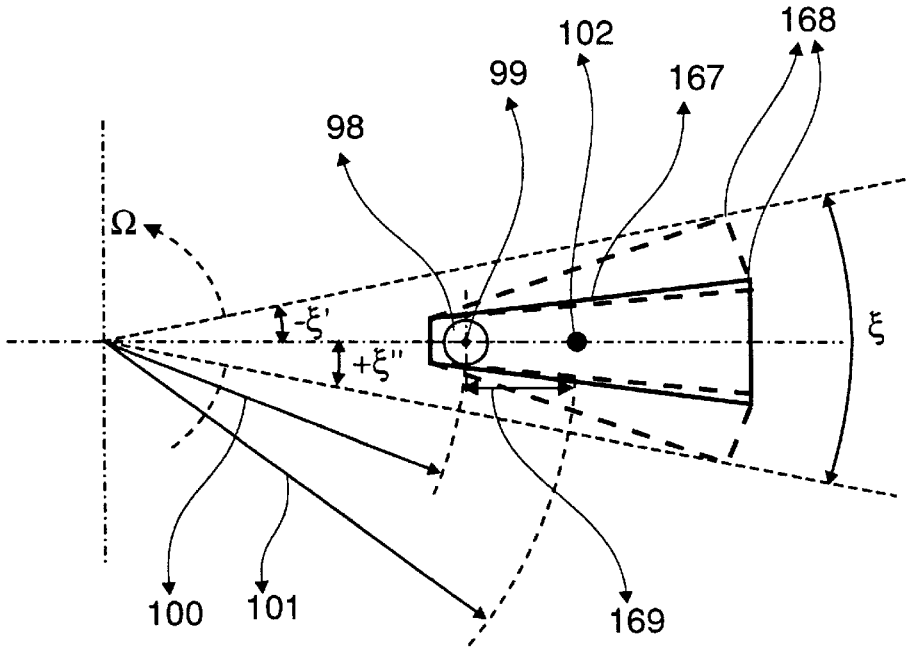
FIG. 50 diagrammatically shows a pivoting guide member.

FIGS. 49 and 50 show how, in the event of the impacts of the grains becoming concentrated on a specific point on the impact face (15), due to the composition of the granular material being so uniform that a natural shift of the stream of material (S) is limited, these impacts can be spread apart in a simple manner. To do this, the guide member (97) is suspended in a pivoting manner, with the aid of a vertical hinge (98) which is fastened to the rotor (2) along the edge of the metering face (3). The radial distance (100) from the axis of rotation (O) to the pivot point (99) must in this case be smaller than the corresponding radial distance (100) to the mass centre (102) of the pivoting guide member (97). Under the effect of the rotating movement of the rotor (2), the pivoting guide member (97) becomes directed radially outwards, but under the effect of a natural, slightly fluctuating loading of the guide face (167) by the stream of material ($S_r$), a certain degree of reciprocating movement of the delivery end (168) can occur. The angle ($\pm\xi$) which the delivery end (168) then forms with respect to the radial line on which is situated the location of the pivot point (99) can be limited both forwards and backwards. The degree to which the delivery end (168) moves in the process can be controlled using the distance (169) between the pivot point (99) and the mass centre (102) of the pivoting guide member (97). The smaller this distance (169) is made, the more the movement of the delivery end (168) increases. A pivoting guide member (97) of this kind moreover has the advantage that the spiral movement (S) is affected to a lesser extent by the wear along the guide face (167).

Figure 51A:
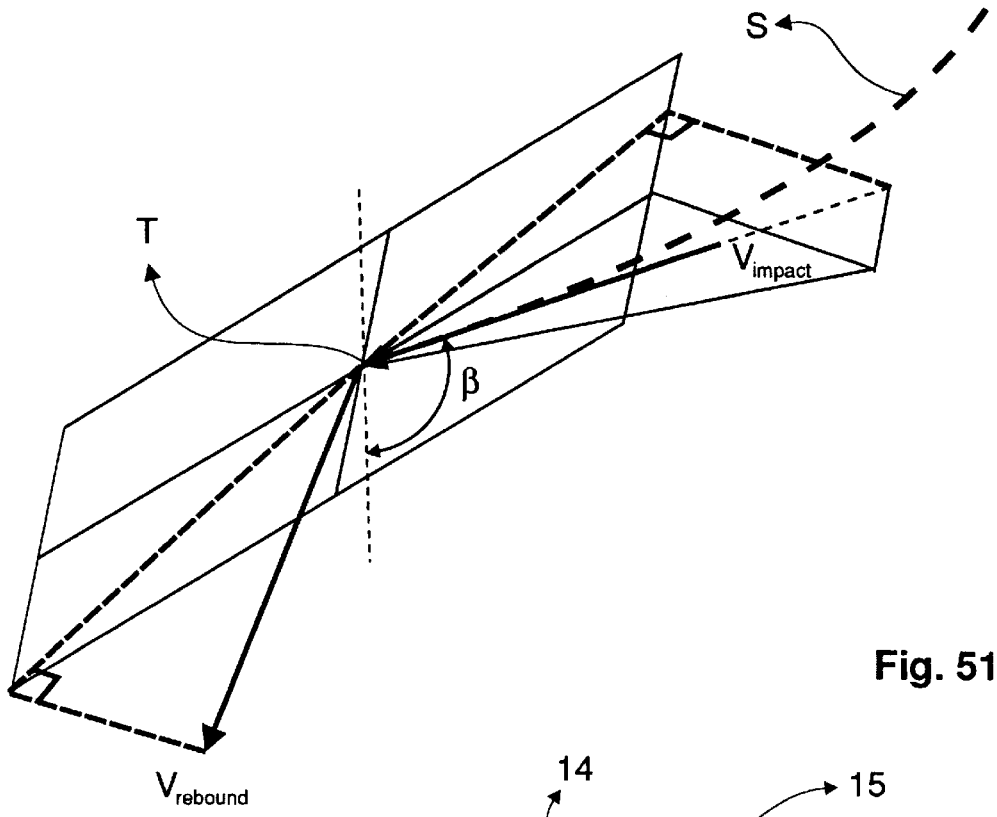
FIG. 51 diagrammatically shows a model for calculating the rebound behaviour of grains after they have struck the impact face of the rotating impact member.
Figure 51B:
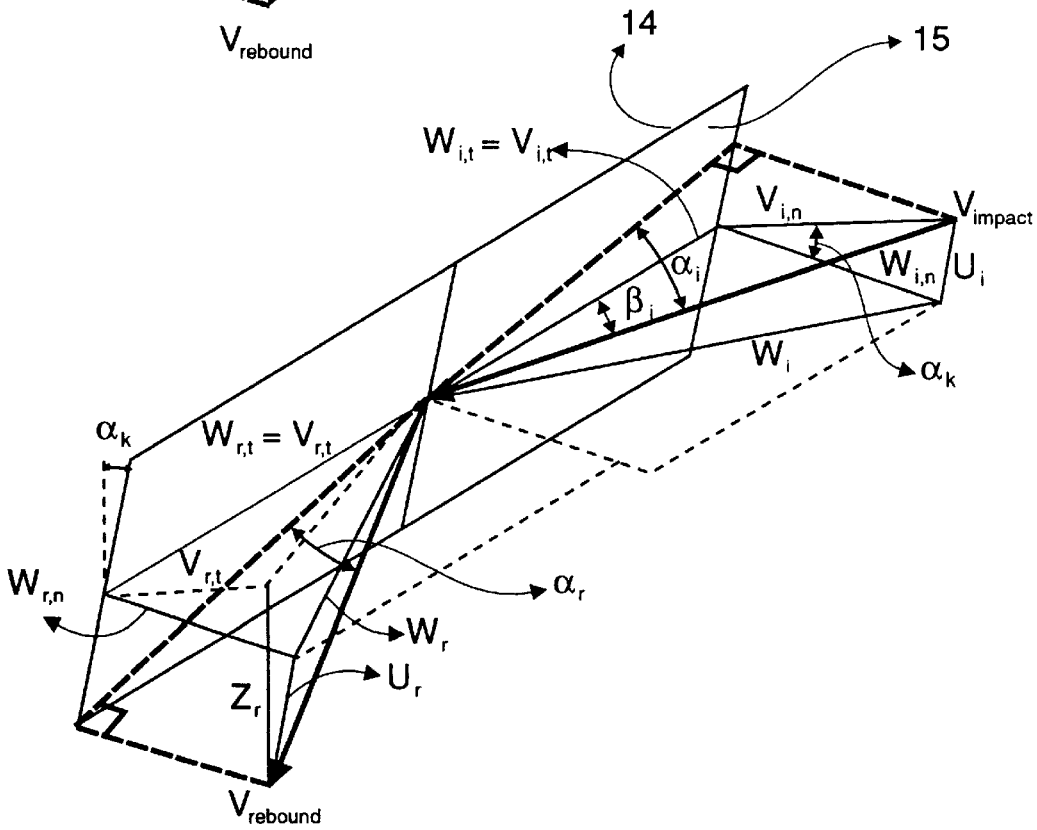

FIG. 51 diagrammatically shows the impact of the grain against the impact face (15) of the rotating impact member (14), and how this grain then comes off and is guided in a further stream ($S_{residual}$). With the aid of the already calculated impact velocity ($V_{impact}$) and the impact angle ($\beta$), it is possible, with the aid of the coefficient of restitution, within the model shown, to calculate the rebound velocity ($V_{residual}$) and the rebound angle ($\beta_r$).

Figure 52:
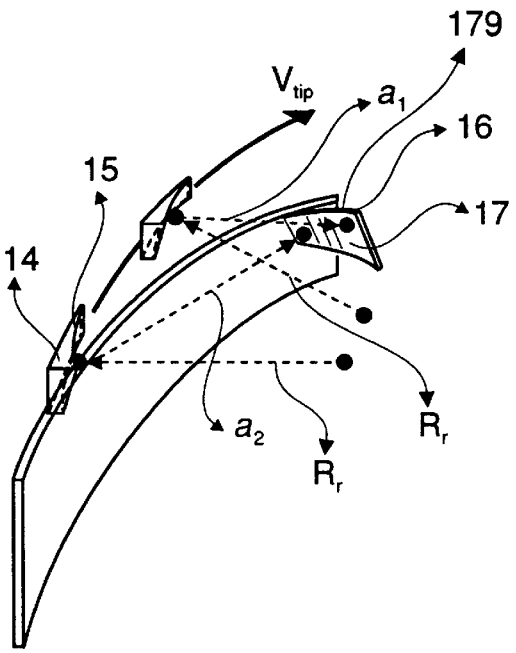
FIG. 52 diagrammatically shows a perspective view of part of the system.
Figure 53:
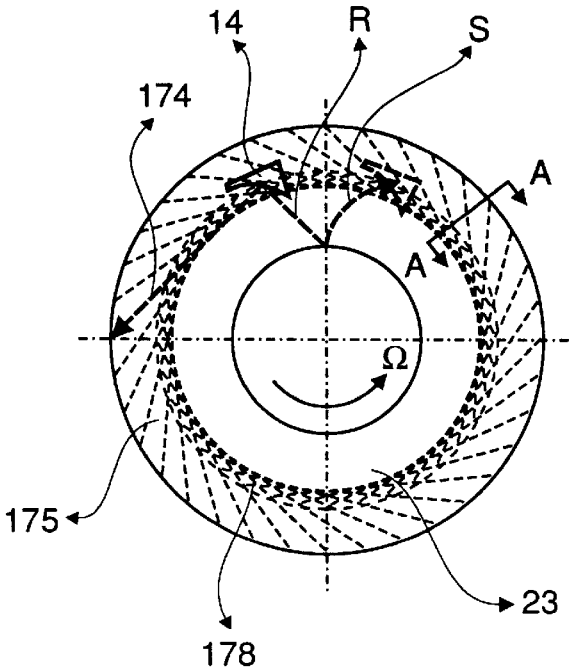
FIG. 53 diagrammatically shows a top view with a diagrammatic movement curve of the grains after they come off the rotating impact member.
Figure 54:
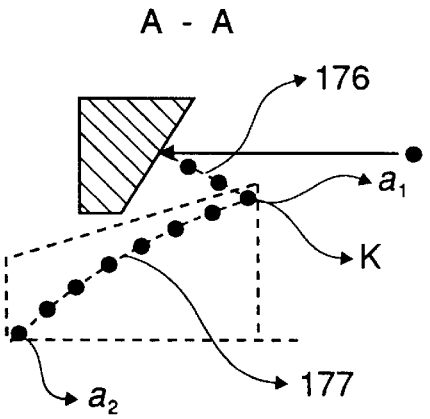
FIG. 54 diagrammatically shows a section on A—A of FIG. 53.
Figure 55:
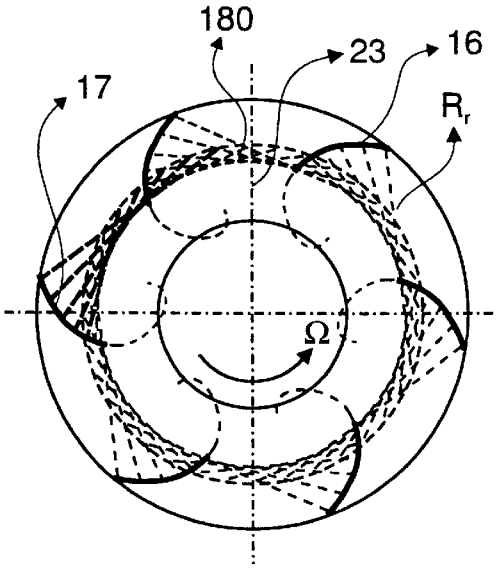
FIG. 55 diagrammatically shows a second top view with a diagrammatic movement curve of the grains after they come off the rotating impact member.

FIG. 52 diagrammatically illustrates the movement of the grains between the rotating impact member (14) and the stationary impact member (16). The velocity ($V_{residual}$) of the material when it comes off the impact face (15) of the rotating impact member (14) is at least equal to the absolute transverse velocity, i.e. the tip velocity ($V_{tip}$) of the rotating impact member (14). The impact against the collision face (17) of the stationary impact member (16) therefore takes place at a relatively great velocity, i.e. at a velocity ($V_{collision}$) which is at least equal to, and often greater than, the velocity ($V_{impact}$) at which the material hit the rotating impact member (14). Moreover, the impacts against the respective impact faces (15→17) take place in quick succession and at an optimum impact angle, increasing the probability of breakage considerably. Depending on the position of the two impact faces (15→17), the grains in the process have to cover a shorter ($a_1$) or longer ($a_2$) distance. FIG. 53 shows the grain movement, i.e. The trajectories (74), which the grains describe between the rotating impact member (14) and the stationary impact member (16). The trajectories (174) which the grains describe together form, as it were, a trajectory plane (175). FIG. 54 depicts the trajectory plane (175) in horizontal section. It is possible to differentiate here between an upper trajectory plane (176), a lower trajectory plane (177) and a trajectory turning point (K), the radius of which is equal to that of the inscribed circle (178) which the trajectories (174) describe. No impacts take place inside this inscribed circle (178) or trajectory turning point (K). It is furthermore important, since the trajectories between them carry out a type of "helical motion" (180) in the trajectory plane (174), as indicated in FIG. 55, that the grains are first guided out of the upper trajectory plane (176) to the lower trajectory plane (177), before they strike the collision face (17). It is necessary here to guide the grains over the edge (179) of the stationary impact member (16). At the location where the trajectory plane (175) intersects this upper edge (179), the straight streams (R), i.e. the trajectories, of the grains can be affected. The grains with the short trajectories ($a_1$) strike the top of the collision face (17) at a first radial distance from the axis of rotation (O), and the grains with the long trajectories ($a_2$) strike the bottom of the collision face (17) at a second radial distance which is greater than the first radial distance. This can be taken into account when designing the stationary impact member (16), which for this purpose can be designed with an oblique upper edge (179).

As has been stated, the method of the invention makes it possible to achieve relatively great impacts in quick succession, first against the impact face (15) and then against the collision face (17), using a relatively short guide member (8) and consequently with relatively low power consumption and, as a result, limited wear. This is achieved essentially by guiding the material in an uninterrupted spiral stream (S), when seen from a viewpoint which moves together with the rotating impact member (14), through a co-rotating breaking chamber (20) which, as it were, is moving, in which breaking chamber (20) the movement of the impact face (15) is synchronized with the spiral movement (S) of the material in such a manner that the material strikes this impact face (15) without making contact with the edges of the rotating impact member (14), which permits an essentially undisturbed, deterministic progress of the material movement and the first impact. If the material is guided out of the moving, rotating chamber (20), after the impact, in particular the upper edge (179) of the stationary impact member (16) provides an interfering influence. By extending the collision faces (17) as far as possible outwards, the number of collision faces (17) can be reduced considerably, as indicated in FIG. 55, and thus so can the abovementioned interfering influence. By curving the collision faces (17) along an involute, it is possible to make the grains, when seen from a horizontal plane, impact as far as possible perpendicularly. It is of coarse also possible to curve the collision face along an involute in the vertical plane.

As indicated above, the movement equations given apply to an idealized, resistance-free state. In reality, it is necessary, when determining the spiral stream (S) which the material describes between the guide member (8) and the rotating impact member (14), when seen from a viewpoint which rotates together with the system, to take into account the effects of, inter alia, the friction of the material with parts of the system, the air resistance, air movements, any inherent rotation of the material and the force of gravity. Although the nature of the movement (S) does not change significantly under the influence of these factors—the material has a relatively great velocity and the distance which the material covers between the guide member (8) and the rotating impact member (14) is relatively short—, it is nevertheless necessary to take into account the fact that a certain degree of spread will occur in the streams (S) which the material describes between the location (W) where it leaves the guide member (8) and the location (T) where the material hits the rotating impact member (14).

Figure 56:
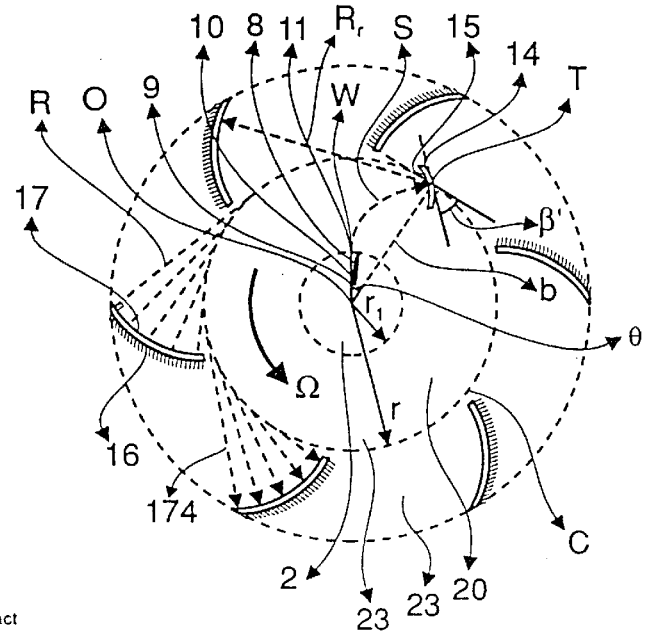
FIG. 56 diagrammatically shows the parameters for designing a device according to the method of the invention.

The method of the invention thus makes it possible, as indicated in FIG. 56, to optimize the design parameters, namely the radial distances to the central feed ($r_0$), the length (l) of the guide member (8), including the length of the central feed ($l_c$) and the guide face ($l_g$), the radial distance ($r_1$) before the said delivery end (11), the radial distance (r) to the rotating impact member (14), the instantaneous angle ($\theta$) between the guide member (8) and the rotating impact member (14) and the angle ($\beta$) at which the impact face (15) has to be arranged. Furthermore, these parameters make it possible to arrange the stationary impact member (16) as effectively as possible in the straight stream ($R_{residual}$) which the material describes when it comes off the impact face (15), when seen from a stationary viewpoint.

The method of the invention furthermore makes it possible to implement a number of principles which make it possible to optimize the process further, namely the principles of differentiation, segmentation and integration.

Figure 57:
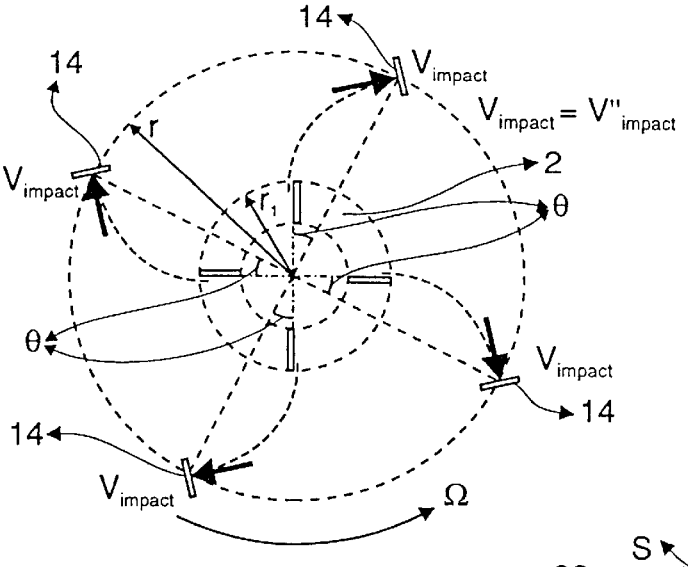
FIG. 57 diagrammatically shows a top view of the movements which the stream of material executes on a rotor with uniformly arranged rotating impact members.
Figure 58:
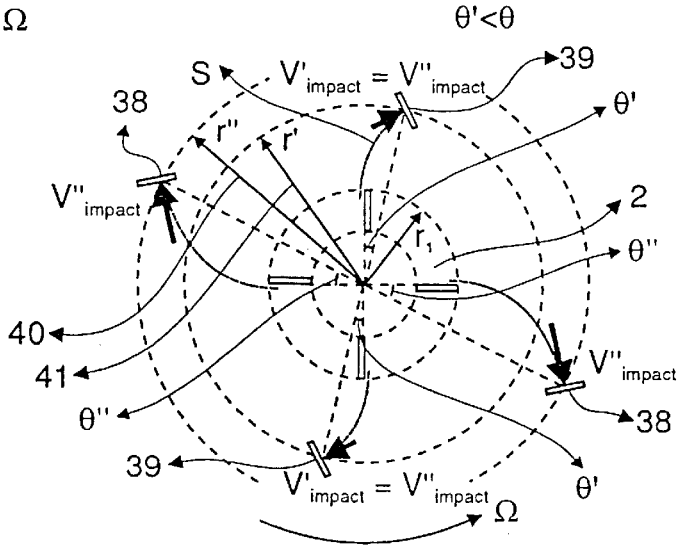
FIG. 58 diagrammatically shows a top view of the movements which the stream of material executes on a rotor with rotating impact members arranged in a differentiated manner.

Since the impacts of the material against the various rotating impact members (14) form essentially individual processes, it is possible to load the material differently in these separate processes. FIG. 57 shows the principle of differentiation, by means of which different loadings of this kind can be realized by comparison with an undifferentiated system (FIG. 58). In the undifferentiated system (58), the impact members (14) are disposed at equal radial distances (r) and are distributed uniformly around the axis of rotation (angle $\theta$). The impact intensity of each rotating impact member (14) is consequently identical. In the differentiated system, the impact members (38)(39) are positioned at different radial distances (r')(r") in the spiral movement ($\theta'$)($\theta''$). Consequently, there are, as it were, a plurality of breaking processes with different intensities functioning simultaneously next to one another. The particles are hit at a lower collision velocity by the rotating impact member (39) which is disposed at a short radial distance (r')($\theta'$) than by the rotating impact member (38) which is disposed at a greater radial distance (r')($\theta''$). The result is broken products with different grain size distributions, which moreover are immediately mixed with one another again. The principle of differentiation consequently makes it possible to control to a considerable extent the grain size distribution.

Figure 59:
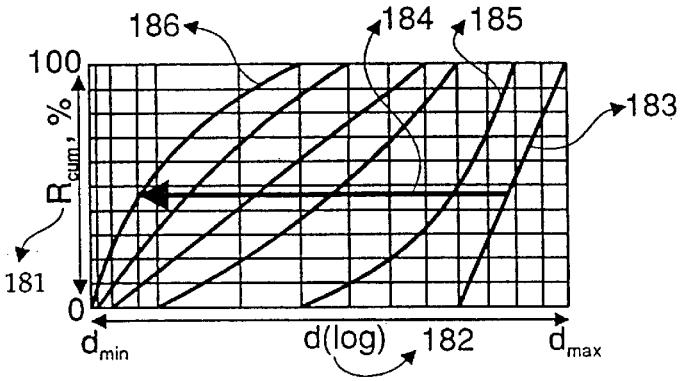
FIG. 59 diagrammatically shows the effect of the impact velocity on the grain size distribution of a broken product from a rotor with uniformly arranged rotating impact members.

FIG. 59 shows the grain size distribution, for different impact velocities, which is obtained with a crusher in which the rotating impact members (14) are not disposed in a differentiated manner and function identically. In this figure, the cumulative amount (181) of material is shown on a smaller scale than the specified diameter (182). The grain size distribution of the broken material is indicated by curve (183). As the collision velocity increases, the grain size distribution shifts in a direction (184) from a coarse (185) range to the fine (186) range and normally continues to run continuously. The grain size distribution can in this case essentially be affected only by the angular velocity (Ω). In this case, the grain size distribution, by changing the velocity, can essentially only be shifted from coarse (185) to fine (186). It is not possible to affect the grain size distribution otherwise.

Figure 60:
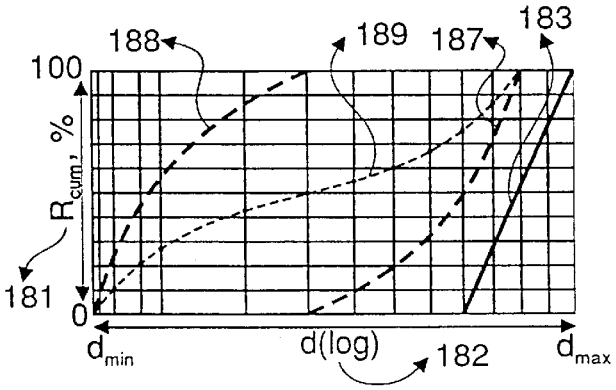
FIG. 60 diagrammatically shows the effect of the impact velocity on the grain size distribution of a broken product from a rotor with rotating impact members arranged in a differentiated manner.

FIG. 60 shows the grain size distribution, for a specific collision velocity, which is obtained with a crusher with a differentiated arrangement of the impact members. The grain size distribution of the broken material is shown by the curve (183). The figure further shows the sieve analyses of a relatively coarse, first broken product (187), which is produced with the rotating impact member at a short radial distance (r') and consequently a relatively low collision velocity, and the sieve analysis of a relatively fine second broken product (188), which is produced with the rotating impact member at a great radial distance (r") and consequently a relatively great impact velocity ($V''_{impact}$), or at least an impact velocity ($V''_{impact}$) which is greater than the impact velocity ($V'_{impact}$) at which the first broken product is produced. The result is thus, as it were, two different broken products at the same time, namely a fine broken product (188) and a coarse broken product (187), which moreover are immediately mixed. The combination of the fine product (188) and the coarse product (187) here provides a broken product with a grain size distribution (189) which cannot be produced directly using a crusher with an undifferentiated arrangement of the rotating impact members (14). In this way, it is basically possible to achieve "all possible" grain size distributions, including discontinuous grain size distributions (189), an example of which is given here. By making if the radial distance ($r_1$/r") at which the impact members are disposed adjustable, it is possible in this way substantially to control the grain size distribution.

The principle of differentiation can be implemented further with the aid of the principle of segmentation.

Figure 61:
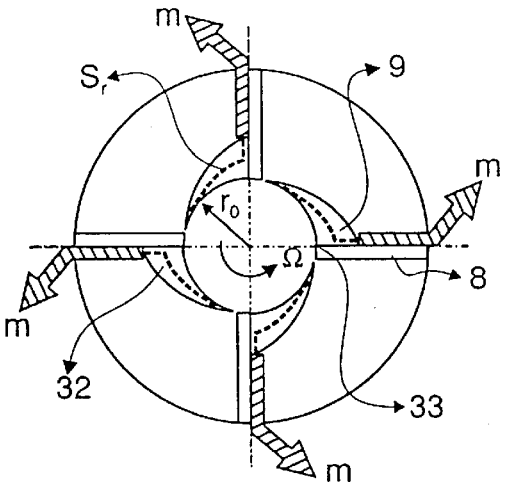
FIG. 61 diagrammatically shows the movement of the material along guide members which are arranged with the central feed at identical radial distances from the axis of rotation.

The material, when it is metered onto the rotor (2), is guided outwards, when seen from the axis of rotation (O), in a spiral movement ($S_r$), when seen from a viewpoint which rotates together with the rotor (2), which spiral movement ($S_r$) is directed backwards, when seen in the direction of rotation. Since the spiral movement ($S_r$) is interrupted by the guide members (8), there are formed, as shown in FIG. 61, as it were, feed segments (32) of material which is moving outwards in a spiral stream ($S_r$) and is taken up by the central feed (9) of the guide members (8), from where it is accelerated and flung outwards. As shown, in the event that the start points (33) of the guide members (8) are situated at identical radial distances ($R_0$) from the axis of rotation (O) and are distributed regularly around the central part of the rotor (2), the granular material from the central part is also distributed regularly over the various feed segments (32) between the guide members (8).

Figure 62:
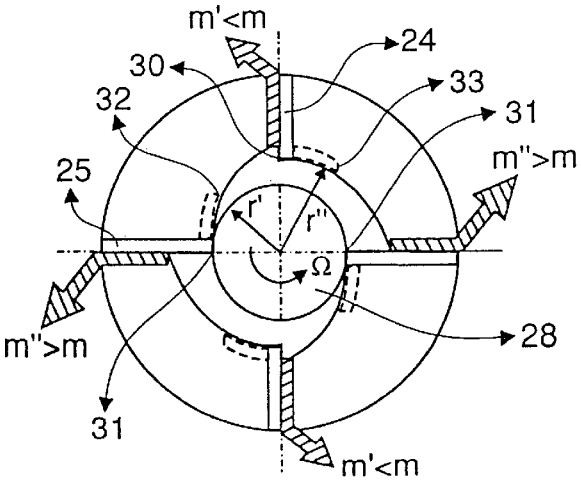
FIG. 62 diagrammatically shows the movement of the material along guide members which are arranged with the central feed at non-identical radial distances from the axis of rotation.

By varying the radial distances (r') (") from the axis of rotation (O) to the central feed (30)(31) of the guide members (24)(25), as is shown in FIG. 62, the effect is achieved that the feed segments (190)(191), from where the grains are fed to the guide members (24)(25), cover different areas, with the result that the various guide members (24)(25) are fed with different amounts of material. Less material is taken up by the guide member (24) which is disposed with the central inlet (30) at a greater radial distance ($r_0$") from the axis of rotation (O) than by the guide member (25) which is disposed with the central inlet (32) at a shorter radial distance ($r_0$') from the axis of rotation (O). This makes it possible to feed the rotating impact members (16), which are arranged in a differentiated manner at different radial distances (r')("), with different amounts of material, with the result that the quantities of coarse and fine broken product which are produced can be controlled further, and thus so can the grain size distribution.

Figure 63A:
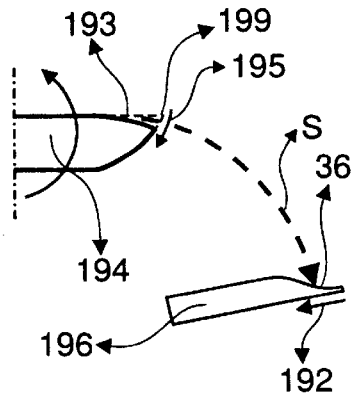
FIG. 63 diagrammatically shows the integrated wear behaviour of the guide member and the impact member.
Figure 63B:
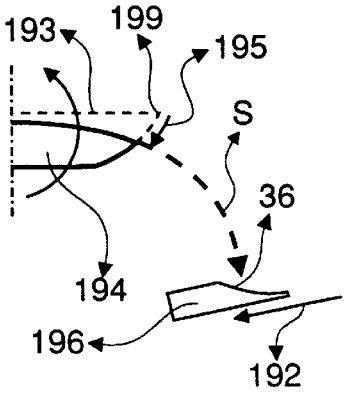
Figure 63C:
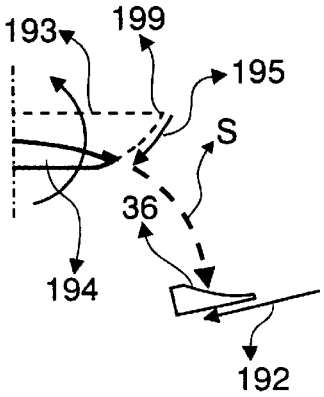
Figure 64A:
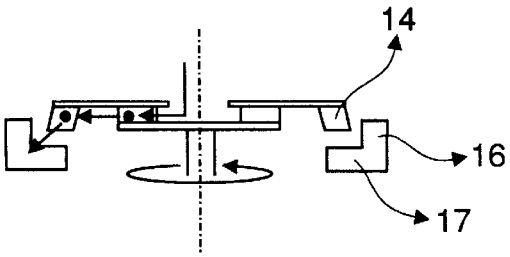
FIG. 64 diagrammatically shows the further progress of integrated wear behaviour of the guide member and the impact member in accordance with FIG. 63.
Figure 65A:
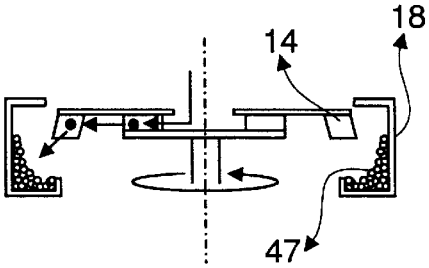
FIG. 65 diagrammatically shows the further progress of integrated wear behaviour of the guide member and the impact member in accordance with FIG. 64.
Figure 64B:
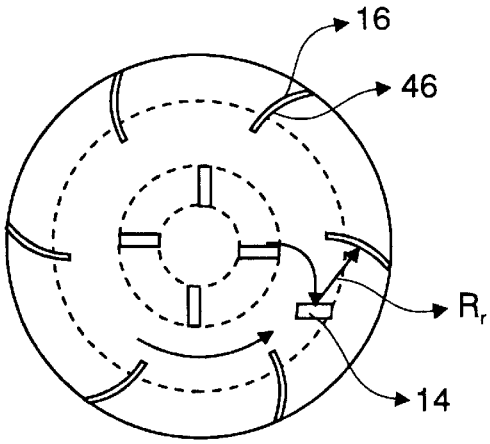
Figure 65B:
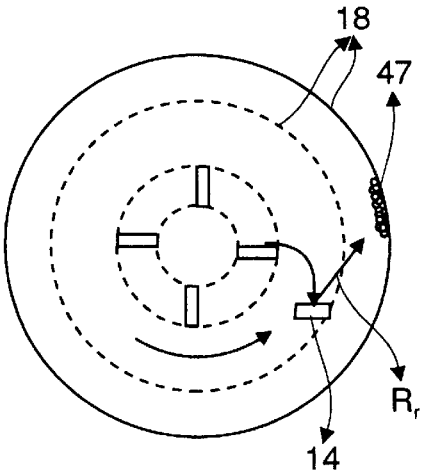

The principle of integration means that the progress of the wear (192), as the spiral (S) shifts, as indicated in FIGS. 63, 64 and 65, which takes place simultaneously along both the guide surface (193) of the guide member (194) and the guide face of the guide member (196), are as far as possible adapted to one another, specifically so that the wear (195) to the guide member (194) progresses, as it were, synchronously with the wear (192) to the rotating impact member (196), so that both elements (194)(196) become worn and can be replaced virtually simultaneously.

The method of the invention makes it possible to comminute granular material having dimensions between 3 mm (or even 1 mm) and about 100 mm, it being possible to achieve a high level of comminution; depending on circumstances, a degree of comminution of more than 25.

To comminute material finer than 1 to 3 mm, the rotor and the stationary impact members must be disposed in a chamber (not shown here) in which a partial vacuum can be created, so that there is no hindrance from air resistance and air movements. An arrangement of this kind makes it possible to achieve extremely great fineness, down to less than 5 $\mu$m, with a relatively low power consumption and, by comparison with known systems, with relatively low wear.

Furthermore, the rotor and the stationary impact member may be disposed in a chamber (not shown here) in which a low temperature can be created. This makes it possible to increase considerably the brittleness of certain materials, with the result that a much better breaking probability is achieved than at room temperature.

The following figures show a number of embodiments according to the method of the invention for devices and a rotor for breaking granular material. All the rotors described are equipped here with four guide members and four associated impact members. It is clear that the rotors may be equipped with fewer and, within practical limits, with more guide members and associated impact members. It is also clear that the various components which are described for the various devices may be combined with one another in other ways and that all the rotors described may function without a stationary impact member.

Figure 66:
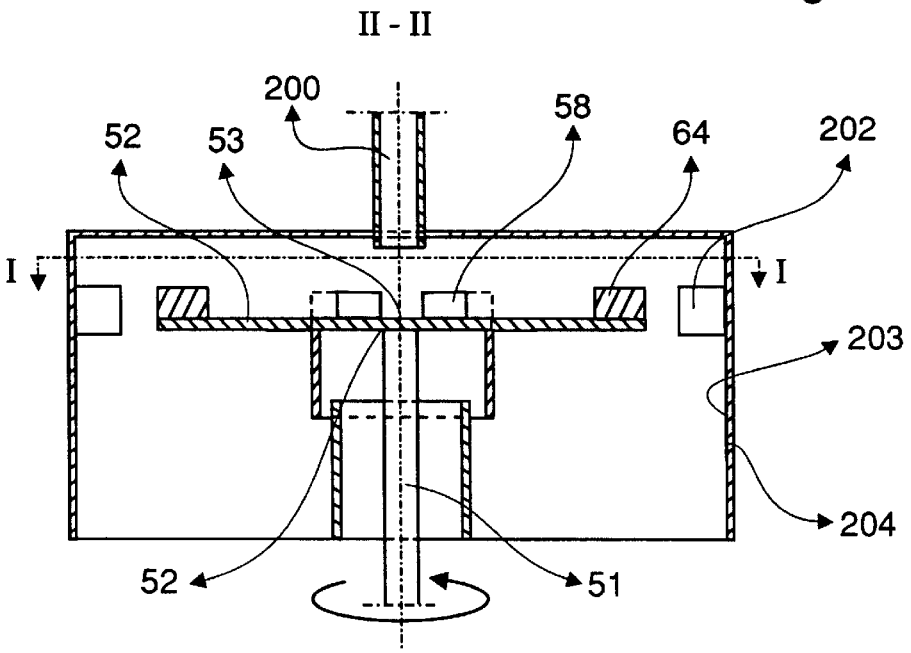
FIG. 66 diagrammatically shows a cross-section on II—II of a first embodiment, according to the method of the invention, for a device for breaking granular material, from FIG. 67.
Figure 67:
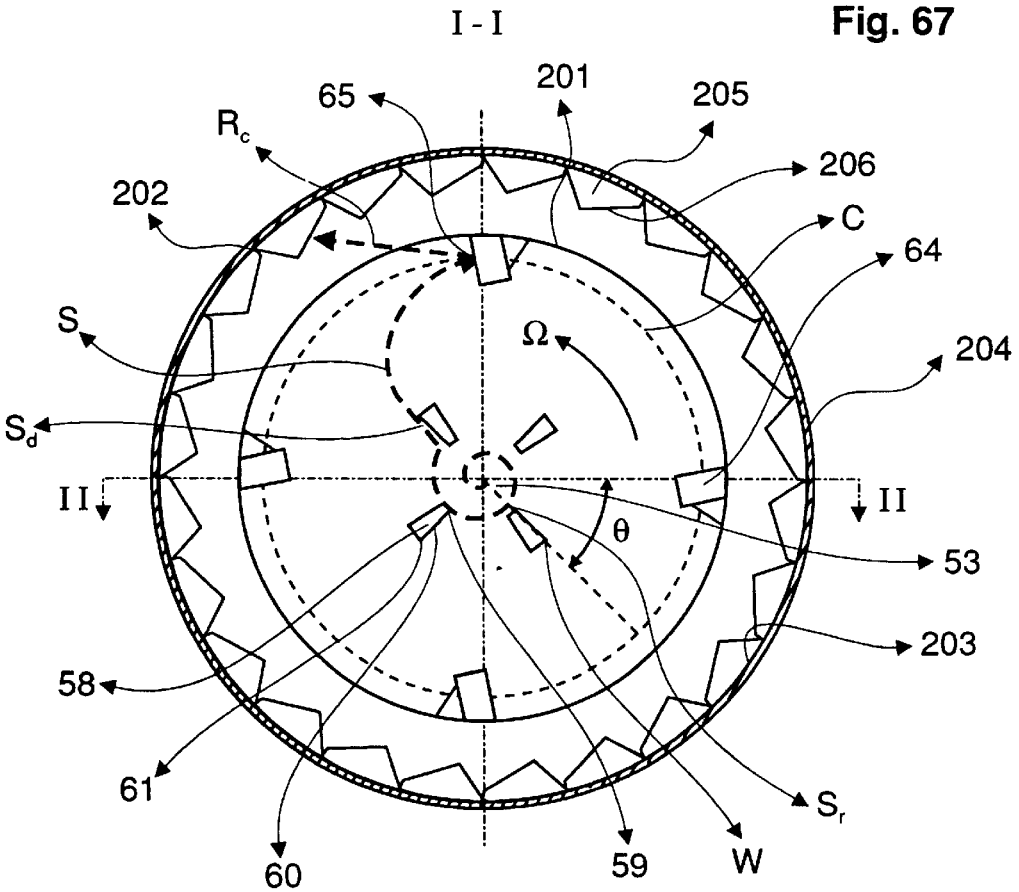
FIG. 67 diagrammatically shows a longitudinal section on I—I of a first embodiment, according to the method of the invention, for a device for breaking granular material, from FIG. 66.

FIG. 66 and FIG. 67 diagrammatically show a first embodiment, according to the method of the invention, for a device for breaking granular material.

The material to be broken is fed centrally onto the top of the rotor (52) via a feed pipe (200). The rotor (52) bears four guide members (58), which are distributed evenly and are disposed at a radial distance around the axis of rotation (O). Each of the guide members (58) is provided with a central feed (59), guide face (60) and delivery end (61). The stream of material ($S_r$) which is metered onto the central part of the rotor (52) is accelerated with the aid of the relatively short guide members (58) in the direction of the rotatable impact members (64), which are associated with each guide member (58) and are disposed, at a greater radial distance from the guide members (58), along the edge (201) of the rotor (52), and are supported by the said rotor (52). From a coordination system which is fixed with respect to the rotor (52), the material, when seen from a viewpoint which moves along with the rotatable impact member (64), moves along the spiral path (S) towards the impact fact (65) of the rotatable impact member (64). Thus in this case, when seen in the plane of the rotation and when seen from a viewpoint which moves along, the impact face (65) is directed virtually transversely to the spiral stream (S) of material. After impact against the rotatable impact member (64), the stream of material is accelerated again by the rotatable impact member (64) and is flung at great speed against a stationary armoured ring (202), which is arranged around the rotor (52) and is fastened against the outer wall (203) of the crusher housing (204). The armoured ring (202) comprises separate segments (205) which are each provided with an impact face (206) which is arranged virtually transversely in the straight stream (R) which the material describes when it comes off the rotatable impact member (65), when seen from a stationary viewpoint. The stationary armoured ring (202) as a whole therefore has a sort of knurled shape. In this embodiment, a stream (S)(R) of material is subjected to direct multiple (double) loading, the impacts taking place at a virtually perpendicular angle.

Figure 68:
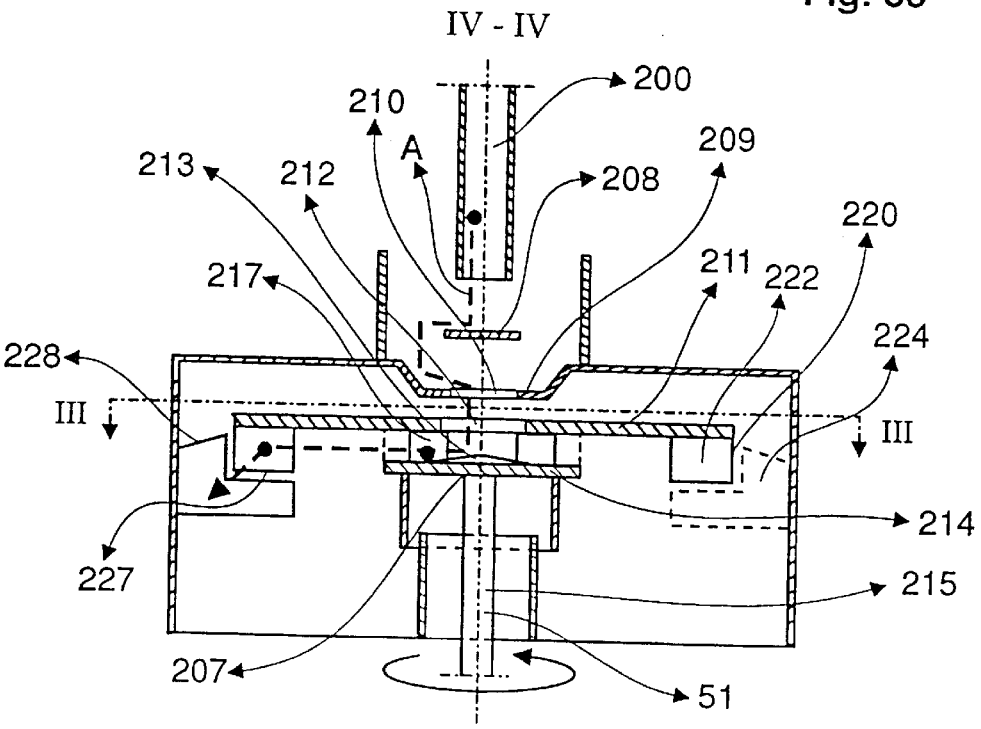
FIG. 68 diagrammatically shows a cross-section on IV—IV of a second embodiment, according to the method of the invention, for a device for breaking material, from FIG. 69.
Figure 69:
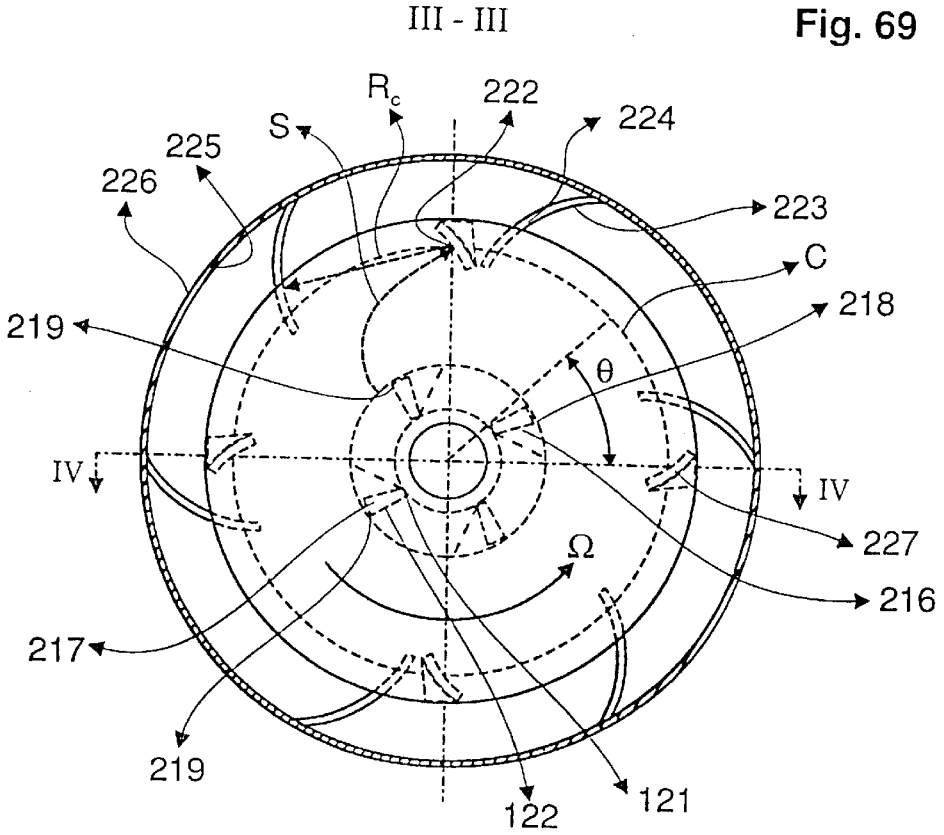
FIG. 69 diagrammatically shows a longitudinal section on III—III of a second embodiment, according to the method of the invention, for a device for breaking material, from FIG. 68.

FIG. 68 and FIG. 69 diagrammatically show a second embodiment, according to the method of the invention, for a device for breaking material.

The material to be broken is metered onto a stationary plate (208) centrally above the rotor (207), via a feed pipe (200), which plate interrupts the fall of the stream of material. The material then flows to a following horizontal plate (209) situated at a lower level, which is provided in the centre, centrally above the rotor (207), with a round opening (210), through which the material, via an opening (212) in the centre of a first rotor blade (211), is moved onto the metering face (213) of a second rotor blade (214), which second rotor blade (214) is supported by the same shaft (215) as the first rotor blade (211), but has a smaller diameter than the first rotor blade (211). The second rotor blade (214) is connected to the first rotor blade (211) by means of projections (216) which are disposed behind the guide members (217). The metering face (213) is designed in the form of an upright cone, so that the material is guided outwards in a flowing movement, towards the relatively short guide members (217) which are disposed along the edge (218) of the second rotor blade (214). The stream of material ($S_c$) is accelerated with the aid of the guide member (217) and is flung outwards from the delivery end (219) and guided along a spiral path (S), when seen from a viewpoint which moves together with the rotor (207), freely through the air in the direction of a rotatable impact member (220) which is associated with the said guide member (217) and is freely suspended, at a greater radial distance from the axis of rotation (O) than the guide member (217), along the bottom of the edge (221) of the first rotor blade (211). After the material has struck the impact face (222) of the said freely suspended, rotatable impact member, (220) and has come off the latter, the stream of material (R) strikes the collision faces (223) of stationary impact members (224) which stand in the straight path (R) which the material now describes, when seen from a stationary viewpoint. These stationary impact members (224) are fastened to the outer wall (225) of the rotor housing (226). The impact face (222) of the rotatable impact members (220) is directed slightly obliquely inwards and slightly obliquely downwards, in such a manner that the material is guided, from the periphery (221) which the rotatable impact member (220) describes, obliquely downwards out of the rotor (207), along a straight virtually tangential stream (R). The collision faces (223) of the stationary impact members (224) are curved concavely, in accordance with the involute which the stream (R) describes from the said periphery (221), so that the impacts of the grains from the stream of material (R), when seen from the plane of the rotation, take place as far as possible at a perpendicular angle. In the vertical plane (not shown here), the collision face (223) can be tilted in such a manner that the impacts take place as far as possible at an angle of between 80° and 85°. The stationary impact member (227) is arranged along the bottom of the edge (220) of the rotatable impact members (220) and is continued outwards, so that the number of stationary impact members (224) is limited as far as possible. Furthermore, the collision faces (223) are continued upwards to some extent along the outside of the rotatable impact members (220), so that there too material can be taken up. The freely suspended, rotatable impact members (220) have the advantage that there is no hindrance from rebounding material, while this design permits simple suspension of the rotatable impact members (220).

Figure 70:
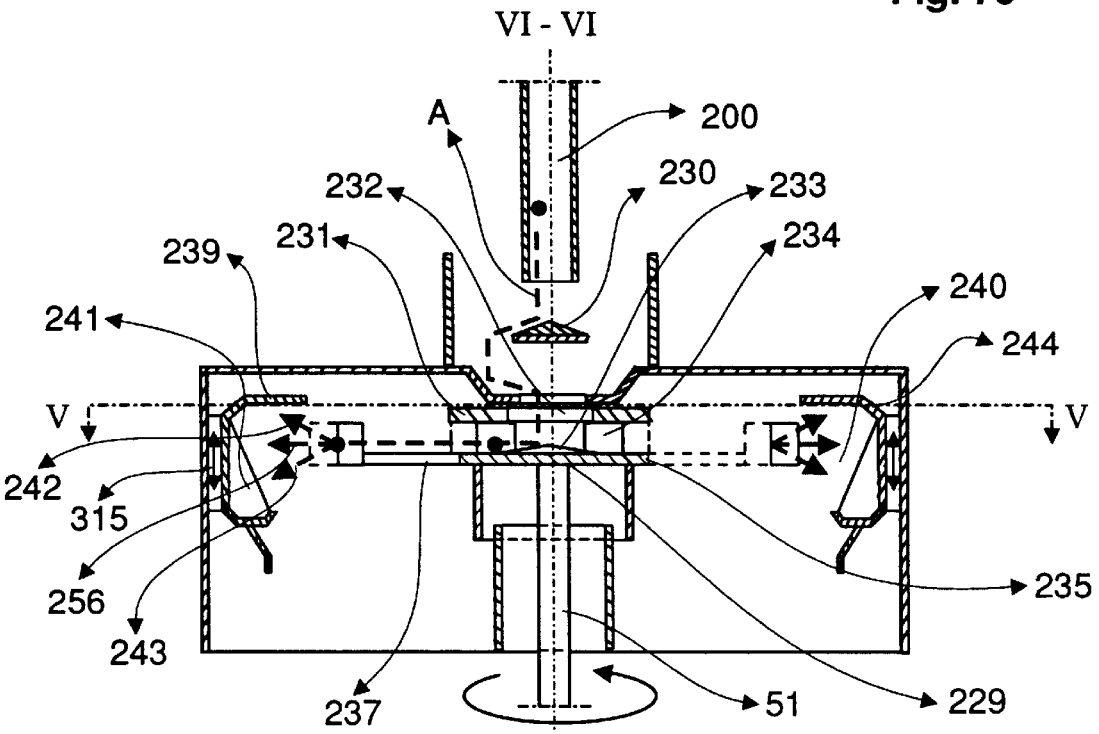
FIG. 70 diagrammatically shows a cross-section on VI—VI of a third embodiment according to the method of the invention, for a device for breaking granular material, and at the same time working the shape of the grain of the broken product, from FIG. 71.
Figure 71:
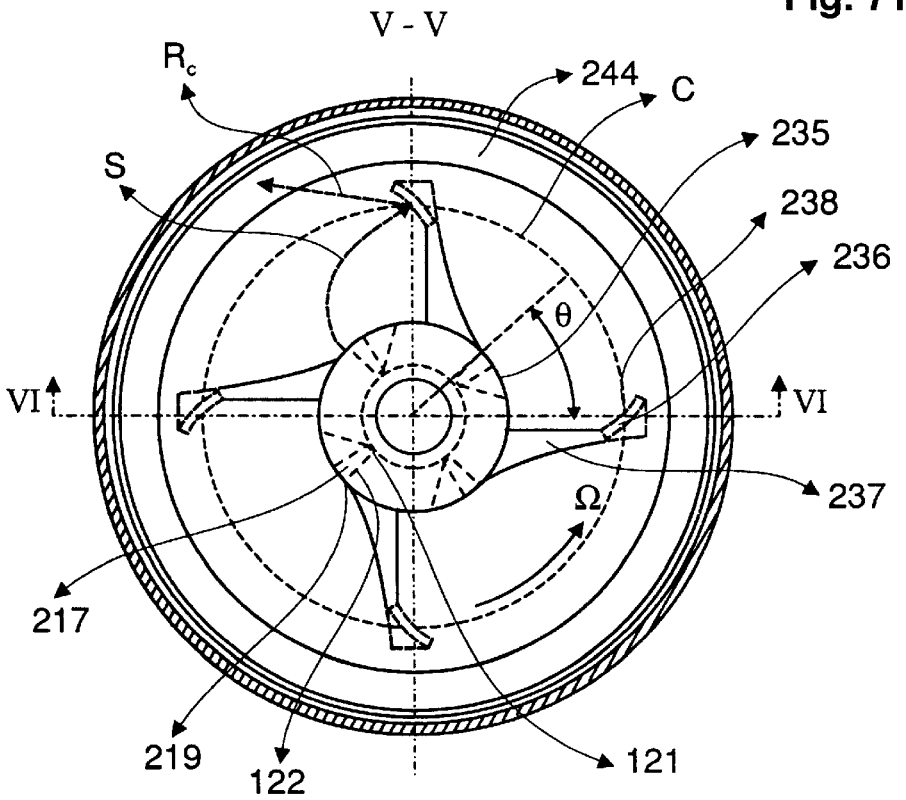
FIG. 71 diagrammatically shows a longitudinal section on V—V of a third embodiment according to the method of the invention, for a device for breaking granular material, and at the same time working the shape of the grain of the broken product, from FIG. 70.

FIG. 70 and FIG. 71 diagrammatically illustrate a third embodiment according to the method of the invention for a device for breaking granular material, and at the same time treating the shape of the grain of the broken product.

The material to be broken is metered onto a stationary plate (230) centrally above the rotor (229), via a feed pipe (200), which plate interrupts the fall of the material. The plate (230) is designed in the form of an upright cone, so that the material is guided further in a flowing movement. The material flows along the plate (230) to a subsequent plate (231), which is disposed in the centre, centrally above the rotor (229), and is provided with a round opening (232), through which the material is moved evenly onto the metering face (233) of the rotor (229), which metering face (233) is likewise designed as an upright cone. The stream of material ($S_r$) is accelerated along guide members (234) which are disposed along the edge (235) of the rotor (229), and, from there, in free flight, are guided to the associated impact members (236) which, at a greater radial distance from the axis of rotation (O) than the impact members (234), are fastened to arms (237) which are supported by the rotor (229). After the stream of material (S) has struck the impact face (238) of the rotatable impact members (236) and comes off it, the material is guided into a trough structure (239), which is disposed around the outside of the rotatable impact members (236), with the opening (240) directed inwards. A bed of the same material (241) builds up in the trough structure (239), against which bed of material the material then impacts. The autogenous action, i.e. the intensive rubbing of the grains against one another, provides a high level of cubicity of the broken product.

As depicted diagrammatically, the stream of material (R), after it comes off the rotatable impact member (236), may be guided, depending on the angle at which the impact face (238) is disposed in the vertical direction, towards the autogenous bed (241) respectively in a horizontal movement (241), a movement directed obliquely upwards (242) and a movement directed obliquely downwards (243). This makes it possible to adapt the autogenous process, together with the arrangement of the height of the trough structure (239), to the material. In the event of a large number of fine particles being formed, the autogenous bed (241) has the tendency to take up too much fine material, with the result that the bed, as it were, dies. This can be partially prevented by air arranging the bed somewhat higher and guiding the stream of material (242) slightly obliquely upwards into the bed (241). In the event that not so many fine particles are formed, the autogenous bed (241) may be arranged at a lower level and the material can be guided into this bed obliquely from above (243), so that the autogenous intensity is increased. For this purpose, the device is equipped with a trough structure (239) whose height (244) can be adjusted.

Figure 72:
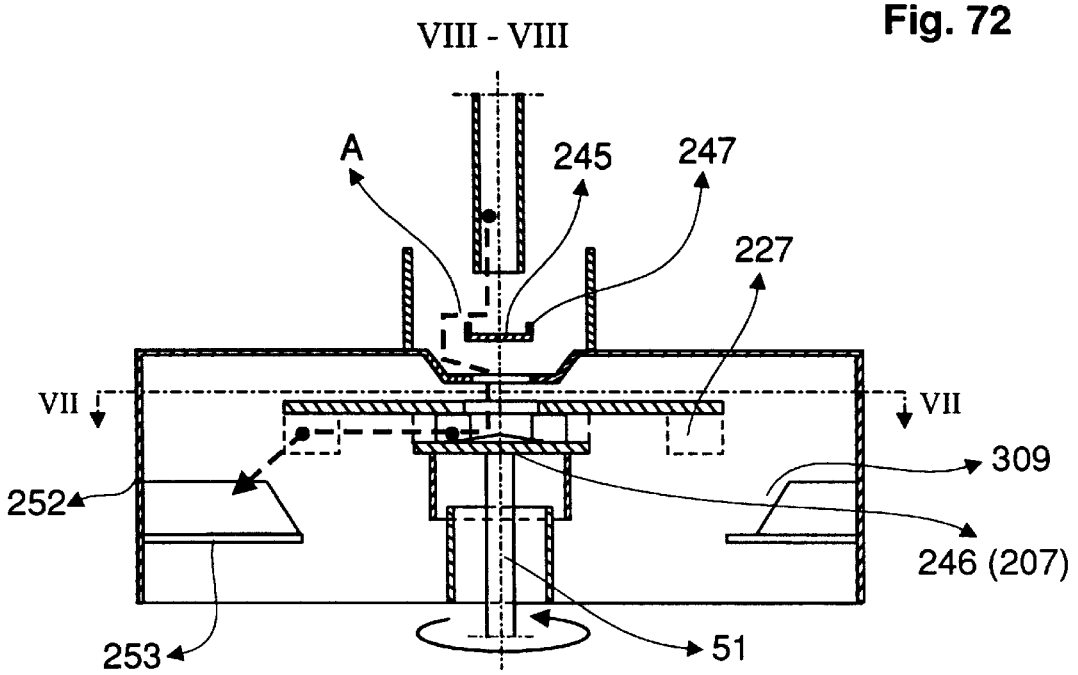
FIG. 72 diagrammatically shows a cross-section on VIII—VIII of a fourth embodiment, according to the method of the invention, for a device for colliding granular material, from FIG. 73.
Figure 73:
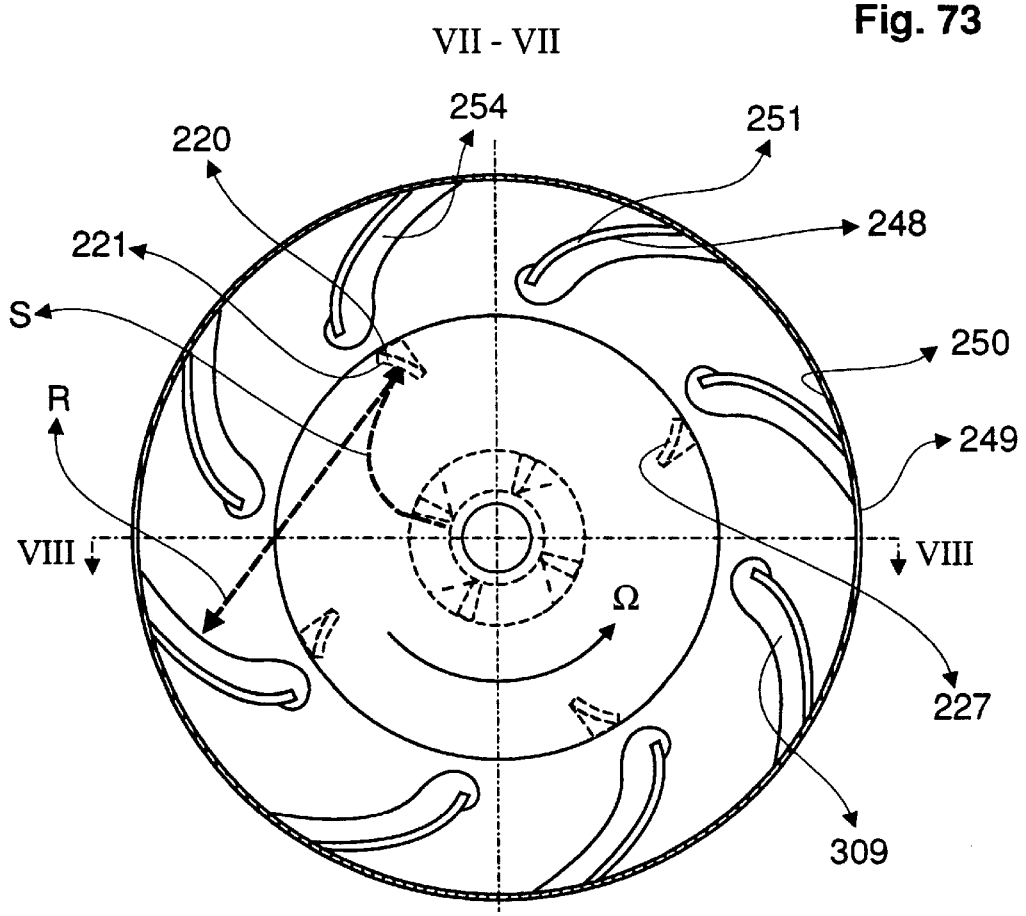
FIG. 73 diagrammatically shows a longitudinal section on VII—VII of a fourth embodiment, according to the method of the invention, for a device for colliding granular material, from FIG. 72.

FIG. 72 and FIG. 73 diagrammatically show a fourth embodiment according to the method of the invention for a device for colliding granular material.

The material is fed centrally above the rotor (246), via a feed pipe (200), onto a stationary, round plate (245), which is provided along the edge (247) with an upright rim, so that a bed of material is formed on the plate (245), limiting the wear to the plate. The stream of material is guided further, along the bed of the same material thus formed, to a rotor (246) which is designed in accordance with the second embodiment (207). After the stream of material comes off the rotatable impact member (220), it is guided further to collision faces (248) of stationary impact members (251), which are fastened around the outside of the rotatable impact members (220), along the wall (250) of the crusher housing (249). The collision faces (248) are curved in accordance with the involute which the stream of material (R) describes from the periphery which the rotatable impact members (220) describe. In the vertical plane (not shown here), the collision faces (248) can be arranged slightly inclined towards the rear, so that the stream of material (R), which is directed slightly obliquely downwards (252) from the impact face (222), strikes this collision face (248) virtually perpendicularly. Horizontal plates (253) may be fastened along the bottom of these stationary impact members (251). This results in the formation, below and along the front of the involute collision face (248), of a rim (254) on which material accumulates and, therefore, builds up an autogenous bed against the involute collision face (248). This design, which, by making the plates (253) along the bottom of the stationary impact members (251) removable, can be used in accordance with the steel-on-steel principle and the steel-on-stone principle, thus makes it possible largely to protect the collision face (248) from wear, while nevertheless bringing about an intensive working of the material.

Figure 74:
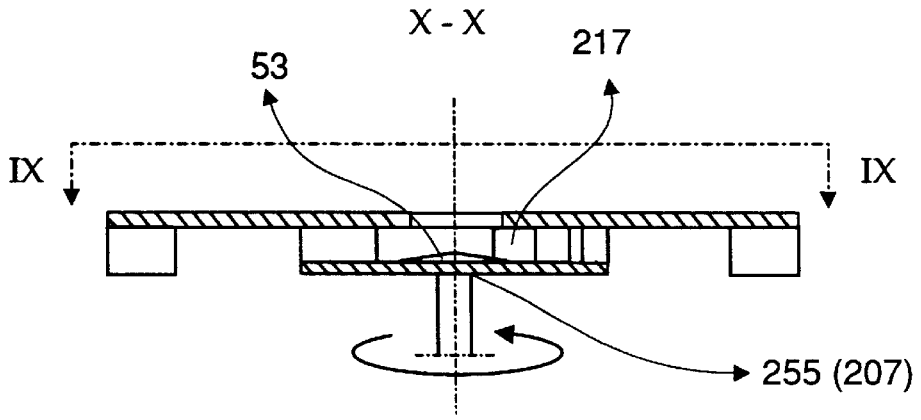
FIG. 74 diagrammatically shows a cross-section on X—X of a fifth embodiment, according to the method of the invention, of a rotor which is provided with a preliminary guide member and a subsequent guide member, from FIG. 75.
Figure 75:
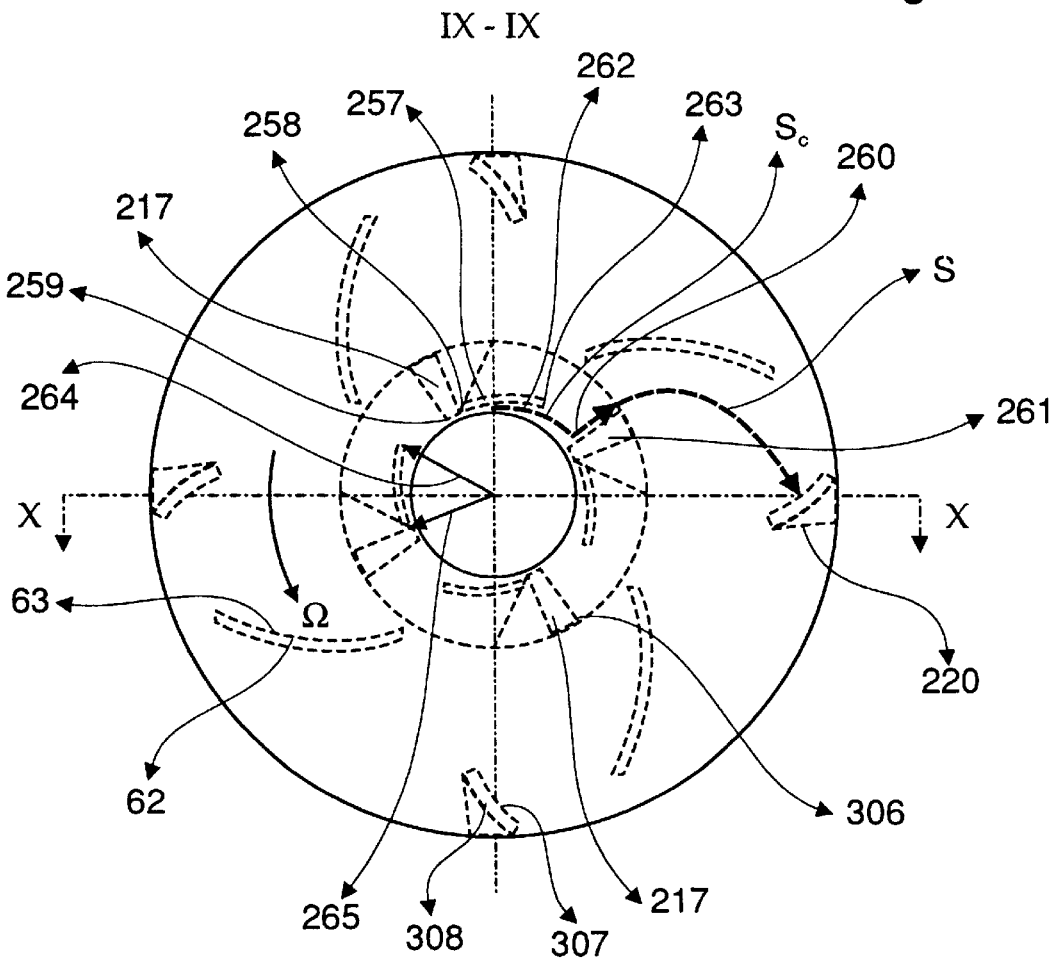
FIG. 75 diagrammatically shows a longitudinal section on IX—IX of a fifth embodiment, according to the method of the invention, of a rotor which is provided with a preliminary guide member and a subsequent guide member, from FIG. 74.

FIG. 74 and FIG. 75 show a fifth embodiment according to the method of the invention of a rotor (52) which is provided with a preliminary guide member and a subsequent guide member.

The rotor (255) is similar to the rotor (207) which is described in the second embodiment, but is provided with preliminary guide members (257), which are associated with the guide members (217) and extend from a central inlet (258), which is positioned in the direction of rotation immediately behind the central feed (259) of the guide member (217), in a direction of the central feed (260) of the guide member (261) which follows in the direction of rotation. The preliminary guide face (262) of the preliminary guide member (257) is curved along the natural spiral stream ($S_r$) which the material describes at that location on the rotor (255), the delivery location (263) of the preliminary guide member (257) lying at a greater radial distance (264) from the axis of rotation (O) than (265) the central inlet (258). Furthermore, a subsequent guide member (264) is disposed on the outside, i.e. in the direction of rotation along the front of the spiral path (S) which the material describes between the guide member (217) and the impact member (220). The aim of the preliminary guide member (257) and the subsequent guide member (264) is to guide the material more effectively along the respective spiral streams ($S_r$)(S), and to prevent, at least as far as possible, material from moving along the outside of this stream.

Figure 76:
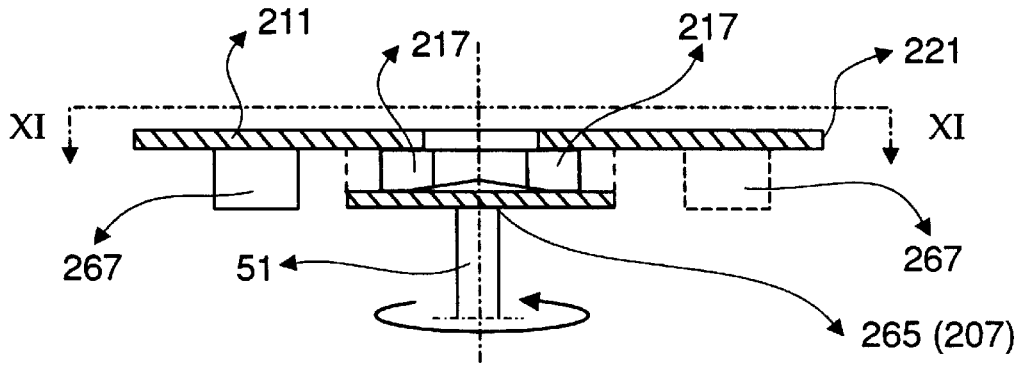
FIG. 76 diagrammatically shows a cross-section on XII—XII of a sixth embodiment, according to the method of the invention, of a rotor in which the guide members can be arranged at different radial distances from the axis of rotation (O), from FIG. 77.
Figure 77:
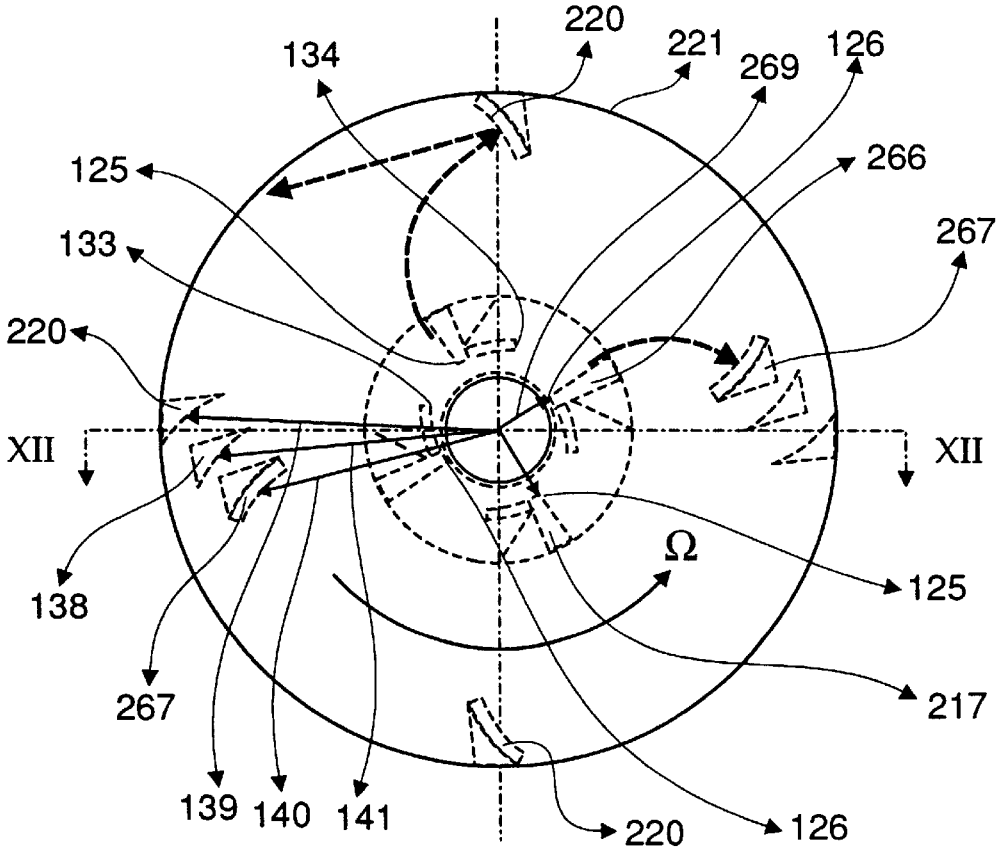
FIG. 77 diagrammatically shows a longitudinal section on XI—XI of a sixth embodiment, according to the method of the invention, of a rotor in which the guide members can be arranged at different radial distances from the axis of rotation (O), from FIG. 76.

FIG. 76 and FIG. 77 show a sixth embodiment according to the method of the invention of a rotor (265) in which the guide members (266) can be disposed at different radial distances from the axis of rotation (O).

The rotor (265) is essentially similar to the rotor (207) which is described in the second embodiment, with the exception of the impact members (220)(267), due to the fact that two impact members (267), which are arranged opposite one another and are fastened to the first rotor blade (211) along the bottom of the outer edge (221), are adjustable, so that they can be disposed at different (268), but, with regard to the balancing, equal radial distances from the axis of rotation (O) by comparison with, the other two impact members (220) arranged opposite one another. At the same time, by selecting the guide member (217), the mutually opposite central feeds of the guide members (217) can be disposed at different radial distances (267)(268) from the axis of rotation (O). A rotor (265) of this kind makes it possible to distribute the stream of material which is metered onto the rotor (265) in different quantities to the associated guide members (217)(269), from which guide members (217)(269) the respective streams are guided to rotatable impact members (220)(267), which are disposed at different radial distances (267)(268) from the axis of rotation (O), so that the grains from the respective streams impact at different velocities. As a result, the different streams are subjected to different loads. This makes it possible to control to a large extent the grain size distribution of the broken material.

Figure 78:
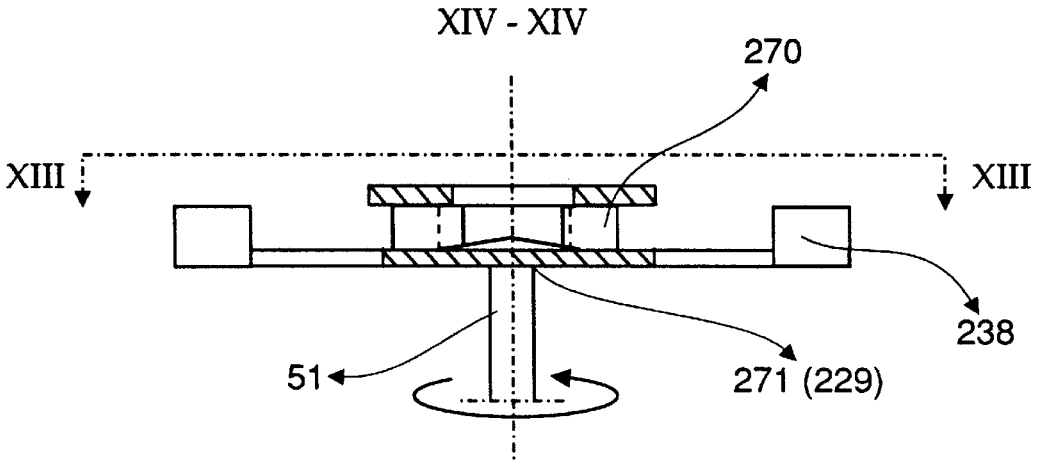
FIG. 78 diagrammatically shows a cross-section on XIV—XIV of a seventh embodiment, according to the method of the invention, in which the guide members are suspended in a pivoting manner, from FIG. 79.
Figure 79:
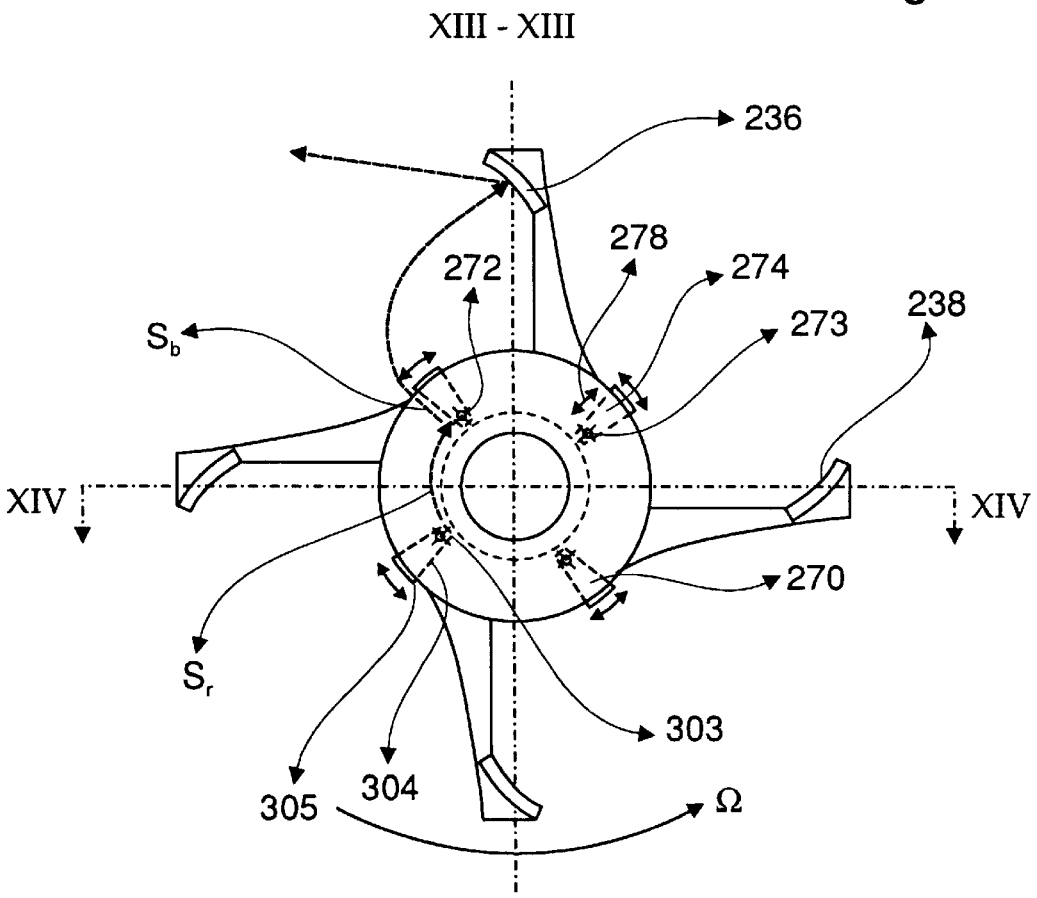
FIG. 79 diagrammatically shows a longitudinal section on XIII—XIII of a seventh embodiment, according to the method of the invention, in which the guide members are suspended in a pivoting manner, from FIG. 78.

FIG. 78 and FIG. 79 show a seventh embodiment according to the method of the invention in which the guide members (270) are pivotably suspended.

The rotor (271) is essentially similar to the rotor (229) which is described in the third embodiment, with the exception of the pivoting guide members (270), which are fastened to the rotor (271) by a vertical hinge (272), at a distance from the axis of rotation (O), the pivot point (273) lying at a shorter distance from the axis of rotation (O) than the mass centre (274) of the pivoting guide member (270). The delivery end (275) of a pivoting guide member (270) of this kind may, in the plane of the rotation, execute a certain level of reciprocating movement (277), under the effect of the varying loading of the stream ($S_r$)($S_b$) of material which is guided along the guide face (276) of the rotatable impact member (270), with the result that the impacts against the impact face (238) of the rotatable impact member (236) are spread to a certain extent, so that a more even wear pattern is obtained on this impact face (238). The magnitude of the reciprocating movement (277) can be controlled by selecting the distance (278) between the axis of rotation (O) and the mass centre (274), the reciprocating movement (277) increasing as this distance is made shorter. Furthermore, it is possible to limit the reciprocating movement (277) in the respective directions.

Figure 80:
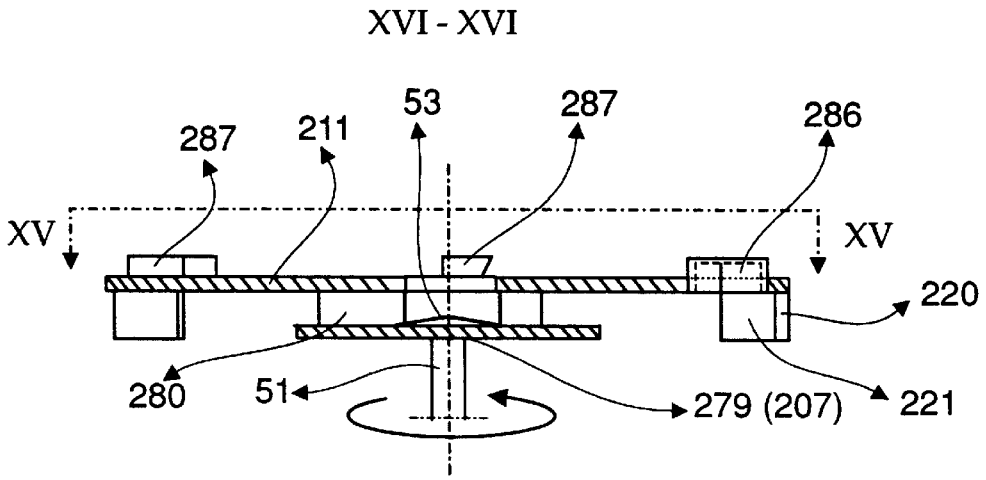
FIG. 80 diagrammatically shows a cross-section on XVI—XVI of an eight embodiment, according to the method of the invention, of a rotor, which is designed with an S-shaped guide member, a jet of air being guided along the impact face, from FIG. 81.
Figure 81:
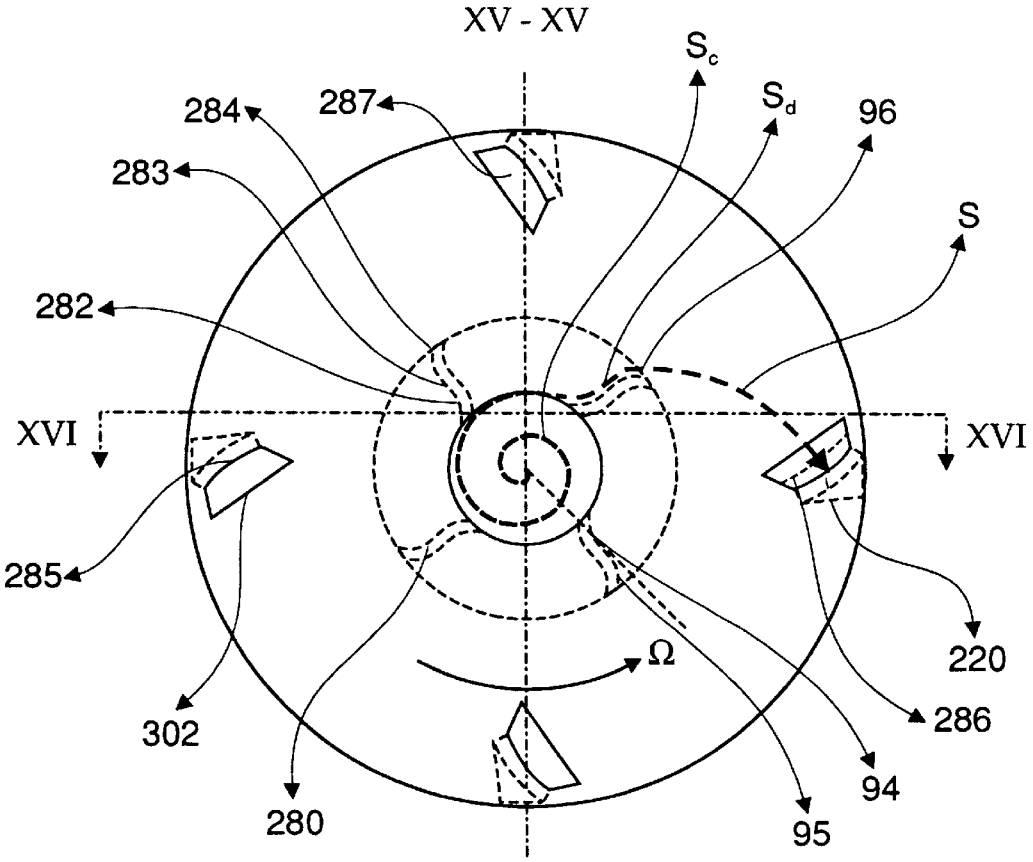
FIG. 81 diagrammatically shows a longitudinal section on XV—XV of an eight embodiment, according to the method of the invention, of a rotor, which is equipped with an S-shaped guide member, at jet of air being guided along the impact face, from FIG. 80.

FIG. 80 and FIG. 81 show an eight embodiment according to the method of the invention of a rotor (279) which is designed with an S-shaped guide member (280), in which a jet of air is guided along the impact face (221).

The rotor (279) is essentially similar to the rotor (207) described in the second embodiment, with the exception of the guide members (280), which are designed differently, while air-guidance members (281) are disposed above the impact members (220). The guide members (280) are designed with a central feed (282), which lies virtually as an extension of the spiral movement which the material describes at that location on the rotor (279), which central feed (282) is bent forwards in the direction of rotation and merges seamlessly into a straight guide face (283) which is directed slightly backwards in the direction of rotation, which guide face (283) merges seamlessly into a delivery end (284) which is bent backwards in the direction of rotation, and specifically is bent so far that this delivery end (284) lies virtually as a "natura" continuation of the spiral path (S) which the material describes between the guide member (280) and the impact member (220). A guide member (280) of this kind means that the material is taken up uniformly by the central feed (282) and is guided in a flowing movement to the guide face (283). Since the guide face (283) is directed slightly backwards, the stream of material ($S_r$) is directed, but it is not accelerated too much. The material comes off the backwardly bent delivery end (284) in a virtually "natura" manner, and is guided in the intended, essentially deterministic path (S) at a relatively low velocity. Slot-like openings (286) are arranged in the first rotor blade (211), along the front of the impact faces (221) of the rotatable impact members (220), above which openings a tube (287) is arranged, with the opening (302) in the direction of rotation, through which opening (302), during the rotational movement, air is taken up, which air as blown through the slot-like opening (286) at great speed, along the impact face (221) from the top downwards. This achieves the effect that the material, after impact, is moved in a stream which is directed downwards, as far as possible perpendicularly, when seen from a viewpoint which moves together with the impact face (221).

Figure 82:
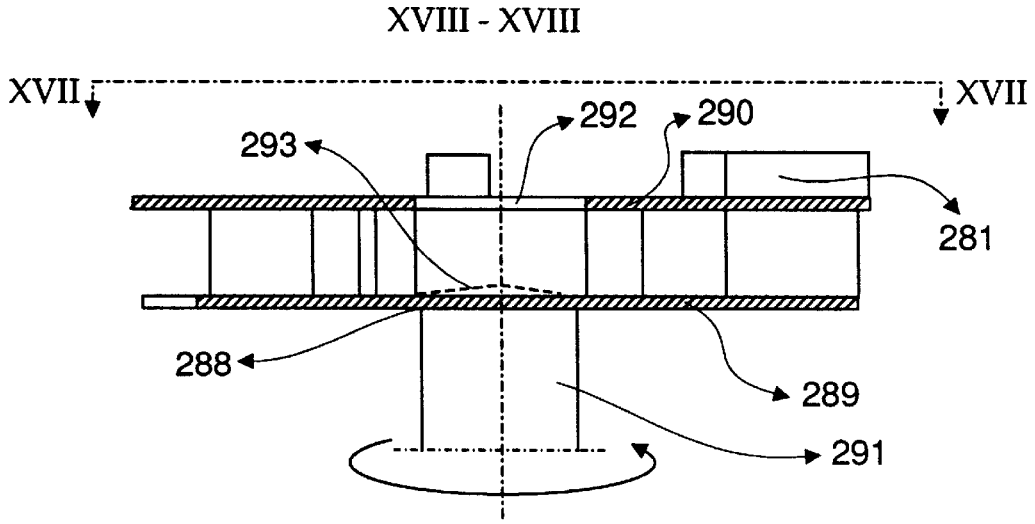
FIG. 82 diagrammatically shows a cross-section on XVIII—XVIII of a ninth embodiment, according to the method of the invention, of a rotor, from FIG. 83.
Figure 83:
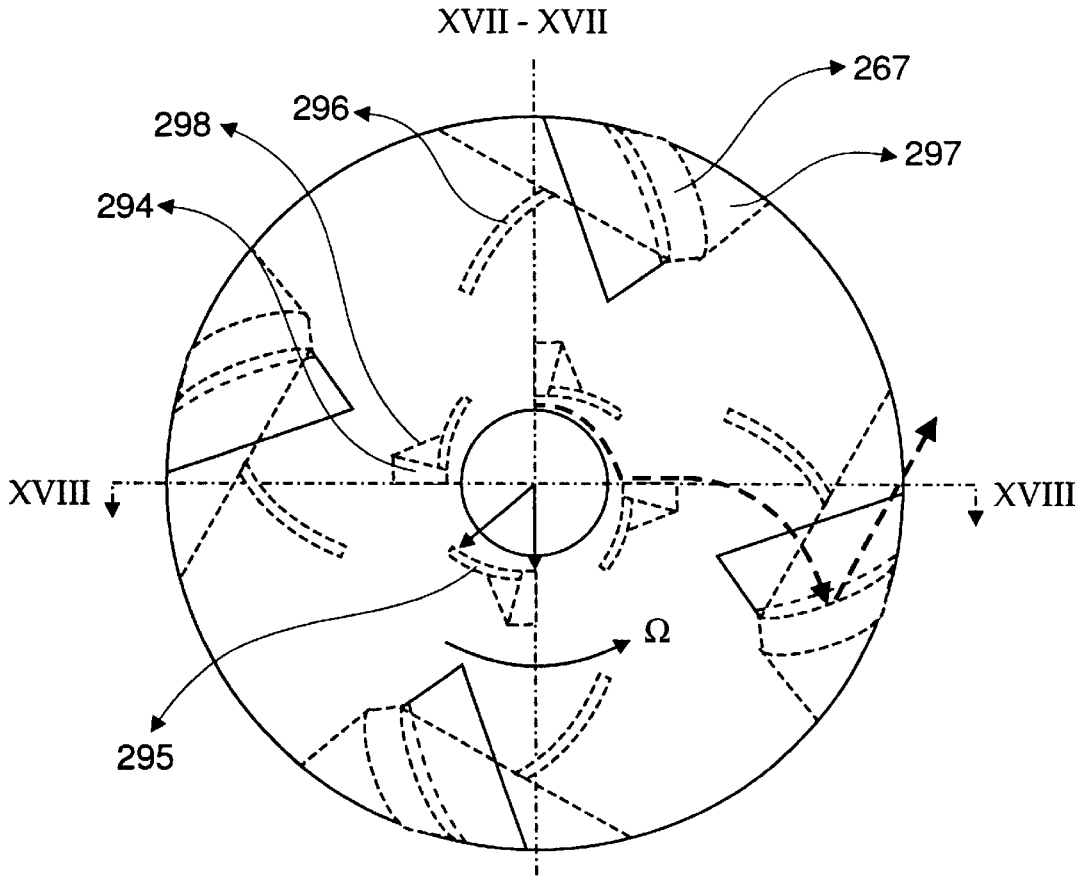
FIG. 83 diagrammatically shows a longitudinal section on XVII—XVII of a ninth embodiment, according to the method of the invention, of a rotor, from FIG. 82.

FIG. 82 and FIG. 83 show a ninth embodiment according to the method of the invention of a rotor (288).

The rotor (288) comprises two rotor blades (289)(290), which are supported by the same shaft (291) and have the same diameter. The first, upper rotor blade (290) is provided in the centre with an opening (292), through which the material can be metered onto the metering face (293) of the second rotor blade (289). This metering face (293) is designed in the form of an upright cone. Between the rotor blades (289)(290) there are clamped, as it were, four guide members (294) with associated preliminary guide members (295) and subsequent guide members (296) and impact members (297), at respectively greater radial distances from the axis of rotation (O). The two rotor blades (289)(290) are connected to one another by projections (297)(298), which are disposed behind the guide members (294)(298) and impact members (267)(297). Along the edge (299) of the second rotor blade (289), segment-like sections (301) are taken out of the second rotor blade (289) along the front of the impact faces (300), so that the material is not impeded when it is guided out of the rotor (290) from the impact faces (300). The first rotor blade (290) is equipped with air-guidance members (281), as described in the embodiment with the S-shaped guide members (279).

It will be apparent to those skilled in the art that various changes in the structure and relative arrangement of parts may be made without necessarily departing from the scope of the present invention as defined in the claims appended.

The following notations have been used in the text and are explained as follows.

$\theta$=included angle between the radial line on which is situated the location (W) where the said as yet uncollided stream of material (S) leaves ($r_1$) the said guide member and the radial line on which is situated the location (T) where the said as yet uncollided stream of material (S) strikes the rotating impact member (r), when seen from a viewpoint which moves along and on the understanding that a negative value of this angle ($\theta$) indicates a rotation in the opposite direction to the rotation of the said guide member.

$\beta$=the said included angle of impact with the said impact face, at the location where the said as yet uncollided stream of material hits the said impact face, when seen from a viewpoint which moves together with the said rotating impact member.

$\beta'$=the said included angle with the said impact face, at the location where the said as yet uncollided stream of material hits the said impact face, when seen in the plane of the rotation, and when seen from a viewpoint which moves together with the said rotating impact member, forms with the line which is directed perpendicular to the said radial line on which is situated the location where the said as yet uncollided stream of material leaves the said guide member $\beta''$=the said included angle of impact with the said impact face, when seen in the plane of the rotation, at the location where the said as yet uncollided stream of material hits the said impact face, when seen from a viewpoint which moves together with the said rotating impact member:

$\beta'''$=the said included angle of impact with the said impact face, when seen from the plane directed perpendicular to the plane of rotation, at the location where the said as yet uncollided stream of material hits the said impact face, when seen from a viewpoint which moves together with the said rotating impact member.

$V_{rel}$=relative velocity of the movement of the stream of materials when seen from a viewpoint which moves together with the said rotating impact member $V_{impact}$=relative velocity at which the said as yet uncollided stream of material strikes the said impact face, when seen from a viewpoint which moves together with the said rotating impact member $v_{abs}$=absolute velocity of the said as yet uncollided stream of material on leaving the said guide member, when seen from a stationary viewpoint $v_r$=radial velocity component of the absolute velocity ($v_{abs}$)

$v_t$=transverse velocity component of the absolute velocity ($v_{abs}$)

$v'_t$=transverse velocity component of the absolute velocity ($v_{abs}$) at a greater radial distance from the axis of rotation than the location where the stream of material leaves the guide member $v'_r$=radial velocity component of the absolute velocity ($v_{abs}$) at a greater radial distance from the axis of rotation than the location where the stream of material leaves the guide member $V_r$=radial velocity component of the relative velocity ($V_{rel}$) at the moment at which the stream of material leaves the guide member and is equal to $v_r$ $V'_r$=radial velocity component of the relative velocity ($V_{rel}$) at a greater radial distance from the axis of rotation than the location at which the stream of material leaves the guide member and is equal to $v'_r$ $V''_r$=radial velocity component of the relative velocity ($V_{rel}$) at a radial distance from the axis of rotation where the relative velocity ($V_{rel}$) of the stream of material is equal to $v_{abs}$ $V'_t$=relative transverse velocity component of the relative velocity (V) at a greater radial distance from the axis of rotation than the location where the stream of material leaves the guide member $v_{tip}$=peripheral velocity of the said location where the said as yet uncollided stream of material leaves the said guide member (tip velocity)

$V'_{tip}$=peripheral velocity of the said location where the said collided material is situated after it leaves the said guide member (relative tip velocity), when seen from a viewpoint which rotates together with the said rotating impact member r=the radial distance from the said axis of rotation to the location where the said stream of the said as yet uncollided material and the path of the said rotating impact member intersect one another $r_1$=the radial distance from the said axis of rotation to the location where the said as yet uncollided stream of material leaves the said guide member $r_0$=the radial distance from the axis of rotation to the location where the central feed is situated closest to the axis of rotation $r_c$=the radial distance from the axis of rotation to the location where the central feed merges into the guide face $\dot{r}$=radial component of the said impact velocity $r\dot{\theta}$=transverse component of the said impact velocity $\alpha$=the included angle between, on the one hand, the velocity of the location where the said as yet uncollided stream of material leaves the said guide member (tip velocity), equal in size to the product of the angular velocity ($\Omega$) and the radial distance from the said axis of rotation to the location where the said as yet uncollided material leaves ($r_1$) the said guide member, and, on the other hand, the absolute velocity ($v_{abs}$) of the said as yet uncollided stream of material on leaving the said guide member $\alpha_0$=the included angle between the radial line on which is situated the location where the stream of material leaves the guide member and the movement of the stream of material at the moment at which it leaves the guide member $\phi$=the angle between the said radial line on which is situated the location where the said as yet uncollided stream of material leaves the said guide member (the said tip of the said guide member), when seen front a stationary position at the moment at which the said as yet uncollided stream of material leaves the said guide member, and the radial line to the location where the said as yet uncollided material hits the said rotating impact member for the first time, when seen from a stationary position f=the ratio of, on the one hand, the magnitude of the velocity of the location on the guide member where the said as yet uncollided stream of material leaves the said guide member (tip velocity) and, on the other hand, the magnitude of the component of the absolute velocity ($v_{abs}$) of the said as yet uncollided stream of material parallel to the tip velocity, i.e. the product of cos ($\alpha$) and the magnitude of the absolute velocity ($v_{abs}$) on leaving the said guide member p=the path covered by the said as yet uncollided stream of material from the said location where the said as yet uncollided stream of material leaves the said guide member to the said location where the said as yet uncollided stream of material strikes the said rotating impact member $l_c$=minimum length of the central feed, which is given as the difference between the radial distance from the axis of rotation ($r_0$) to the location where the central feed is situated closest to the axis of rotation and the radial distance from the axis of rotation ($r_c$) to the location where the central feed merges into the guide face $l_c$=the minimum length of the guide face, which is given as the difference between the radial distance from the axis of rotation ($r_c$) to the location where the central feed merges into the guide face and the radial distance from the axis of rotation to the location where the guide face merges into the delivery end $\chi$=the angle between the radial line on which is situated the location where the central feed is situated closest to the axis of rotation and the radial line on which is situated the location where the material hits the guide member which follows in the direction of rotation $V_a$=the radial velocity component of the grain on the rotor at a radial distance ($r_0$) from the axis of rotation where the central feed is situated closet to the axis of rotation $\Omega$=the angular velocity of the rotor R=the straight stream which the material describes after it comes off the guide member, when seen from a stationary viewpoint $R_c$=the stream which the material describes on the central part of the rotor before it is taken up by the central feed, when seen from a stationary viewpoint $R_b$=the stream which the material describes along the guide member, when seen from a stationary viewpoint S=the spiral stream which the material describes after it comes off the guide member, when seen from a viewpoint which moves together with the said rotating impact member $S_c$=the spiral stream which the material describes on the central part of the rotor before it is taken up by the central feed, when seen from a viewpoint which moves together with the said impact member $S_b$=the stream which the material describes along the guide member, when seen from a viewpoint which moves together, with the rotating member $\kappa$=the angle between the radial line on which is situated the location where the central feed is situated closest to the axis of rotation and the radial line on which is situated the location where the material leaves the guide member $\xi$=the angle on which are situated the radial lines to the locations on the delivery end, where the material leaves the pivoting guide member, which are situated furthest forwards and furthest backwards in the direction of rotation.

We claim:

1. Method for making a stream of granular material collide in a rotating system which is disposed horizontally and rotates about a vertical shaft (1), with the aid of a rotating impact member (14), comprising the steps of:

feeding the said stream of material ($S_c$) to the central feed (9) of a guide member (8), which rotates about the axis of rotation (O) of the said rotating system;

guiding the said fed stream ($S_c$) of material from the said central feed (9), along the guide face (10), to the delivery end (11) of the said guide member (8), which delivery end (11) is situated at a greater radial distance from the said axis of rotation (O) than the said central feed (9), in such a manner that the said guided stream of material comes off the said guide member (8) wish at least a radial velocity component ($v_r$) and is guided in an essentially deterministic straight stream (R), when seen from a stationary viewpoint, and in an essentially deterministic spiral stream (S), when seen from a viewpoint which moves together with the said guide member (8);

using the said rotating impact member (14) to hit the said material which is moving in the said essentially deterministic spiral stream (S) and has not yet collided, which rotating impact member (14) is provided with an impact face (15) and rotates in the same direction, at the same angular velocity (Ω) and about the same axis of rotation (O) as the said guide member (8), at a hit location (T) which is behind, when seen in the direction of rotation, the radial line on which is situated the location (W) where the said as yet uncollided stream of material leaves the said guide member (8), and at a greater radial distance from the said axis of rotation (O) than the location at which the said as yet uncollided stream of material leaves the said guide member (8), the position of which hit location (T) is determined by selecting the angle (θ) between the radial line on which is situated the location (W) where the said as yet uncollided stream of material leaves the said guide member (8) and the radial line on which is situated the location where the stream (S) of the said as yet uncollided material and the path (C) of the said impact face (15) intersect one another in such a manner that the arrival of the said as yet uncollided stream (S) of material at the location where the said stream (S) and the said path (C) intersect one another is synchronized with the arrival at the same location of the said impact face (15).

2. Method according to claim 1, comprising the steps of:

metering the said stream of material onto a horizontally disposed metering face (3), which rotates in the same direction, at the same angular velocity (Ω) and about the same axis of rotation (O) as the said system, in a region close to the said axis of rotation (O);

guiding the said metered material, when seen from a viewpoint which moves together with the said metering face (3), onto the said rotating metering face (3), in a spiral stream ($S_c$) which is as far as possible natural and moves outwards, when seen from the said axis of rotation (O);

feeding the said metered material moving in the said natural, spiral stream ($S_c$) from the said rotating metering face (3) to the central feed (9) of a guide member (8), which central feed (9) is situated at a radial distance from the said axis of rotation (O) and rotates in the same direction, at the same angular velocity (Ω) and about the same axis of rotation (O) as the said metering face (3).

3. Method according to claim 1, comprising the steps of:

metering the said stream of material onto a horizontally disposed metering face (3), which rotates in the same direction, at the same angular velocity (Ω) and about the same axis of rotation (O) as the said system, in a region close to the said axis of rotation (O);

guiding the said metered material, when seen from a viewpoint which moves together with the said metering face (3), onto the said rotating metering face (3), in a spiral stream ($S_c$) which is as far as possible natural and moves outwards, when seen from the said axis of rotation (O);

distributing the said metered material moving in the said natural, spiral stream ($S_c$) from the said metering face (3) to the central inlet (5) of a preliminary guide member (4), which rotates in the same direction, at the same angular velocity (Ω) and about the same axis of rotation (O) as the said metering face (3);

the preliminary guidance of the said distributed stream ($S_c$) of material from the said central inlet (5), along the preliminary guide face (6), to the delivery location (7) of the said preliminary guide member (4), which is disposed along at least a section of the outside, when seen from the direction of rotation, of the said natural, spiral stream ($S_c$) which the said material on the said metering face (3) describes, which preliminary guide member (4) extends from the said central inlet (5) outwards, when seen from the axis of rotation (O), in a direction which is essentially opposite to the direction of rotation of the said rotating metering face (3), towards the said delivery location (7), which is directed towards the central feed (9) of a guide member (8), which rotates in the same direction, at the same angular velocity (Ω) and about the same axis of rotation (O) as the said preliminary guide member (4), which delivery end (11) is situated at a greater radial distance from the said axis of rotation (O) than the said central inlet (5), the distance between the said delivery location and the said central feed (9) being at least sufficiently large for the said stream of material to be able to be fed unimpeded to the said central feed (9) and the radial distance from the said axis of rotation (O) to the said central feed (9) is no greater than the corresponding radial distance to the said delivery location (7).

4. Method according to claim 1, comprising the step of:

feeding the said material moving in the said natural, spiral stream ($S_c$) to the central feed (9) of a guide member (8), which central feed (9) is situated at a radial distance from the said axis of rotation (O) and rotates in the same direction, at the same angular velocity (Ω) and about the same axis of rotation (O) as the said metering face (3) and is disposed in the said natural, spiral stream ($S_c$), when seen from a viewpoint which moves together with the said central feed (9), and extends as far as the outer edge (19) of the said natural, spiral stream ($S_c$), at the location of the said central feed (9), when seen from the said axis of rotation (O).

5. Method according to claim 1, comprising the step of:

feeding the said material moving in the said natural, spiral stream ($S_c$) to the central feed (9) of a guide member (8), which central feed (9) is situated at a radial distance from the said axis of rotation (O) and rotates in the same direction, at the same angular velocity (Ω) and about the same axis of rotation (O) as the said metering face (3) and is disposed in the said natural, spiral stream ($S_c$), when seen from a viewpoint which moves together with the said central feed (9), and extends as far as the outer edge (19) of the said natural, spiral stream ($S_c$), at the location of the said central feed (9), when seen from the said axis of rotation (O), the width ($l_c$) of the said spiral stream ($S_c$) at the location of the central feed (9), i.e. the difference between the radial distance from the said axis of rotation (O) to the start of the said central feed (9) and the corresponding radial distance to the end of the said central feed (9), determining the length ($l_c$) of the said central feed (9), which length ($l_c$) essentially satisfying the equation:

$$l_c \chi^V_a / \Omega$$

in which:

$l_c$=minimum length of the central feed, which is given as the difference between the radial distance from the axis of rotation ($r_0$) to the location where the central feed is situated closest to the axis of rotation and the radial distance from the axis of rotation ($r_c$) to the location where the central feed merges into the guide face $\chi$=the angle between the radial line on which is situated the location where the central feed is situated closest to the axis of rotation and the radial line on which is situated the location where the material hits the guide member which follows in the direction of rotation $V_a$=the radial velocity component of the grain on the rotor at a radial distance ($r_0$) from the axis of rotation where the central feed is situated closest to the axis of rotation $\Omega$=angular velocity of the said guide member.

6. Method according to claim 1, comprising the step of:

guiding the said fed stream of material from the said central feed (9), along the said guide face (10), to the said delivery end (11) of the said guide member (8), which delivery end (11) is situated behind, when seen in the direction of rotation, the radial line on which is situated the said central feed (9), which guide member (8) rotates at an angular velocity ($\Omega$) which is at least sufficiently great, is designed with a guide face (10) which has a length ($l_c$) which is at least sufficiently great and of which the said delivery end (11) is situated at a location at a radial distance ($r_1$) from the said axis of rotation (O) which is at least sufficiently greater than the radial distance ($r_0$) to the start point of said central feed (9) for the said fed stream of material to develop along the said guide face (10) a take-off velocity ($v_{abs}$) which is at least sufficiently great, with a radial velocity component ($v_r$) which is at least sufficiently great in relation to the transverse velocity component ($v_0$), for the said guided stream of material to come off the said guide member (8) from a predetermined take-off location (W), at a predetermined take-off angle ($\alpha$), which is greater than 0°, when seen from a stationary viewpoint, which is no longer affected by the angular velocity ($\Omega$) and to be guided in an essentially deterministic straight stream (R), when seen from a stationary viewpoint, and in an essentially deterministic spiral stream (S), when seen from a viewpoint which moves together with the said guide member (8).

7. Method according to claim 1, comprising the step of:

guiding the said fed stream of material from the said central feed (9), along the said guide face (10), to the said delivery end (11) of the said guide member (8)(173), which has in longitudinal direction, a layered structure with the evenly distributed layers, which successive layers have, from top to bottom, alternate higher (312) and lower (311) wear resistance, the top layer (310) and the bottom layer (313) having a higher wear resistance, resulting during operation in an evenly waved wear pattern, developing evenly distributed longitudinal guide channels (314) along the layers with the lower wear resistance layer (311), for guiding the material along the said guide member (8)(173), which guide member (173) rotates at an angular velocity ($\Omega$) which is at least sufficiently great, is designed with a guide face (10) which has a length ($l_c$) which is at least sufficiently great and of which the said delivery end (11) is situated at a location at a radial distance ($r_1$) from the said axis of rotation (O) which is at least sufficiently greater than the radial distance ($r_0$) to the start point of said central feed (9) for the said fed stream of material to develop along the said guide face (10) a take-off velocity ($v_{abs}$) which is at least sufficiently great, with a radial velocity component ($v_r$) which is at least sufficiently great in relation to the transverse velocity component ($v_l$), for the said guided stream of material to come off the said guide member (8)(173) from a predetermined take-off location (W), at a predetermined take-off angle ($\alpha$), which is greater than 0°, when seen from a stationary viewpoint, which is no longer affected by the angular velocity ($\Omega$) and to be guided in an essentially deterministic straight stream (R), when seen from a stationary viewpoint, and in an essentially deterministic spiral stream (S), when seen from a viewpoint which moves together with the said guide member (8)(173).

8. Method according to claim 1, comprising the step of:

when the said guided stream of material comes off the said guide member (8) from the said predetermined take-off location (W), at the said predetermined take-off angle ($\alpha$), at a take-off velocity ($v_{abs}$) to be selected with the aid of the angular velocity ($\Omega$), guiding the said guided material in an essentially deterministic straight stream (R), when seen from a stationary viewpoint, the direction of which straight stream (R) is not significantly affected by the angular velocity ($\Omega$) of the said guide member (8), along which straight stream (R) the velocity ($v_{abs}$) of the said material remains essentially constant and which straight stream (R), in the plane of the rotation, has a direction towards the outside, when seen from the said axis of rotation (O), and towards the front, when seen in the direction of rotation, the said take-off velocity ($v_{abs}$) being at least sufficiently great for the said straight stream (R) in the space immediately outside the periphery described by the said rotating guide member (8) not to be significantly affected by the force of gravity, the air resistance and any air movements.

9. Method according to claim 1, comprising the step of:

when the said guided stream of material comes off the said guide member (8), from the said predetermined take-off location (W), with the said radial velocity component ($v_r$) of the said take-off velocity ($v_{abs}$) to be selected with the aid of the angular velocity ($\Omega$), guiding the said guided material in an essentially deterministic spiral stream (S), which spiral stream (S) is not significantly affected by the angular velocity ($\Omega$) of the said guide member (8), along which spiral stream (S) the said material is accelerated in relative terms in the direction of the said impact face (15), when seen from a viewpoint which moves together with the said impact face (15), which spiral stream (S), in the plane of the rotation, has a direction towards the outside, when seen from the axis of rotation (O), and towards the rear, when seen in the direction of rotation, the said take-off velocity ($v_{abs}$) being at least sufficiently great for the said spiral stream (S) in the space directly outside the periphery described by the said rotating guide member (8) not to be significantly affected by the force of gravity, the air resistance and any air movements.

10. Method according to claim 1, comprising the step of:

when the said guided stream of material comes off the said guide member (8), from the said predetermined take-off location (W), with the said radial velocity component ($v_r$) of the said take-off velocity ($v_{abs}$) to be selected with the aid of the irregular velocity ($\Omega$), guiding the said guided material in an essentially deterministic spiral stream (S), which spiral stream (S) is not significantly affected by the angular velocity (Ω) of the said guide member (8), along which spiral stream (S) the said material is accelerated in relative terms in the direction of the said impact face (15), when seen from a viewpoint which moves together with the said impact face (15), which spiral stream (S), in the plane of the rotation, has a direction towards the outside, when seen from the axis of rotation (O), and towards the rear, when seen in the direction of rotation, the said take-off velocity ($v_{abs}$) being at least sufficiently great for the said spiral stream (S) in the space directly outside the periphery described by the said rotating guide member (8) not to be significantly affected by the force of gravity, the air resistance and any air movements, the air in the cylindrical space (20) between the said delivery end (11) and the said rotating impact member (14) being set in motion, with the aid of the said guide member (8), in such a manner that this air moves outwards at approximately the same radial velocity as the said material moving in the said spiral stream (S), and rotating in roughly the same direction, at the same angular velocity (Ω) and about the same axis of rotation (O) as the said rotating impact member (14), and the effect of air movements in the said cylindrical space (20) on the movement of the said stream of material being limited as far as possible.

11. Method according to claim 1, comprising the step of:

subsequently guiding the said material moving in the said spiral stream (S) in the direction of the said impact face (15), with the aid of a subsequent guide member (12), the subsequent guide face (13) of which extends, along at least a section of at least one side of the said spiral stream (S), from a subsequent guidance start (22) outwards, when seen from the axis of rotation (O), in a direction which is essentially opposite to the direction of rotation of the said rotating metering face (3), towards a subsequent guidance end (21), which lies at a greater radial distance from the said axis of rotation (O) than the said subsequent guidance start (22) and, when seen in the direction of rotation, lies behind the radial line on which is situated the location at which the said subsequent guidance start (22) is situated, the said subsequent guidance start (22) being disposed at a radial distance from the said axis of rotation (O) which is greater than the corresponding radial distance to the said delivery end (11), in such a manner that the said stream of material can come off the said delivery end (11) without being impeded and can be taken up by the said subsequent guide member (12), and the said subsequent guidance end (21) being disposed at a radial distance from the said axis of rotation (O) which is less than the corresponding radial distance to the said impact face (15), in such a manner, that the said subsequently guided stream of material can come off the said subsequent guidance end (21) without hindrance and can reach the said impact face (15) and come off the latter.

12. Method according to claim 1, comprising the step of:

using the said rotating impact member (14), which is situated entirely behind, when seen in the direction of rotation, the radial line on which is situated the location at which the said as yet uncollided stream of material leaves the said guide member (8), to hit the said as yet uncollided material moving in the said essentially deterministic spiral stream (S), which hitting takes place at a predetermined hit location (T), at a predetermined impact angle (β) and at an impact velocity ($V_{impact}$) to be selected with the aid of the angular velocity (Ω), which hit location (T) which lies behind, when seen in the direction of rotation, the radial line on which is situated the location (W) where the said as yet uncollided stream of material leaves the said guide member (8), and at a greater radial distance from the said axis of rotation (O) than the location (W) at which the said as yet uncollided stream of material leaves the said guide member (8), the position of which hit location (T) is determined by selecting the angle (θ) between the radial line on which is situated the location (W) where the said as yet uncollided stream of material leaves the said guide member (8) and the radial line on which is situated the location where the stream of the said as yet uncollided material and the path (C) of the said impact face (15) of the said rotation impact member, (14) intersect one another in such a manner that the arrival of the said as yet uncollided stream (S) of material at the location where the said stream (S) and the said path (C) intersect one another is synchronized with the arrival at the same location of the said impact face (15), which angle (θ) is unambiguously related to the radial distance (r) from the said axis of rotation (O) to the said hit location (T).

13. Method according to claim 1, comprising the step of:

after the said stream of material has collided for the first time with the said impact face (15) of the said rotating impact member (14) and has come off the said impact face (15), guiding the said material, which has collided once, in a straight stream ($R_r$), when seen from a stationary viewpoint, which straight stream ($R_r$), in the plane of the rotation, has a direction which is inclined forwards at an angle (β"), when seen in the said direction of rotation, and is inclined outwards, when seen from the said axis of rotation (O).

14. Method according to claim 1, comprising the step of:

after the said stream of material has collided for the first time with the said impact face (15) of the said rotating impact member (14) and has come off the said impact face (15), guiding the said material, which has collided once, in a straight stream ($R_r$), when seen from a stationary viewpoint, which straight stream ($R_r$), in the plane of the rotation, has a direction which is inclined forwards at an angle (β"), when seen in the said direction of rotation, and is inclined outwards, when seen from the said axis of rotation (O) and is inclined outwards, when seen from said plane of the rotation.

15. Method according to claim 1, comprising the step of:

immediately after the first impact, hitting the said material, which has collided once and is moving in the said straight stream ($R_r$), for a second time with a collision face (17) of a stationary impact member (16) which is disposed in the straight stream ($R_r$) which the said material describes, when seen from a stationary viewpoint, at a location outside at least one side of a cylindrical spice (20) which is defined by the said rotating impact member (14) and in which the said rotating impact member (14) rotates.

16. Method according to claim 1, for making a stream of material collide twice, in immediate succession, in a partially rotating, horizontally disposed system, with the aid of a rotating impact member (14) and a stationary impact member (16), comprising the steps of:

metering the said stream of material onto a horizontally disposed metering face (3), which rotates in the same direction, at the same angular velocity (Ω) and about the same axis of rotation (O) as the said system, in a region close to the said axis of rotation (O);

feeding the said material moving in the said natural, spiral stream ($S_c$) to the central feed (9) of a guide member (8), which central feed (9) is situated at a radial distance from the said axis of rotation (O) and rotates in the same direction, at the same angular velocity (Ω) and about the same axis of rotation (O) as the said metering face (3) and is disposed in the said natural, spiral stream ($S_c$), when seen from a viewpoint which moves together with the said central feed (9), and extends as far as the outer edge (19) of the said natural, spiral stream ($S_c$), at the location of the said central feed (9), when seen from the said axis of rotation (O);

guiding the said fed stream of material from the said central feed (9), along the said guide face (10), to the said delivery end (11) of the said guide member (8), which delivery end (11) is situated behind, when seen in the direction of rotation, the radial line on which is situated the said central feed (9), which guide member (8) rotates at an angular velocity (Ω) which is at least sufficiently great, is designed with a guide face (10) which has a length ($l_c$) which is at least sufficiently great and of which the said delivery end (11) is situated at a location at a radial distance ($r_1$) from the said axis of rotation (O) which is at least sufficiently greater than the radial distance ($r_0$) to the start point of said central feed (9) for the said fed stream of material to develop along the said guide face (10) a take-off velocity ($v_{abs}$) which is at least sufficiently great, with a radial velocity component ($v_r$) which is at least sufficiently great in relation to the transverse velocity component ($v_0$), for the said guided stream of material to come off the said guide member (8) from a predetermined take-off location (W), at a predetermined take-off angle (α), which is greater than 0°, when seen from a stationary viewpoint, which is no longer affected by the angular velocity (Ω) and to be guided in an essentially deterministic straight stream (R), when seen from a stationary viewpoint, and in an essentially deterministic spiral stream (S), when seen from a viewpoint which moves together with the said guide member (8);

when the said guided stream of material comes off the said guide member (8), from the said predetermined take-off location (W), with the said radial velocity component ($v_r$) of the said take-off velocity ($v_{abs}$) to be selected with the aid of the angular velocity (Ω), guiding the said guided material in an essentially deterministic spiral stream (S), which spiral stream (S) is not significantly affected by the angular velocity (Ω) of the said guide member (8), along which spiral stream (S) the said material is accelerated in relative terms in the direction of the said impact face (15), when seen from a viewpoint which moves together with the said impact face (15), which spiral stream (S), in the plane of the rotation, has a direction towards the outside, when seen from the axis of rotation (O), and towards the rear, when seen in the direction of rotation, the said take-off velocity ($v_{abs}$) being at least sufficiently great for the said spiral stream (S) in the space directly outside the periphery described by the said rotating guide member (8) not to be significantly affected by the force of gravity, the air resistance and any air movements;

using the said rotating impact member (14), which is situated entirely behind, when seen in the direction of rotation, the radial line on which is situated the location at which the said as yet uncollided stream of material leaves the said guide member (8), to hit the said as yet uncollided material moving in the said essentially deterministic spiral stream (S), which hitting takes place at a predetermined hit location (T), at a predetermined impact angle (β) and at an impact velocity ($V_{impact}$) to be selected with the aid of the angular velocity (Ω), which hit location (T) which lies behind, when seen in the direction of rotation, the radial line on which is situated the location (W) where the said as yet uncollided stream of material leaves the said guide member (8), and at a greater radial distance from the said axis of rotation (O) than the location (W) at which the said as yet uncollided stream of material leaves the said guide member (8), the position of which hit location (T) is determined by selecting the angle (θ) between the radial line on which is situated the location (W) where the said as yet uncollided stream of material leaves the said guide member (8) and the radial line on which is situated the location where the stream of the said as yet uncollided material and the path (C) of the said impact face (15) of the said rotation impact member, (14) intersect one another in such a manner that the arrival of the said as yet uncollided stream (S) of material at the location where the said stream (S) and the said path (C) intersect one another is synchronized with the arrival at the same location of the said impact face (15), which angle (θ) is unambiguously related to the radial distance (r) from the said axis of rotation (O) to the said hit location (T);

after the said stream of material has collided for the first time with the said impact face (15) of the said rotating impact member (14) and has come off the said impact face (15), guiding the said material, which has collided once, in a straight stream ($R_r$), when seen from a stationary viewpoint which straight stream ($R_r$), in the plane of the rotation, has a direction which is inclined forwards at an angle (β"), when seen in the said direction of rotation, and is inclined outwards, when seen from the said axis of rotation (O) and is inclined outwards, when seen from said plane of the rotation;

immediately after the first impact, hitting the said material, which has collided once and is moving in the said straight stream ($R_r$), for a second time with a collision face (17) of a stationary impact member (16) which is disposed in the straight stream ($R_r$) which the said material describes, when seen from a stationary viewpoint, at a location outside at least one side of a cylindrical space (20) which is defined by the said rotating impact member (14) and in which the said rotating impact member (14) rotates.

17. Method according to claim 16, comprising the step of:

creating a vacuum in the space (23) in which the said rotor (2), the said guide member (8), the said rotating impact member (14) and the said stationary impact member (16) are disposed.

18. Method according to claim 16, comprising the step of:

creating a low temperature in the space (23) in which the said rotor (2), the said guide member (8), the said rotating impact member (14) and the said stationary impact member (16) are disposed.

19. Method according to claim 16, the said rotor (28) bearing at least two guide members (24)(25), the radial distances (r')(r") from the said axis of rotation (O) to the said respective central feeds (30)(31).

20. Method according to claim 16, the said rotor (28) bearing at least two guide members (24)(25), the radial distances from the said axis of rotation (O) to the said respective central inlets (32)(33) not all being identical.

21. Method according claim 16, the said take-off velocity ($v_{abs}$), which is to be prescribed with the aid of the angular velocity (Ω) and at which the said stream of material comes off the said guide member (8), being at least 10 meters per second, when seen from a stationary viewpoint.

22. Method according to claim 16, the said predetermined take-off angle (α), which is formed by the said straight stream (R) which the said material describes at the moment at which the said stream of material comes off the said guide member (8), and the tangent ($t_w$) on the periphery which the said delivery end describes, being at least 30°, when seen from a stationary viewpoint.

23. Method according to claim 16, the said radial velocity component ($v_r$) of the take-off velocity ($v_{abs}$), at the moment a which the said stream of material comes off the said guide member (8), being at least 50% of the said transverse velocity component ($v_1$).

24. Method according to claim 16, the relationship between the said radial distance ($r_1$) from the said axis of rotation (O) to the end point of said delivery end (11) and the said corresponding radial distance ($r_c$) to the end point of the said central feed (9) essentially satisfying the equation:

$$\alpha = \arctan\left(\frac{\cos\alpha_0\sqrt{r_1^2 - r_c^2}}{r_1 - \sin\alpha_0\sqrt{r_1^2 - r_c^2}}\right)$$

where for radially designed guide member (8):

$$\frac{r_c}{r_1} = \sqrt{1 - \tan^2\alpha}$$

in which:

$r_1$=the radial distance from the said axis of rotation to the location where the said as yet uncollided stream of material leaves the said guide member;

$r_c$=the radial distance from the axis of rotation to the location where the central feed merges into the guide face;

α=the included angle between, on the one hand, the velocity of the location where the said as yet uncollided stream of material leaves the said guide member (tip velocity), equal in size to the product of the angular velocity (Ω) and the radial distance from the said axis of rotation to the location where the said as yet uncollided material leaves ($r_1$) the said guide member, and, on the other hand, the absolute velocity ($v_{abs}$) of the said as yet uncollided stream of material on leaving the said guide member.

$\alpha_0$=the included angle between the radial line on which is situated the location where the stream of material leaves the guide member and the movement of the stream of material at the moment at which it leaves the guide member.

25. Method according to claim 16, the said radial distance ($r_1$) from the said axis of rotation (O) to the end point of the said delivery end (11) being at least 33⅓% greater than the said corresponding radial distance ($r_0$) to the start point of the said central feed (9).

26. Method according to claim 16, the said angle (θ) between the radial line (48) on which is situated the location (W) at which the said as yet uncollided stream of material leaves the said guide member (8) and the radial line (49) on which is situated the location (T) at which the said stream (S) of the said as yet uncollided material and the path (C) of the said rotating impact member (14) intersect one another essentially satisfying the equation:

$$\theta = \arctan\left(\frac{p\cos\alpha}{p\sin\alpha + r_1}\right) - p\frac{\cos\alpha}{f r_1}$$

in which:

θ=included angle between the radial line oil which is situated the location (W) where the said as yet uncollided stream of material (S) leaves ($r_1$) the said guide member and the radial line on which is situated the location (T) where the said as yet uncollided stream of material (S) strikes the rotating impact member (r), when seen from a viewpoint which moves along and on the understanding that a negative value of this angle (θ) indicates a rotation in the opposite direction to the rotation of the said guide member;

r=the radial distance from the said axis of rotation to the location where the said stream of the said as yet uncollided material and the path of the said rotating impact member intersect one another;

$r_1$=the radial distance from the said axis of rotation to the location where the said as yet uncollided stream of material leaves thee said guide member;

α=the included angle between, on the one hand, the velocity of the location where the said as yet uncollided stream of material leaves the said guide member (tip velocity), equal in size to the product of the angular velocity (Ω) and the radial distance from the said axis of rotation to the location where the said as yet uncollided material leaves ($r_1$) the said guide member, and, on the other hand, the absolute velocity ($v_{abs}$) of the said as yet uncollided stream of material on leaving the said guide member;

f=the ratio of, on the one hand, the magnitude of the velocity of the location on the guide member where the said as yet uncollided them of material leaves the said guide member (tip velocity) and, on the other hand, the magnitude of the component of the absolute velocity ($v_{abs}$) of the said as yet uncollided stream of material parallel to the tip velocity, i.e. the product of cos(α) and the magnitude of the absolute velocity ($v_{abs}$) on leaving the said guide member.

$$f = \frac{v_{abs}\cos\alpha}{v_{tip}}$$

p=the path covered by the said as yet uncollided stream of material from the said location where the said as yet uncollided stream of material leaves the said guide member to the said location where the said as yet uncollided stream of material strikes the said rotating impact member;

$$p = r_1\left\{\sqrt{\frac{r^2}{r_1^2} - \cos^2\alpha} - \sin\alpha\right\}$$

on the understanding that a negative value of the said angle (θ) indicates a rotation in the opposite direction to the rotation of the said first rotating impact member (14) and the said guide member (8).

27. Method according to claim 16, the impact velocity ($V_{impact}$) at which the said as yet uncollided stream (S) of material is hit with the aid of the said rotating impact member (14) essentially satisfying the equation.

$$V_{impact}=\sqrt{\dot{r}^2+r^2\dot{\theta}^2}$$

in which;

$$\dot{\theta}=\left\{\frac{\cos\phi}{p\sin\alpha+r_1}\right\}^2 v_{abs}r_1\cos\alpha-\frac{v_{abs}\cos\alpha}{f\,r_1}$$

$$\dot{r}=v_{abs}\frac{p+r_1\sin\alpha}{r}$$

$$\phi=\arctan\left\{\frac{p\cos\alpha}{p\sin\alpha+r_1}\right\}$$

$$f=\frac{v_{abs}\cos\alpha}{v_{tip}}$$

$$p=r_1\left\{\sqrt{\frac{r^2}{r_1^2}-\cos^2\alpha}-\sin\alpha\right\}$$

$$r=\sqrt{r_1^2+2\,r_1\,p\sin\alpha+p^2}$$

$$v_{tip}=\Omega r_1$$

$V_{impact}$=relative velocity at which the said as yet uncollided stream of material strikes the said impact face, when seen from a viewpoint which moves together with the said rotating impact member;

θ=included angle between the radial line on which is situated the location (W) where the said as yet uncollided stream of material (S) leaves ($r_1$) the said guide member and the radial line on which is situated the location (T) where the said as yet uncollided stream of material (S) strikes the rotating impact member (r), when seen from a viewpoint which moves along and on the understanding that a negative value of this angle (θ) indicates a rotation in the opposite direction to the rotation of the said guide member;

$\dot{r}$=radial component of the said impact velocity;

$r\dot{\theta}$=transverse component of the said impact velocity;

$v_{abs}$=absolute velocity of the said as yet uncollided stream of material on leaving the said guide member, when seen from a stationary viewpoint;

$v_{tip}$=peripheral velocity of the said location where the said as yet uncollided stream of material leaves the said guide member (tip velocity);

α=the included angle between, on the one hand, the velocity of the location where the said as yet uncollided stream of material leaves the said guide member (tip velocity), equal in size to the product of the angular velocity (Ω) and the radial distance from the said axis of rotation to the location where the said as yet uncollided material leaves ($r_1$) the said guide member, and, on the other land, the absolute velocity ($v_{abs}$) of the said as yet uncollided stream of material on leaving the said guide member;

r=the radial distance from the said axis of rotation to the location where the said stream of the said as yet uncollided material and the path of the said rotating impact member intersect one another;

$r_1$=the radial distance from the said axis of rotation to the location where the said as yet uncollided stream of material leaves the said guide member;

p=the path covered by the said as yet uncollided stream of material from the said location where the said as yet uncollided stream of material leaves the said guide member to the said location where the said as yet uncollided stream of material strikes the said rotating impact member;

Ω=angular velocity of the said guide member;

φ=the angle between the said radial line on which is situated the location where the said as yet uncollided stream of material leaves the said guide member (the said tip of the said guide member), when seen from a stationary position at the moment at which the said as yet uncollided stream of material leaves the said guide member, and the radial line to the location where the said as yet uncollided material hits the said rotating impact member for the first time, when seen from a stationary position.

28. Method according to claim 16, the said impact face (15), at the location where the said as yet uncollided stream (S) of material hits the said impact face (15), when seen in the plane of the rotation, and when seen from a viewpoint which moves together with the said rotating impact member (14), forming an included angle (β') with a line (34) which is directed perpendicular to the said radial line (35) on which is situated the location at which the said stream of material leaves the said guide member (8), which angle (β') essentially satisfies the equation:

$$\beta'=\arctan\left\{\frac{\frac{r^2\cos\alpha}{f\,r_1}-\left\{\frac{r\cos\phi}{p\sin\alpha+r_1}\right\}^2 r_1\cos\alpha}{r_1\sin\alpha+p}\right\}-\theta$$

in which:

$$\theta=\arctan\left(\frac{p\cos\alpha}{p\sin\alpha+r_1}\right)-p\frac{\cos\alpha}{f\,r_1}$$

$$p=r_1\left\{\sqrt{\frac{r^2}{r_1^2}-\cos^2\alpha}-\sin\alpha\right\}$$

$$\phi=\arctan\left\{\frac{p\cos\alpha}{p\sin\alpha+r_1}\right\}$$

$$f=\frac{v_{abs}\cos\alpha}{v_{tip}}$$

$$v_{tip}=\Omega r_1$$

β'=the said included angle which the said impact face, at the location where the said as yet uncollided stream of material hits the said impact face, when seen in the plane of the rotation, and when seen from a viewpoint which moves together with the said rotating impact member, forms with the line which is directed perpendicular to the said radial line on which is situated the location where the said as yet uncollided stream of material leaves the said guide member, $v_{abs}$=absolute velocity of the said as yet uncollided stream of material on leaving the said guide member, when seen from a stationary viewpoint;

$V_{tip}$=peripheral velocity of the said location where the said as yet uncollided stream of material leaves the said guide member (tip velocity);

α=the included angle between, on the one hand, the velocity of the location where the said as yet uncollided stream of material leaves the said guide member (tip velocity), equal in size to the product of the angular velocity (Ω) and the radial distance from the said axis of rotation to the location where the said as yet uncollided material leaves ($r_1$) the said guide member, and, on the other hand, the absolute velocity ($v_{abs}$) of the said as yet uncollided stream of material on leaving the said guide member;

r=the radial distance from the said axis of rotation to the location where the said stream of the said as yet uncollided material and the path of the said rotating impact member intersect one another;

$r_1$=the radial distance from the said axis of rotation to the location where the said as yet uncollided stream of material leaves the said guide member;

θ=included angle between the radial line oil which is situated the location (W) where the said as yet uncollided stream of material (S) leaves ($r_1$) the said guide member and the radial line on which is situated the location (T) where the said as yet uncollided stream of material (S) strikes the rotating impact member (r), when seen front a viewpoint which moves along and on the understanding that a negative value of this angle (θ) indicates a rotation in the opposite direction to the rotation of the said guide member;

p=the path covered by the said as yet uncollided stream of material from the said location where the said as yet uncollided stream of material leaves the said guide member to the said location where the said as yet uncollided stream of material strikes the said rotating impact member;

Ω=angular velocity of the said guide member;

ϕ=the angle between the said radial line on which is situated the location where the said as yet uncollided stream of material leaves the said guide member (the said tip of the said guide member), when seen from a stationary position at the moment at which the said as yet uncollided stream of material leaves the said guide member, and the radial line to the location where the said as yet uncollided material hits the said rotating impact member for the first time, when seen from a stationary position.

29. Method according to claim 16, the impact face (15) of the said rotating impact member (14) being directed slightly inwards, when seen in the plane of the rotation, in such a manner that the said angle (β") which the said impact face (15) forms with the said spiral stream (S), at the location of the impact is greater than 90°, when seen from a viewpoint which moves together with the said rotating impact member (14).

30. Method according to claim 16, the said impact face (15) of the said rotating impact member (14) being directed slightly downwards, when seen from the plane directed perpendicular to the plane of the rotation, in such a manner that the said angle (β'") which the said impact face (15) forms with the said spiral stream (S), at the location of the impact, is greater than 90°, when seen from a viewpoint which moves together with the said rotating impact member (14).

31. Method according to claim 16, the impacts of the said as yet uncollided stream of material against the said impact face (15) of the said rotating impact member (14) taking place at an angle (β) of between 75° and 85°, when seen from a viewpoint which moves together with the said rotating impact member (14).

32. Method according to claim 16, the design and the geometry of the said guide member (8)(194) and of the said rotating impact member (14)(196) being mutually adapted to the shift (192) to the rear, when seen in the direction of rotation, of the said spiral stream (S) which the said material passes through between the said guide member (8)(194) and the said rotating impact member (14)(196), when seen from a viewpoint which moves together with the said rotating impact member (14)(196), which shift (192) occurs due to wear (195) on the said guide face (10)(193), and in particular at the said delivery end (11)(199), and specifically being adapted in such a manner that, in the event of wear (195) to the said guide member (8)(194), the said impact face (15) (36) always lies in the said spiral stream (S) of the said material.

33. Method according claim 16, the said rotor (2) bearing at least two rotating impact members (38)(39), the radial (r')(r") distances (40)(41) from the said axis of rotation (O) to the said respective rotating impact members (38)(39) not all being identical.

34. Method according to claim 16, the said stationary impact member (16) being equipped with at least one collision face (46) made of hard metal, which collision face (46) is directed virtually transversely to the straight stream ($R_r$) which the said material which has collided once describes when it comes off the said rotating impact member (14), when seen from a stationary viewpoint.

35. Method according to claim 16, the said stationary impact member (16) being equipped with at least one collision face (47), which is formed by a bed of its own material, which collision face (47) is directed it the straight stream ($R_r$) which the said material which has collided once describes when it comes off the said rotating impact member (14), when seen from it stationary viewpoint.

36. Method according to claim 16, a collision face (46) (47) being disposed in the said straight stream ($R_r$) which the said material describes when it comes off the said rotating impact member (14) in such a manner that the said impacts of the said as yet uncollided stream of material against the said collision face (46)(47) take place at a virtually perpendicular angle when seen from the plane of rotation and when seen from a stationary viewpoint.

37. Method according to claim 16, a collision face (46) (47) being disposed in the said straight stream ($R_r$) which the said material describes when it comes off the said rotating impact member (14) in such a manner that the said impacts of the said as yet uncollided stream of material against the said collision face (46)(47) take place at an angle of 75°–85°, when seen from a stationary viewpoint.

38. Method according to claim 1, with the object of comminuting granular and particulate material.

39. Method according to claim 1, with the object of working the shape of granular and particulate material.

40. Method according to claim 1, with the object of treating the surface of granular and particulate material.

41. Device for making a stream of granular material collide, comprising:

at least one rotor (52) which can rotate around a central, vertical axis of rotation (O) and is provided with a shaft (51);

at least one guide member (58) (217), which is supported by the said rotor (52) (207) (229) and is provided with a central feed (59), a guide face (60) and a delivery end (61), for respectively feeding, guiding, accelerating and delivering the said stream of material which, in a region close to the said axis of rotation (O), is metered onto the said rotor (52), which guide member (58) extends in the direction of the external edge (201) of the said rotor (52);

at least one rotatable impact member (64), which is associated with the said guide member (58) (217) and can rotate around the said axis of rotation (O), which rotatable impact member (64) (222) (227) (236) is equipped with an impact face (65) which lies entirely behind, when seen in the direction of rotation, the radial line on which is situated the location (W) at which the said as yet uncollided stream of material leaves the said guide member (58) and at a greater radial distance from the said axis of rotation (O) than the location (W) at which the said as yet uncollided stream of material leaves the said guide member (58), the position of which impact face (65) is determined by selecting the angle (θ) between the radial line on which is situated the location (W) at which the said as yet uncollided stream of material leaves the said guide member (58) and the radial line on which is situated the location at which the said essentially deterministic stream (S) of the said as yet uncollided stream of material and the path (C) of the said impact face (65) intersect one another, in such a manner that the arrival of the said as yet uncollided material at the location where the said stream (S) and the said path (C) intersect one another is synchronized with the arrival at the same location of the said impact face (65), which impact face (65) is directed virtually transversely, when seen in the plane of the rotation, to the spiral stream (S) which the said as yet uncollided material describes, when seen from a viewpoint which moves together with the said rotatable impact member (64).

42. Device according to one of claim 41, comprising:

metering means (200)(208)(209)(230)(245) for metering at least one stream (A) of one type of material or metering the said stream of material in parts;

a metering face (53)(213) which is supported by the said rotor (52)(214) and is disposed in the central region of the said rotor (52)(214), close to the axis of rotation (O) of the rotor (52)(124).

43. Device according to claim 42, comprising:

at least one preliminary guide member (257), which is associated with the said guide member (217) and is supported by the said rotor (255), for the preliminary guidance of the said metered stream of material from the said metering face (53) in the direction towards the central feed (260) of as guide member (53), which central inlet (218) is supported by the said rotor (255) and is provide distance from the said axis of rotation (O), which preliminary guide member (257) is provided with a preliminary guide face (262), which extends from a central inlet (258) in a direction, which is essentially opposite to the direction of rotation of the said rotatable metering face (255), towards a delivery location (263), which lies at a greater radial distance from the axis of rotation (O) than the central inlet (258), which preliminary guide face (262) as far as possible follows the outside, when seen from the axis of rotation (O), of the natural spiral stream ($S_c$) which the said material describes, at the location at the said rotatable metering face (58), the location of the said central inlet (258) coinciding with the location of the said central feed (259) and the distance between the said delivery location (263) and the said central feed (260) being at least sufficiently great for the said stream material to be able to be fed unimpeded to the said central feed (260).

44. Device according to claim 41, comprising:

at least one guide member (58)(217)(224), which is supported by the said rotor (52)(207)(229)(246) and is provided with a central feed (59), a guide face (60) and a delivery end (61), for respectively feeding, guiding, accelerating and delivering the said stream of material which, in a region close to the said axis of rotation (O), is metered onto the said rotor (52), which delivery end (61) is situated behind, when seen in the direction of rotation, the radial line on which is situated the said central feed (59), which central feed (59) is situated at such a radial distance from the said axis of rotation (O) and has a length ($l_c$) which is at least sufficiently great for the said stream of material to be taken up by the said central feed (55), which guide member (58), which extends from the edge of the said metering face (53) in the direction of the external edge of the said rotor (52), can be rotated at an angular velocity (Ω) which is at least sufficiently great and has a guide face (60) with a length ($l_g$) which is at least sufficiently great, for the radial distance ($r_1$) from the said axis of rotation (O) to the end point of the said delivery end (61) to be at least sufficiently greater than the corresponding radial distance ($r_0$) to the start point of the said central feed (59) for the said stream of material to be guided, from a predetermined take-off location (W) on the said delivery end (61), at a predetermined take-off angle (α) which is greater than 0°, when seen from a stationary viewpoint, in an essentially deterministic straight stream (R), when seen from a stationary viewpoint, and in the essentially deterministic spiral stream (S), when seen from a viewpoint which moves together with the said guide member (58).

45. Device according to claim 41, comprising:

at least one guide member (58)(173)(217)(224), which is supported by the said rotor (52)(207)(229)(246) and is provided with a central feed (59), guide face (60) and a delivery end (61), for respectively feeding, guiding, accelerating and delivering the said stream of material which, in a region close to the said axis of rotation (O), is metered onto the said rotor (52), which delivery end (61) is situated behind, when seen in the direction of rotation, the radial line on which is situated the said central feed (59), which central feed (59) is situated at such a radial distance from the said axis of rotation (O) and has a length ($l_c$) which is at least sufficiently great for the said stream of material to be taken up by the said central feed (55), which guide member (58)(173)(217)(224), which extends from the edge of the said metering face (53) in the direction of the external edge of the said rotor (52), can be rotated at an angular velocity (Ω) which is at least sufficiently great and has a guide face (60) with a length ($l_g$) which is at least sufficiently great, for the radial distance ($r_1$) from the said axis of rotation (O) to the end point of the said delivery end (61) to be at least sufficiently greater than the corresponding radial distance ($r_0$) to the start point of the said central feed (59) for the said the stream of material to be guided from a predetermined take-off location (W) on the said delivery end (61), at a predetermined take-off angle (α) which is greater 0°, when seen from a stationary viewpoint, in an essentially deterministic straight stream (R), when seen from a stationary viewpoint, and in an essentially deterministic spiral stream (S), when seen from a viewpoint which moves together with the said guide member (58) which guide member (58)(173)(217)(224), in longitudinal direction has a layered structure, with at least five horizontal layers (311)(312)evenly distributed on top of each other, composing a structure with an alternate higher (312) and lower (311) wear resistance, with top layer (310) and the bottom layer (313) having a higher wear resistance.

46. Device according to claim 41, comprising:

at least on guide member (280), which is supported by the said rotor (279) and is provided with a central feed (282), a guide face (283) and a delivery end (284) for respectively feeding, guiding, accelerating and delivering the said stream of material which, in a region close to the said axis of rotation (O), is metered onto the said rotor (279), which guide member (280) has a type of S-shape and extends in the direction of the edge of the said rotor (279), the said central feed (282) being situated at such a radial distance from the said axis of rotation (O) and having a length ($l_c$) which is at least sufficiently great for the said stream of material ($S_c$) to be taken up by the said central feed (282) and extends, from the edge of the said metering face (53), as far as possible out of the continuation of the said natural, spiral stream ($S_c$) which the said material describes at the location on the said metering face (53), in an increasingly radial, bent-forwards direction, when seen in the direction of rotation, which bent-forwards central feed (282) gradually merges into a straight guide face (283) which is inclined backwards, when seen in the direction of rotation, and extends further outwards, when seen from the direction of rotation, which straight, backwardly directed guide face (283) merges onto a delivery end (284) which is bent backwards, when seen in the direction of rotation, in such a manner that the location (95) at which the said guide face (283) merges into the said bent delivery end (284) lies behind, when seen in the direction of rotation, the radial line on which is situated the location (94) at which the central feed (282) merges into the said guide face (283), the said bend of the said delivery end (284) extending to approximately the location (96) where the said material comes off the said guide member (280) in a natural manner, when seen from a viewpoint which moves together with the said guide manner (280), which guide face (283) has a length ($l_g$) which is at least sufficiently great for the radial distance ($r_1$) from the said axis of rotation (O) to the end point of the said delivery end (284) to be at least sufficiently greater than the corresponding radial distance ($r_0$) to the start point of the said central feed (282) for the said stream of material to be guided, from an essentially predetermined take-off location (W), onto the said delivery end (284), which bends continually further backwards, when seen in the direction of rotation, at an essentially predetermined take-off angle ($\alpha$), which is greater than 0°, when seen from a stationary viewpoint, and in an essentially deterministic straight stream ($R_r$), when seen from a stationary viewpoint, and in an essentially deterministic spiral stream (S), when seen from a viewpoint which moves together with the said guide member (280).

47. Device according to claim 41, comprising:

at least one pivoting guide member (270), which is supported by the said rotor (271) and is provided with a central feed (303), a guide face (304) and a delivery end (305) for respectively feeding, guiding, accelerating and delivering the said stream of material which is metered onto the said rotor (271), which central feed (303) is situated at such a radial distance from the said axis of rotation (O) and has such a length ($l_c$) that the said stream of material ($S_c$) is taken up by the said central feed (303), which pivoting guide member (270), which extends from the external edge of the said metering face (53) in the direction of the external edge of the said rotor (271), can be rotated at an angular velocity ($\Omega$) which is at least sufficiently great and has a guide face (304) with a length ($l_g$) which is at least sufficiently great for radial distance ($r_1$) from the said axis of rotation (O) to the end point of the said delivery end (305) to be at least sufficiently greater than the corresponding radial distance ($r_0$) to the start point of the said central feed (303) for the said stream of material to be guided, from an essentially predetermined take-off location (W) on the said delivery end (305), at an essentially predetermined take-off angle ($\alpha$) which is greater than 0°, when seen from a stationary viewpoint, in an essentially deterministic spiral stream (S), when seen from a viewpoint which moves together with the said pivoting guide member (270), which pivoting guide member (270), at a distance from the said axis of rotation (O), is connected by mean of a vertical hinge (272) to the said rotor (271), with the vertical pivot point (273) at a radial distance (278) from the said axis of rotation (O) which is less than the corresponding radial distance to the mass centre (274) of the said pivoting guide member (270)).

48. Device according to claim 41, comprising:

a subsequent guide member (62), which is provided with a subsequent guide face (63), which subsequent guide member (62) is supported by the said rotor (255) and is disposed between the said delivery end (306) and the said impact face (307), with the said subsequent guide face (63) along at least a section of at least one side of the said spiral stream (S) which the said material describes between the said delivery end (306) and the said impact face (307), when seen from a viewpoint which moves together with the said rotatable impact member (309).

49. Device according to claim 41, comprising:

at one rotatable impact member (64)(227)(236), which is associated with the said guide member (59)(217)(234), can rotate around the said axis of rotation (O) and is supported by the said rotor (52)(207)(229)(246), which rotatable impact member (64) is equipped with an impact face (65) which lies entirely behind, when seen in the direction of rotation, the radial line on which is situated the location (W) at which the said as yet uncollided stream of material leaves the said guide member (58) and at a greater radial distance from the said axis of rotation (O) than the location (W) at which the said as yet uncollided stream of material leaves the said guide member (58), the position of which impact face (65) is determined by selecting the angle ($\theta$) between the radial line on which is situated the location (W) at which the said as yet uncollided stream of material leaves the said guide member (58) and the radial line on which is situated the location at which the said essentially deterministic stream (S) of the said as yet uncollided stream of material and the path (C) of the said impact face (65) intersect one another, in such a manner that the arrival of the said as yet uncollided material at the location where the said stream (S) and the said impact face (65), which impact face (65) is direct virtually transversely and the said path (C) intersect one another is synchronized with the arrival at the same location of the said impact face (65), which impact face (65) is directed virtually transversely and slightly inwards, where seen from the said axis of rotation (O) and when seen in the plane of the rotation, to the spiral stream (S) which the said as yet uncollided material describes, when seen from a viewpoint which moves together with the said rotatable impact member (64) the angle ($\theta$) having an unambiguous relationship with the radial distance from the axis of rotation (O) to the said impact face (65).

50. Device according to one of claim 41, comprising:

at least one stationary impact member, which stationary impact member (202)(224)(239) is disposed in the straight stream ($R_r$) which the said material describes when it comes off the said rotatable impact member (64)(227)(236), when seen from a stationary viewpoint, at a location outside at least one side of a cylindrical space which is defined by the said rotatable impact member (64)(227)(236) and in which the said rotatable impact member (64)(227)(230) rotates.

51. Device according to claim 41, comprising at least one slot-like opening arranged along the front and along the top of the impact face of the rotatable impact member, above which slot-like opening an air-guidance member (145) is arranged, with the opening in the direction of the rotation, which slot-like opening and which air-guidance member are supported by said rotatable impact member.

52. Device according to claim 41, comprising:

a space in which the said rotor (52)(207)(229)(246)(255)(266)(271)(279)(288), the said guide member, the said rotatable impact member and the said stationary impact member are disposed and in which a vacuum can be created.

53. Device according to claim 41, comprising:

a space in which the said rotor (52)(207)(229)(246)(255)(260)(271)(279)(288), the said guide member, the said rotatable impact member and the said stationary impact member are disposed and in which a low temperature can be created.

54. Device according to claim 41, for making a stream of granular material collide twice immediately in succession, comprising:

at least one shaft (51) which can rotate around a central, vertical axis of rotation (O), which shaft (51) bears a rotor (207), which comprises a first rotor blade (211) and a second rotor blade (214) positioned directly beneath the latter, which first rotor blade (211) has a larger diameter than the second rotor blade (214) and is provided in the central part with an opening (212) for metering material onto the said second rotor blade (214);

metering means (200)(208)(209) for metering at least one stream (A) of one type of material or metering the said stream of material in parts;

a metering face (213) which is supported by the said rotor (207) and is disposed in the central region of the said rotor (207), close to the axis of rotation (O) of the rotor (207);

at least one guide member (217), which is supported by the said second rotorblade (214) and is provided with a central feed (121), a guide face (122) and a delivery end (219), for respectively feeding, guiding, accelerating and delivering the said stream of material which, in a region close to the said axis of rotation (O), is metered onto the said second rotorblade (214), which delivery end (219) is situated behind, when seen in the direction of rotation, the radial line on which is situated the said central feed (121), which central feed (121) is situated at such a radial distance form the said axis of rotation (O) and has a length ($l_c$) which is at least sufficiently great for the said stream of material to be taken up by the said central feed (121), which guide member (217), which extends from the edge of the said metering face (213) in the direction of the external edge of the said rotor (207), can be rotated at an angular velocity (Ω) which is at least sufficiently great and has a guide face (122) with a length ($l_g$) which is at least sufficiently great, for the radial distance ($r_1$) from the said axis of rotation (O) to the end point of the said delivery end (219) to be at least sufficiently greater than the corresponding radial distance ($r_0$) to the start point of the said central feed (121) for the said stream of material to be guided, from a predetermined take-off location (W) on the said delivery end (219), at a predetermined take-off angle (α) which is greater than 0°, when seen from a stationary viewpoint, in an essentially deterministic straight stream (R), when seen from a stationary viewpoint, and in an essentially deterministic spiral stream (S), when seen from a viewpoint which moves together with the said guide member (217);

at least one rotatable impact member (227), which is associated with the said guide member (217), can rotate around the said axis of rotation (O) and is freely suspended, at a greater radial distance from the axis of rotation (O) than the guide member (217), along the bottom of the edge (221) of the first rotorblade (211), which rotatable impact member (217) is equipped with an impact face (222) which lies entirely behind, when seen in the direction of rotation, the radical line on which is situated the location (W) at which the said as yet uncollided stream of material leaves the said guide member (217) and at a greater radial distance from the said axis of rotation (O) than the location (W) at which the said as yet uncollided stream of material leaves the said guide member (217), the position of which impact face (222) is determined by selecting the angle (θ) between the radial line on which is situated the location (W) at which the said as yet uncollided stream of material leaves the said guide member (217) and the radial line on which is situated the location at which the said essentially deterministic stream (S) of the said as yet uncollided stream of material and the path (C) of the said impact face (222) intersect one another, in such a manner that the arrival of the said as yet uncollided material at the location where the said stream (S) and the said path (C) intersect one another is synchronized with the arrival at the same location of the said impact face (222), which impact face (222) is directed virtually transversely and slightly inwards, when seen from the said axis of rotation (O) and when seen in the plane of the rotation a viewpoint which moves together with the said rotatable impact member (227) the angle (θ) having an unambiguous relationship with the radial distance from the axis of rotation (O) to the said impact face (222);

at least one stationary impact member, which stationary impact members (224) is disposed in the straight stream ($R_1$) which the said material describes when it comes off the said rotatable impact member (227), when seen from a stationary viewpoint, at a location outside at least one side of a cylindrical space which is defined by the said rotatable impact member (227) and in which the said rotatable impact member (227) rotates.

55. Device according to claim 41, the said rotor (265) bearing at least to guide members (217)(266), the radial distances (268)(269) from the said axis of rotation (O) to the said respective central feeds (125)(126).

56. Device according to claim 41, the said rotor (265) bearing at least two guide members (217)(266), the radial distances (268)(269) from the said axis of rotation (O) to the said respective central inlets (133)(134) not all being identical.

57. Device according to claim 41, the length ($l_c$) of the said central feed (59)(121), i.e. the difference between the radial distance from the said axis of rotation (O) to the start point of the said central feed (59)(121) and the corresponding radial distance to the end point of the said central feed (59)(121), essentially satisfying the equation:

$$l_c = \frac{\chi V_a}{\Omega}$$

in which:

$l_c$=minimum length of the central feed, which is given as the difference between the radial distance from the axis of rotation ($r_0$) to the location where the central feed is situated closest to the axis of rotation and the radial distance from the axis of rotation ($r_c$) to the location where the central feed merges into the guide face;

$\chi$=the angle between the radial line on which is situated the location where the central feed is situated closest to the axis of rotation and the radial line on which is situated the location where the material hits the guide member which follows in the direction of rotation;

$V_n$=the radial velocity component of the grain on the rotor at a radial distance ($r_0$) from the axis of rotation where the central feed is situated closest to the axis of rotation;

$\Omega$=angular velocity of the said guide member.

58. Device according to claim 41, the said take-off velocity ($v_{abs}$), which is to do prescribed with the aid of the angular velocity ($\Omega$) and at which the said stream of material comes off the said guide member (58)(217), being at least 10 meters per second when seen from a stationary viewpoint.

59. Device according to claim 41, the said predetermined take-off angle ($\alpha$), which is formed by the said straight stream (R) which the said material describes at the moment at which the said stream of material comes off the said guide member (58)(517), and the tangent ($t_w$) on the periphery (C) which the said delivery end (61)(219) describes, being at least 30°, when seen from a stationary viewpoint.

60. Device according to claim 41, the said radial velocity component ($v_r$) of the take-off velocity ($v_{abs}$), at the moment at which the said stream of material comes off the said guide member (58)(217), being at least 50% of the said transverse velocity component ($v_r$).

61. Device according to claim 41, the relationship between the said radial distance ($r_1$) from the said axis of rotation (O) to the end point of said optionally moving delivery end (61) and the said corresponding radial distance ($r_c$) to the end point of the said central feed (59) essentially satisfying the equation:

$$\alpha = \arctan\left(\frac{\cos\alpha_0\sqrt{r_1^2 - r_c^2}}{r_1 - \sin\alpha_0\sqrt{r_1^2 - r_c^2}}\right)$$

where for radially designed guide member (8):

$$\frac{r_c}{r_1} = \sqrt{1 - \tan^2\alpha}$$

in which;

$r_1$=the radial distance from the said axis of rotation to the location where the said as yet uncollided stream of material leaves the said guide member;

$r_c$=the radial distance from the axis of rotation to the location where the central feed merges into the guide face;

$\alpha$=the included angle between, on the one hand, the velocity of the location where the said as yet uncollided stream of material leaves the said guided member (tip velocity), equal in size to the product of the angular velocity ($\Omega$) and the radial distance from the said axis of rotation to the location where the said as yet uncollided material leaves ($r_1$) the said guide member, and, on the other hand, the absolute velocity ($v_{abs}$) of the said as yet uncollided stream of material on leaving the said guide member;

$\alpha_0$=the included angle between the radial line on which is situated the location where the stream of material leaves the guide member and the movement of the stream of material at the moment at which it leaves the guide member.

62. Device according to claim 61, the said radial distance ($r_1$) form the said axis of rotation (O) to the end point of the said optionally moving delivery end (61)(219)(305) being at least 33⅓% greater than the said corresponding radial distance ($r_0$) to the start point of the said central feed (59)(121)(303).

63. Device according to claim 41, the said rotor (265) bearing at least two rotatable impact members (138)(220)(267), the radial (r')(r") distances (139)(140)(141) from the said axis of rotation (O) to the said respective rotatable impact members (139)(220)(267) not all being identical.

64. Device according to claim 41, the said angle ($\theta$) between the radial line (48) on which is situated the location (W) at which the said as yet uncollided stream of material leaves the said guide member (8)(58)(217)(234) and the radial line (49) on which is situated the location (T) at which the said stream (S) of the said as yet uncollided material and the path (C) of the said rotatable impact member (14)(64)(227)(236) intersect one another essentially satisfying the equation:

$$\theta = \arctan\left(\frac{p\cos\alpha}{p\sin\alpha + r_1}\right) - p\frac{\cos\alpha}{f r_1}$$

in which:

$\theta$=included angle between the radial line on which is situated the location (W) where the said as yet uncollided stream of material (S) leaves ($r_1$) the said guide member and the radial line on which is situated the location (T) where the said as yet uncollided stream of material (S) strikes the rotatable impact member (r), when seen from a viewpoint which moves along and on the understanding that a negative value of this angle ($\theta$) indicates a rotation in the opposite direction to the rotation of the said guide member, r=the radial distance from the said axis of rotation to the location where the said stream of the said as yet uncollided material and the path of the said rotatable impact member intersect one another;

$r_1$=the radial distance from the said axis of rotation to the location where the said as yet uncollided stream of material leaves the said guide member;

$\alpha$=the included angle between, on the one hand, the velocity of the location where the said as yet uncollided stream of material leaves the said guide member (tip velocity), equal in size to the product of the angular velocity ($\Omega$) and the radial distance from the said axis of rotation to the location where the said as yet uncollided material leaves ($r_1$) the said guide member, and, on the other hand, the absolute velocity ($v_{abs}$) of the said as yet uncollided stream of material on leaving the said guide member;

f=the ratio of, on the one hand, the magnitude of the velocity of the location on the guide member where the said as yet uncollided stream of material leaves the said guide member (tip velocity) and, on the other hand, the magnitude of the component of the absolute velocity ($v_{abs}$) of the said as yet uncollided stream of material parallel to the tip velocity, i.e. the product of cos(α) and the magnitude of the absolute velocity ($v_{abs}$) on leaving the said guide member;

$$f = \frac{v_{abs} \cos \alpha}{v_{tip}}$$

p=the path covered by the said as yet uncollided stream of material from the said location where the said as yet uncollided stream of material leaves the said guide member to the said location where the said as yet uncollided stream of material strikes the said rotatable impact member;

$$p = r_1 \left\{ \sqrt{\frac{r^2}{r_1^2} - \cos^2 \alpha} - \sin \alpha \right\}$$

on the understanding that a negative value of the said angle (θ) indicates a rotation in the opposite direction to the rotation of the said first rotatable impact member (14)(64)9227)(236) and the said guide member (8)(58)(217)(234).

65. Device according to claim 41, the impact velocity ($V_{impact}$) at which the said as yet uncollided stream (S) of material is hit with the aid of the said rotatable impact member (14)(64)(227)(236) essentially satisfying the equation:

$$V_{impact} = \sqrt{\dot{r}^2 + r^2 \dot{\theta}^2}$$

in which:

$$\dot{\theta} = \left\{ \frac{\cos \phi}{p \sin \alpha + r_1} \right\}^2 v_{abs} r_1 \cos \alpha - \frac{v_{abs} \cos \alpha}{f r_1}$$

$$\dot{r} = v_{abs} \frac{p + r_1 \sin \alpha}{r}$$

$$\phi = \arctan \left\{ \frac{p \cos \alpha}{p \sin \alpha + r_1} \right\}$$

$$f = \frac{v_{abs} \cos \alpha}{v_{tip}}$$

$$p = r_1 \left\{ \sqrt{\frac{r^2}{r_1^2} - \cos^2 \alpha} - \sin \alpha \right\}$$

$$r = \sqrt{r_1^2 + 2 r_1 p \sin \alpha + p^2}$$

$$v_{tip} = \Omega r_1$$

$V_{impact}$=relative velocity at which the said as yet uncollided stream of material strikes the said impact face, when seen from a viewpoint which moves together with the said rotatable impact member, θ=included angle between the radial line on which is situated the location (W) where the said as yet uncollided stream of material (S) leaves ($r_1$) the said guide member and the radial line on which is situated the location (T) where the said as yet uncollided stream of material (S) strikes the rotatable impact member (r), when seen from a viewpoint which moves along and on the understanding that a negative value of this angle (θ) indicates a rotation in the opposite direction to the rotation of the said guide member;

$\dot{r}$=radial component of the said impact velocity;

$r\dot{\theta}$=transverse component of the said impact velocity;

$v_{abs}$=absolute velocity of the said as yet uncollided stream of material on leaving the said guide member, when seen from a stationary viewpoint;

$v_{tip}$=peripheral velocity of the said location where the said as yet uncollided stream of material leaves the said guide member (tip velocity);

α=the included angle between, on the one hand, the velocity of the location where the said as yet uncollided stream of material leaves the said guide member (tip velocity); equal in size to the product of the angular velocity (Ω) and the radial distance from the said axis of rotation to the location where the said as yet uncollided material leaves ($r_1$) the said guide member, and, on the other hand, the absolute velocity ($v_{abs}$) of the said as yet uncollided stream of material on leaving the said guide member;

r=the radial distance from the said axis of rotation to the location where the said stream of the said as yet uncollided material and the path of the said rotatable impact member intersect one another;

$r_1$=the radial distance from the said axis of rotation to the location where the said as yet uncollided stream of material leaves the said guide member;

p=the path covered by the said as yet uncollided stream of material from the said location where the said as yet uncollided stream of material leaves the said guide member to the said location where the said as yet uncollided stream of material strikes the said rotatable impact member;

Ω=angular velocity of the said guide member;

φ=the angle between the said radial line on which is situated the location where the said as yet uncollided stream of material leaves the said guide member (the said tip of the said guide member), when seen from a stationary position at the moment at which the said as yet uncollided stream of material leaves the said guide member, and the radial line to the location where the said as yet uncollided material hits the said rotatable impact member for the first time, when seen from a stationary position.

66. Device according to claim 41, the said impact face (15)(65)(222)(238), at the location where the said as yet uncollided stream (S) of material hits the said impact face (15)(65)(222)(238), when seen in the plane of the rotation, and when seen from a viewpoint which moves together with the said rotatable impact member (14)(64)(227)(236), forming an included angle (β') with a line (34) which is directed perpendicular to the said radial line (35) on which is situated the location at which the said stream of material leaves the said guide member (8)(58)(217), which angle (β') essentially satisfies the equation:

$$\beta' = \arctan \left\{ \frac{\frac{r^2 \cos \alpha}{f r_1} - \left\{ \frac{r \cos \phi}{p \sin \alpha + r_1} \right\}^2 r_1 \cos \alpha}{r_1 \sin \alpha + p} \right\} - \theta$$

-continued in which:

$$\theta = \arctan\left(\frac{p\cos\alpha}{p\sin\alpha + r_1}\right) - p\frac{\cos\alpha}{f r_1}$$

$$p = r_1\left\{\sqrt{\frac{r^2}{r_1^2} - \cos^2\alpha} - \sin\alpha\right\}$$

$$\phi = \arctan\left\{\frac{p\cos\alpha}{p\sin\alpha + r_1}\right\}$$

$$f = \frac{v_{abs}\cos\alpha}{v_{tip}}$$

$$v_{tip} = \Omega r_1$$

β'=the said included angle which the said impact face, at the location where the said as yet uncollided stream of material hits the said impact face, when seen in the plane of the rotation, and when seen from a viewpoint which moves together with the said rotatable impact member, forms with the line which is directed perpendicular to the said radial line on which is situated the location where the said as yet uncollided stream of material leaves the said guide member;

$v_{abs}$=absolute velocity of the said as yet uncollided stream of material on leaving the said guide member, when seen from a stationary viewpoint;

$v_{tip}$=peripheral velocity of the said location where the said as yet uncollided stream of material leaves the said guide member (tip velocity);

α=the included angle between, on the one hand, the velocity of the location where the said as yet uncollided stream of material leaves the said guide member (tip velocity), equal in size to the product of the angular velocity (Ω) and the radial distance from the said axis of rotation to the location where the said as yet uncollided material leaves ($r_1$) the said guide member, and, on the other hand, the absolute velocity ($v_{abs}$) of the said as yet uncollided stream of material on leaving the said guide member;

r=the radial distance from the said axis of rotation to the location where the said stream of the said as yet uncollided material and the path of the said rotatable impact member intersect one another;

$r_1$=the radial distance from the said axis of rotation to the location where the said as yet uncollided stream of material leaves the said guide member;

θ=included angle between the radial line on which is situated the location (W) where the said as yet uncollided stream of material (S) leaves ($r_1$) the said guide member and the radial line on which is situated the location (T) where the said as yet uncollided stream of material (S) strikes the rotatable impact member (r), when seen from a viewpoint which moves along and on the understanding that a negative value of this angle (θ) indicates a rotation in the opposite direction to the rotation of the said guide member;

p=the path covered by the said as yet uncollided stream of material from the said location where the said as yet uncollided stream of material leaves the said guide member to the said location where the said as yet uncollided stream of material strikes the said rotatable impact members;

Ω=angular velocity of the said guide member;

ϕ=the angle between the said radial line on which is situated the location where the said as yet uncollided stream of material leaves the said guide member (the said tip of the said guide member), when seen from a stationary position at the moment at which the said as yet uncollided stream of material leaves the said guide member, and the radial line to the location where the said as yet uncollided material hits the said rotatable impact member for the first time, when seen from a stationary position.

67. Device according to claim 66, the impact face (15)(65)(222)(238) of the said rotatable impact member (14)(64)(227)(236) being directed slightly inwards, when seen in the plane of the rotation, in such a manner that the said angle (β"), which the said impact face (15)(65)(222)(238) forms with the said spiral stream (S), at the location of the impact is greater than 90°, when seen from a viewpoint which moves together with the said rotatable impact member (14)(64)(227)(236).

68. Device according to claim 66, the said impact face (15)(65)(222)(238) of the said rotatable impact member (14)(64)(227)(236) being directed slightly downwards, when seen from the plane directed perpendicular to the plane of the rotation, in such a manner that the said angle (β''') which the said impact face (15)(65)(222)(238) forms with the said spiral stream (S), at the location of the impact, is greater than 90°, when seen from a viewpoint which moves together with the said rotatable impact member (14)(64)(227)(236).

69. Device according to claim 41, the impacts of the said as yet uncollided stream of material against the said impact face (15)(65)(222)(238) of the said rotatable impact member (14)(64)(227)(236) taking place at an angle (β) of between 75° and 85°, when seen from a viewpoint which moves together with the said rotatable impact member (14)(64)(227)(236).

70. Device according to claim 41, the design and the geometry of the said guide member (8)(58)(217) and of the said rotatable impact member (14)(64)(227)(236) being mutually adapted to the shift (192) to the rear, when seen in the direction of rotation, of the said spiral stream (S) which the said material passes through between the said guide member (8)(58)(217) and the said rotatable impact member (14)(64)(227)(236), when seen from a viewpoint which moves together with the said rotatable impact member (14)(64)(227)(236), which shift (192) occurs due to wear (195) on the said guide face (10)(60)(122), and in particular at the said delivery end (11)(61)(219), and specifically being adapted in such a manner that, in the event of wear (195) to the said guide member (8)(58)(217), the said impact face (15)(65)(222)(238) always lies in the said spiral stream (S) of the said material.

71. Device according to claim 41, the said stationary impact member (202)(224) being equipped with at least one collision face (206)(223) made of hard metal, which collision face (206)(223) is directed virtually transversely to the straight stream ($R_r$) which the said material which has collided once describes when it comes off the said rotatable impact member (64)(227), when seen from a stationary viewpoint.

72. Device according to claim 41, the said stationary impact member (244)(309) being equipped with at least one collision face (241)(248), which is formed by a bed of its own material, which collision face (241)(248) is directed at the straight stream ($R_r$) which the said material which has collided once describes when it comes off the said rotatable impact member (227)(238), when seen from a stationary viewpoint.

73. Device according to claim 41, the said collision face (206)(223)(241)(248) being curved in such a manner and disposed transversely in the straight stream ($R_r$) which the said material describes when it comes off the said rotatable impact member (64)(227)(238) in such a manner that the said impacts of the said stream of material which has collided once against the said collision face (206)(223)(241)(248) take place as far as possible a virtually perpendicular angle when seen from the plane of rotation and when seen from a stationary viewpoint.

74. Device according to claim 41, the said collision face (206)(223)(241)(248) being curved in such a manner and disposed transversely in the straight stream ($R_r$) which the said material describes when it comes off the said rotatable impact member (64)(227)(238) in such a manner that the said impacts of the said stream of material which has collided once against the said collision face (206)(223)(241)(248) take place as far as possible at an angle of 75°–85°, when seen from a stationary viewpoint.

75. Device according to claim 41, the said collision face (206)(223)(241)(248) being curved concavely, in accordance with the involute (17) which the stream (R) describes from the periphery (C) which the rotatable impact member describes.

76. Device according to claim 41, the said collision face (248) of the stationary impact members (251) being equipped with horizontal plates (309) below and along the front of the collision face (248), which horizontal plates (309) are optionally removeable.

77. Device according to claim 41, the said collision face (241) being being adjustable in height (315) parallel to the said axis of rotation (O).

* * * * *

UNITED STATES PATENT AND TRADEMARK OFFICE

CERTIFICATE OF CORRECTION

PATENT NO. : 5,860,605

DATED : January 19, 1999

INVENTOR(S) : Johannes Petrus Andreas Josephus

It is certified that error appears in the above-indentified patent and that said Letters Patent is hereby corrected as shown below:

On the title page: Item [56]

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | 3 | 7 | 6 | 7 | 6 | 0 | | | 07/32 | Great Britain | | | | |
| | 1 | 0 | 0 | 0 | 1 | 1 | 1 | | 10/96 | Netherlands | | | | |
| | 1 | 2 | 4 | 8 | 6 | 5 | 5 | | 08/86 | Russia (with English Abstracts) | | | | |
| | | | | | | | | | | | | | | |

UNITED STATES PATENT AND TRADEMARK OFFICE

CERTIFICATE OF CORRRECTION

PATENT NO. : 5,860,605
DATED : January 19, 1999
INVENTOR(S) : Johannes Petrus Andreas Josephus

It is certified that error appears in the above-identified patent and that said Letters Patent is hereby corrected as shown below:

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | 2 | 0 | 0 | 5 | 6 | 8 | 0 | | 12/69 | France | | | | x |
| | 2 | 4 | 1 | 2 | 3 | 4 | 8 | | 7/79 | France | | | | x |
| | 4 | 4 | 1 | 3 | 5 | 3 | 2 | | 10/95 | Germany | | | | x |
| | 9 | 3 | 0 | 8 | 8 | 6 | 0 | 0.4 | 12/94 | Germany | | | | x |
| | 3 | 0 | 9 | 8 | 5 | 4 | | | 6/28 | Great Britain | | | | x |
| | | | | | | | | | | | | | | |

Signed and Sealed this

Ninth Day of November, 1999

*Attest:*

Q. TODD DICKINSON

*Attesting Officer*

*Acting Commissioner of Patents and Trademarks*